US010068534B2

(12) United States Patent
Yang et al.

(10) Patent No.: US 10,068,534 B2
(45) Date of Patent: Sep. 4, 2018

(54) DISPLAY DEVICE HAVING A PLURALITY OF SUB-PIXELS WITH DIFFERENT HEIGHTS AND DRIVING MODULE THEREOF

(71) Applicant: NOVATEK Microelectronics Corp., Hsin-Chu (TW)

(72) Inventors: Kai-Min Yang, Kaohsiung (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 60 days.

(21) Appl. No.: 14/813,109

(22) Filed: Jul. 29, 2015

(65) Prior Publication Data

US 2016/0155398 A1 Jun. 2, 2016

(30) Foreign Application Priority Data

Dec. 2, 2014 (TW) ..... 103141859 A

(51) Int. Cl.
*G09G 3/36* (2006.01)

(52) U.S. Cl.
CPC ... *G09G 3/3607* (2013.01); *G09G 2300/0426* (2013.01); *G09G 2300/0452* (2013.01);
(Continued)

(58) Field of Classification Search
CPC ..... G09G 3/3607
(Continued)

(56) References Cited

U.S. PATENT DOCUMENTS 5,642,176 A * 6/1997 Abukawa ..... G02F 1/133514 349/106
6,750,875 B1 6/2004 Keely, Jr.
(Continued)

FOREIGN PATENT DOCUMENTS

CN 1722193 A 1/2006
CN 1836188 A 9/2006
(Continued)

OTHER PUBLICATIONS

Yang, Title of Invention: Display Device and Driving Module thereof, U.S. Appl. No. 14/730,245, filed Jun. 4, 2015.
(Continued)

*Primary Examiner* — Long D Pham
(74) *Attorney, Agent, or Firm* — Winston Hsu

(57) ABSTRACT

A display device includes a plurality of sub-pixel groups. Each sub-pixel group includes a first sub-pixel located at a first column; a second sub-pixel located at a second column adjacent to the first column; a third sub-pixel located a third column adjacent to the second column; a fourth sub-pixel located at the third column; a fifth sub-pixel located at a fourth column adjacent to the third column; and a six sub-pixel located at the fourth column; wherein height of the first sub-pixel is different from or/equal to height of the second sub-pixel, a sum of heights of the third sub-pixel and the fourth sub-pixel, and a sum of heights of the fifth sub-pixel and the sixth sub-pixel; wherein height of the third sub-pixel is different from or equal to height of the fourth sub-pixel; wherein height of the fifth sub-pixel is different from or equal to height of sixth sub-pixel.

8 Claims, 37 Drawing Sheets

(52) U.S. Cl.
CPC ..... *G09G 2300/0465* (2013.01); *G09G 2330/021* (2013.01)

(58) Field of Classification Search
USPC ..... 345/87
See application file for complete search history.

(56) References Cited

U.S. PATENT DOCUMENTS

| | | | | |
|---|---|---|---|---|
| 6,867,549 | B2 | 3/2005 | Cok | |
| 6,903,754 | B2 | 6/2005 | Brown Elliott | |
| 8,552,635 | B2 | 10/2013 | Kim | |
| 2004/0085495 | A1 | 5/2004 | Roh | |
| 2005/0068477 | A1 | 3/2005 | Shin | |
| 2005/0270444 | A1* | 12/2005 | Miller | G09G 3/3216 349/108 |
| 2009/0121983 | A1 | 5/2009 | Sung | |
| 2011/0291550 | A1* | 12/2011 | Kim | G09G 3/2003 313/504 |
| 2013/0050282 | A1* | 2/2013 | Kim | G09G 3/3413 345/690 |
| 2014/0204008 | A1 | 7/2014 | Chu-Ke | |
| 2015/0061978 | A1 | 3/2015 | Shih | |
| 2015/0380471 | A1 | 12/2015 | Guo | |

FOREIGN PATENT DOCUMENTS

| | | | |
|---|---|---|---|
| CN | 1941060 | A | 4/2007 |
| CN | 1991463 | A | 7/2007 |
| CN | 101271234 | A | 9/2008 |
| CN | 101276109 | A | 10/2008 |
| CN | 102262854 | A | 11/2011 |
| CN | 102354701 | A | 2/2012 |
| CN | 103809313 | A | 5/2014 |
| CN | 104091567 | A | 10/2014 |
| CN | 203870947 | U | 10/2014 |
| JP | 2002-6303 | A | 1/2002 |
| JP | 2005129505 | A | 5/2005 |
| JP | 2008-122473 | A | 5/2008 |
| TW | 200849167 | | 12/2008 |
| TW | 201033682 | | 9/2010 |
| TW | 201035655 | | 10/2010 |
| TW | 201145242 | | 12/2011 |
| TW | 201227704 | | 7/2012 |

OTHER PUBLICATIONS

Yang, Title of Invention: Display Device and Driving Module thereof, U.S. Appl. No. 14/730,247, filed Jun. 4, 2015.

* cited by examiner

DISPLAY DEVICE HAVING A PLURALITY OF SUB-PIXELS WITH DIFFERENT HEIGHTS AND DRIVING MODULE THEREOF

BACKGROUND OF THE INVENTION

1. Field of the Invention

The present invention relates to a display device and driving module thereof, and more particularly, to a display device reducing power consumption and increasing brightness via changing sub-pixel arrangement method and driving module thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

An image quality of the LCD can be determined via counting a number of pixels of the LCD located in a direction. For example, the user may acquire a reference of determining the image quality of the LCD via calculating the pixels per inch (PPI). Please refer to FIG. 1, which is a schematic diagram of the relationship between the image quality and the PPI. As shown in FIG. 1, the image quality is proportional to the PPI. However, recognizing ability of the eyes has a limit. When the PPI of the LCD exceeds a threshold, the eyes generally cannot recognize each pixel of the LCD. In other words, the image viewed by the eyes would become no-grid if the PPI of the LCD exceeds the threshold.

For example, under a condition that the visual acuity of the user is 1.0 and a distance between the eyes and the LCD is 12 inches, it may be difficult for the user to recognize distances between the pixels of the LCD when the PPI of the LCD exceeds 286. In other words, the image received by the eyes becomes no-grid if the PPI of the LCD reaches 286. In such a condition, the number of sub-pixels corresponding to each pixel can be accordingly decreased, to increase the aperture ratio and to reduce the power consumption of the LCD. Thus, how to decrease the number of sub-pixel while maintaining the image quality becomes a topic to be discussed.

SUMMARY OF THE INVENTION

In order to solve the above problem, the present invention provides a reducing power consumption and increasing brightness via changing pixel arrangement method and driving module thereof.

As an aspect, a display device with a plurality of sub-pixel groups is disclosed. Each of sub-pixel groups comprises a first sub-pixel, a second sub-pixel, a third sub-pixel, a fourth sub-pixel, a fifth sub-pixel, and a sixth sub-pixel. In an embodiment, the first pixel is located at a first column, the second sub-pixel is located at a second column adjacent to the first column, the third sub-pixel is located at a third column adjacent to the second column, the fourth sub-pixel is located at the third column, the fifth sub-pixel is located at a fourth column adjacent to the third column, and the sixth sub-pixel is located at the fourth column. In addition, a height of the first sub-pixel is different from or equal to a height of the second sub-pixel; a height of the first sub-pixel is greater than heights of the third sub-pixel and the fourth sub-pixel. The height of the first sub-pixel is greater than or equal to a sum of the heights of the third sub-pixel and the fourth sub-pixel. The height of the first sub-pixel is different from or equal to a sum of the heights of the fifth sub-pixel and the sixth sub-pixel; and the height of the third sub-pixel is different from or equal to the height of the fourth sub-pixel and the height of the fifth sub-pixel is different from or equal to the height of the sixth sub-pixel. Via adapting the above sub-pixel groups, the aperture ratio and brightness of the display device are improved.

As another aspect, a driving module used for driving a display device to display images is disclosed. The display device comprises a plurality of sub-pixel groups. Each of sub-pixel groups comprises a first sub-pixel, a second sub-pixel, a third sub-pixel, a fourth sub-pixel, a fifth sub-pixel, and a sixth sub-pixel. In an embodiment, the first pixel is located at a first column, the second sub-pixel is located at a second column adjacent to the first column, the third sub-pixel is located at a third column adjacent to the second column, the fourth sub-pixel is located at the third column, the fifth sub-pixel is located at a fourth column adjacent to the third column, and the sixth sub-pixel is located at the fourth column. In addition, a height of the first sub-pixel is different from or equal to a height of the second sub-pixel; a height of the first sub-pixel is greater than heights of the third sub-pixel and the fourth sub-pixel. The height of the first sub-pixel is greater than or equal to a sum of the heights of the third sub-pixel and the fourth sub-pixel. The height of the first sub-pixel is different from or equal to a sum of the heights of the fifth sub-pixel and the sixth sub-pixel; and the height of the third sub-pixel is different from or equal to the height of the fourth sub-pixel and the height of the fifth sub-pixel is different from or equal to the height of the sixth sub-pixel. Via the arrangement of each of the sub-pixel groups, the aperture ratio and brightness of the display device are improved.

As another aspect, a display device with a plurality of sub-pixel groups is disclosed. Each of sub-pixel groups comprises a first sub-pixel, a second sub-pixel, a third sub-pixel, a fourth sub-pixel, a fifth sub-pixel, a sixth sub-pixel, and a seventh sub-pixel. In the embodiment, the first sub-pixel is located at a first column; the second sub-pixel is located at a second column adjacent to the first column; the third sub-pixel is located at the second column; the fourth sub-pixel is located at a third column adjacent to the second column; the fifth sub-pixel is located at the third column; the sixth sub-pixel is located at a fourth column adjacent to the third column; and the seventh sub-pixel is located at the fourth column. In addition, a height of the first sub-pixel is greater than heights of the second sub-pixel, the third sub-pixel, the fourth sub-pixel, the fifth sub-pixel, the sixth sub-pixel and the seventh sub-pixel. The height of the first sub-pixel is different from or equal to a sum of the heights of the second sub-pixel and the third sub-pixel. The height of the first sub-pixel is different from or equal to a sum of the heights of the fourth sub-pixel and the fifth sub-pixel. The height of the first sub-pixel is different from or equal to a sum of the heights of the sixth sub-pixel and the seventh sub-pixel. The height of the second sub-pixel is different from or equal to the height of the third sub-pixel, the height of the fourth sub-pixel is different from or equal to the height of the fifth sub-pixel, and the height of the sixth sub-pixel is different from or equal to the height of the seventh sub-pixel. Via adapting the above sub-pixel groups, the aperture ratio and brightness of the display device are improved.

As to another aspect, a driving module used for driving a display device to display images is disclosed. The display device comprises a plurality of sub-pixel groups. Each of sub-pixel groups comprises a first sub-pixel, a second sub-pixel, a third sub-pixel, a fourth sub-pixel, a fifth sub-pixel, a sixth sub-pixel, and a seventh sub-pixel. In the embodiment, the first sub-pixel is located at a first column; the second sub-pixel is located at a second column adjacent to the first column; the third sub-pixel is located at the second column; the fourth sub-pixel is located at a third column adjacent to the second column; the fifth sub-pixel is located at the third column; the sixth sub-pixel is located at a fourth column adjacent to the third column; and the seventh sub-pixel is located at the fourth column. In addition, a height of the first sub-pixel is greater than heights of the second sub-pixel, the third sub-pixel, the fourth sub-pixel, the fifth sub-pixel, the sixth sub-pixel and the seventh sub-pixel. The height of the first sub-pixel is different from or equal to a sum of the heights of the second sub-pixel and the third sub-pixel. The height of the first sub-pixel is different from or equal to a sum of the heights of the fourth sub-pixel and the fifth sub-pixel. The height of the first sub-pixel is different from or equal to a sum of the heights of the sixth sub-pixel and the seventh sub-pixel. The height of the second sub-pixel is different from or equal to the height of the third sub-pixel, the height of the fourth sub-pixel is different from or equal to the height of the fifth sub-pixel, and the height of the sixth sub-pixel is different from or equal to the height of the seventh sub-pixel.

As to another aspect, a display device with a plurality of sub-pixel groups is disclosed. Each of sub-pixel groups comprises a first sub-pixel, a second sub-pixel, a third sub-pixel, a fourth sub-pixel, a fifth sub-pixel, a sixth sub-pixel, a seventh sub-pixel, an eighth sub-pixel, a ninth sub-pixel, a tenth sub-pixel, an eleventh sub-pixel, and a twelfth sub-pixel. In the embodiment, the first sub-pixel is located at a first column; the second sub-pixel is located at a second column adjacent to the first column; the third sub-pixel, located at a third column adjacent to the second column; the fourth sub-pixel is located at the third column; the fifth sub-pixel is located at a fourth column adjacent to the third column; the sixth sub-pixel is located at the fourth column adjacent; the seventh sub-pixel is located at a fifth column adjacent to the fourth column; the eighth sub-pixel is located at the fifth column; the ninth sub-pixel is located at a sixth column adjacent to the fifth column; the tenth sub-pixel is located at a seventh column adjacent to the sixth column; the eleventh sub-pixel, located at an eighth column adjacent to the seventh column; the twelfth sub-pixel, located at the eighth column. In addition, heights of the first sub-pixel, the second sub-pixel, the ninth sub-pixel and the tenth sub-pixel are greater than heights of the third sub-pixel, the fourth sub-pixel, the fifth sub-pixel, the sixth sub-pixel, the seventh sub-pixel, the eighth sub-pixel, the eleventh sub-pixel and the twelfth sub-pixel. The height of the first sub-pixel is different from or equal to the heights of the second sub-pixel, the ninth sub-pixel and the tenth sub-pixel. The height of the first sub-pixel is different from or equal to a sum of the heights of the third sub-pixel and the fourth sub-pixel. The height of the first sub-pixel is different from or equal to a sum of the heights of the fifth sub-pixel and the sixth sub-pixel. The height of the first sub-pixel is different from or equal to a sum of the heights of the seventh sub-pixel and the eighth sub-pixel. The height of the first sub-pixel is different from or equal to a sum of the heights of the eleventh sub-pixel and the twelfth sub-pixel. The height of the third sub-pixel is different from or equal to the height of the fourth sub-pixel, the height of the fifth sub-pixel is different from or equal to the height of the sixth sub-pixel, the height of the seventh sub-pixel is different from or equal to the height of the eighth sub-pixel, and the height of the eleventh sub-pixel is different from or equal to the height of the twelfth sub-pixel. Via adapting the above sub-pixel groups, the aperture ratio and brightness of the display device are improved.

As to another aspect, a driving module used for driving a display device to display images is disclosed. The display device comprises a plurality of sub-pixel groups. Each of sub-pixel groups comprises a first sub-pixel, a second sub-pixel, a third sub-pixel, a fourth sub-pixel, a fifth sub-pixel, a sixth sub-pixel, a seventh sub-pixel, an eighth sub-pixel, a ninth sub-pixel, a tenth sub-pixel, an eleventh sub-pixel, and a twelfth sub-pixel. In the embodiment, the first sub-pixel is located at a first column; the second sub-pixel is located at a second column adjacent to the first column; the third sub-pixel, located at a third column adjacent to the second column; the fourth sub-pixel is located at the third column; the fifth sub-pixel is located at a fourth column adjacent to the third column; the sixth sub-pixel is located at the fourth column adjacent; the seventh sub-pixel is located at a fifth column adjacent to the fourth column; the eighth sub-pixel is located at the fifth column; the ninth sub-pixel is located at a sixth column adjacent to the fifth column; the tenth sub-pixel is located at a seventh column adjacent to the sixth column; the eleventh sub-pixel, located at an eighth column adjacent to the seventh column; the twelfth sub-pixel, located at the eighth column. In addition, heights of the first sub-pixel, the second sub-pixel, the ninth sub-pixel and the tenth sub-pixel are greater than heights of the third sub-pixel, the fourth sub-pixel, the fifth sub-pixel, the sixth sub-pixel, the seventh sub-pixel, the eighth sub-pixel, the eleventh sub-pixel and the twelfth sub-pixel. The height of the first sub-pixel is different from or equal to the heights of the second sub-pixel, the ninth sub-pixel and the tenth sub-pixel. The height of the first sub-pixel is different from or equal to a sum of the heights of the third sub-pixel and the fourth sub-pixel. The height of the first sub-pixel is different from or equal to a sum of the heights of the fifth sub-pixel and the sixth sub-pixel. The height of the first sub-pixel is different from or equal to a sum of the heights of the seventh sub-pixel and the eighth sub-pixel. The height of the first sub-pixel is different from or equal to a sum of the heights of the eleventh sub-pixel and the twelfth sub-pixel. The height of the third sub-pixel is different from or equal to the height of the fourth sub-pixel, the height of the fifth sub-pixel is different from or equal to the height of the sixth sub-pixel, the height of the seventh sub-pixel is different from or equal to the height of the eighth sub-pixel, and the height of the eleventh sub-pixel is different from or equal to the height of the twelfth sub-pixel.

According to the embodiments of the present invention, the number of sub-pixels for realizing the display device is reduced, so that the aperture ratio, the power consumption and the layout area of the display device therefore can be improved.

These and other objectives of the present invention will no doubt become obvious to those of ordinary skill in the art after reading the following detailed description of the preferred embodiment that is illustrated in the various figures and drawings.

DETAILED DESCRIPTION

The present invention reduces a number of sub-pixels corresponding to each pixel via different arrangements of the sub-pixels. An aperture ratio and brightness of the liquid crystal display (LCD) are accordingly improved. The power consumption and the layout area of the LCD are further decreased.

Figure 1:
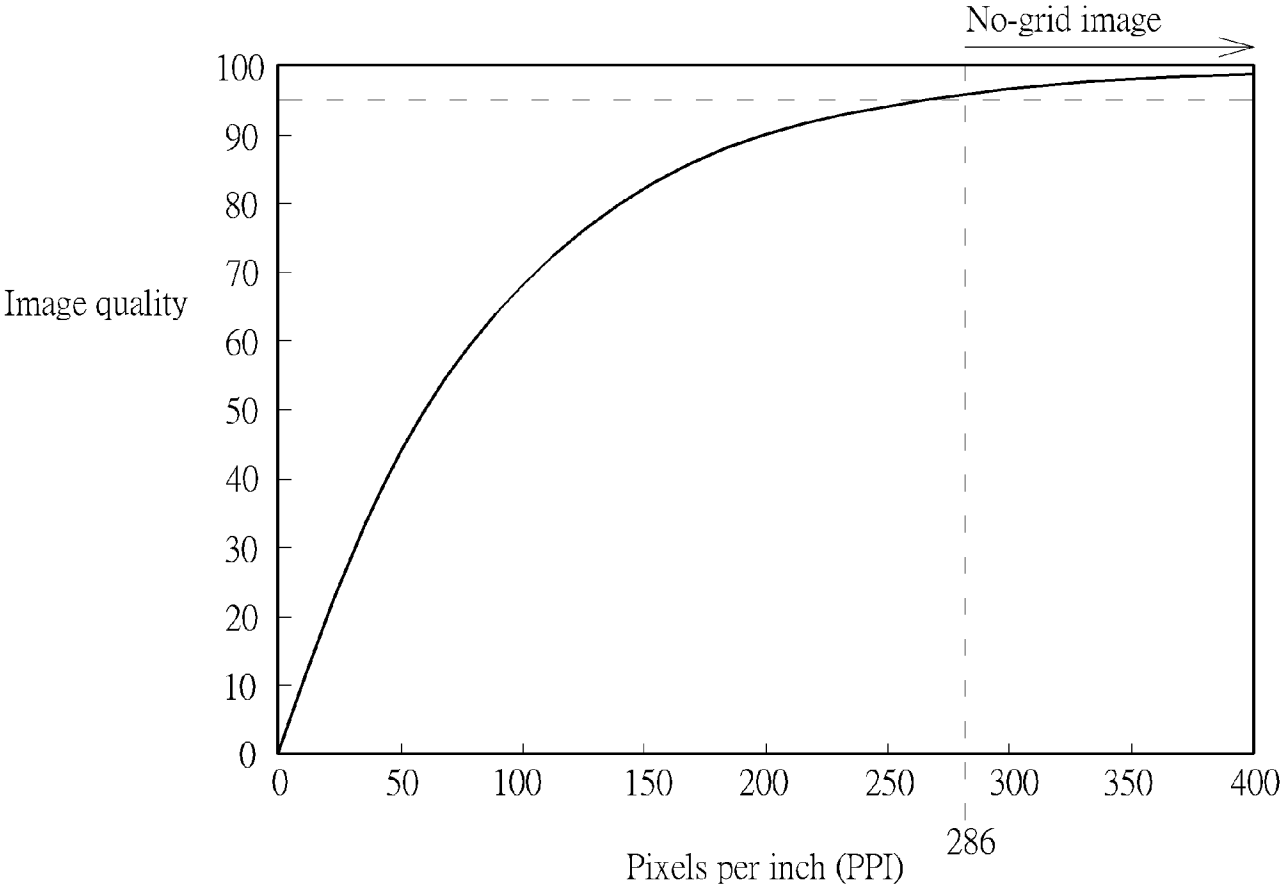
FIG. 1 PRIOR ART
FIG. 1 is a schematic diagram of the relationship between the image quality and the pixel per inch.
Figure 2:
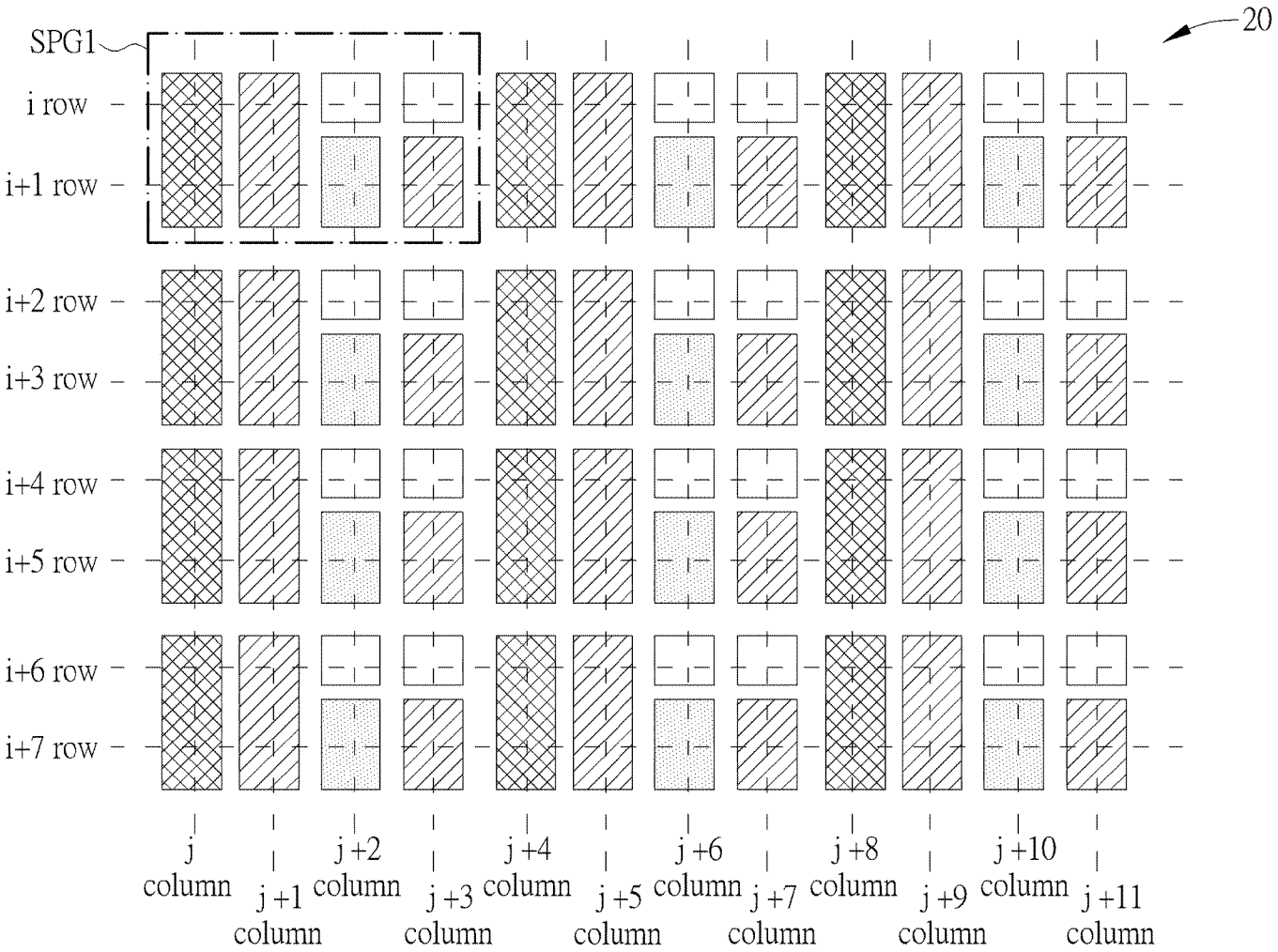
FIG. 2 is a schematic diagram of a display device according to an example of the present invention.
Figure 3:
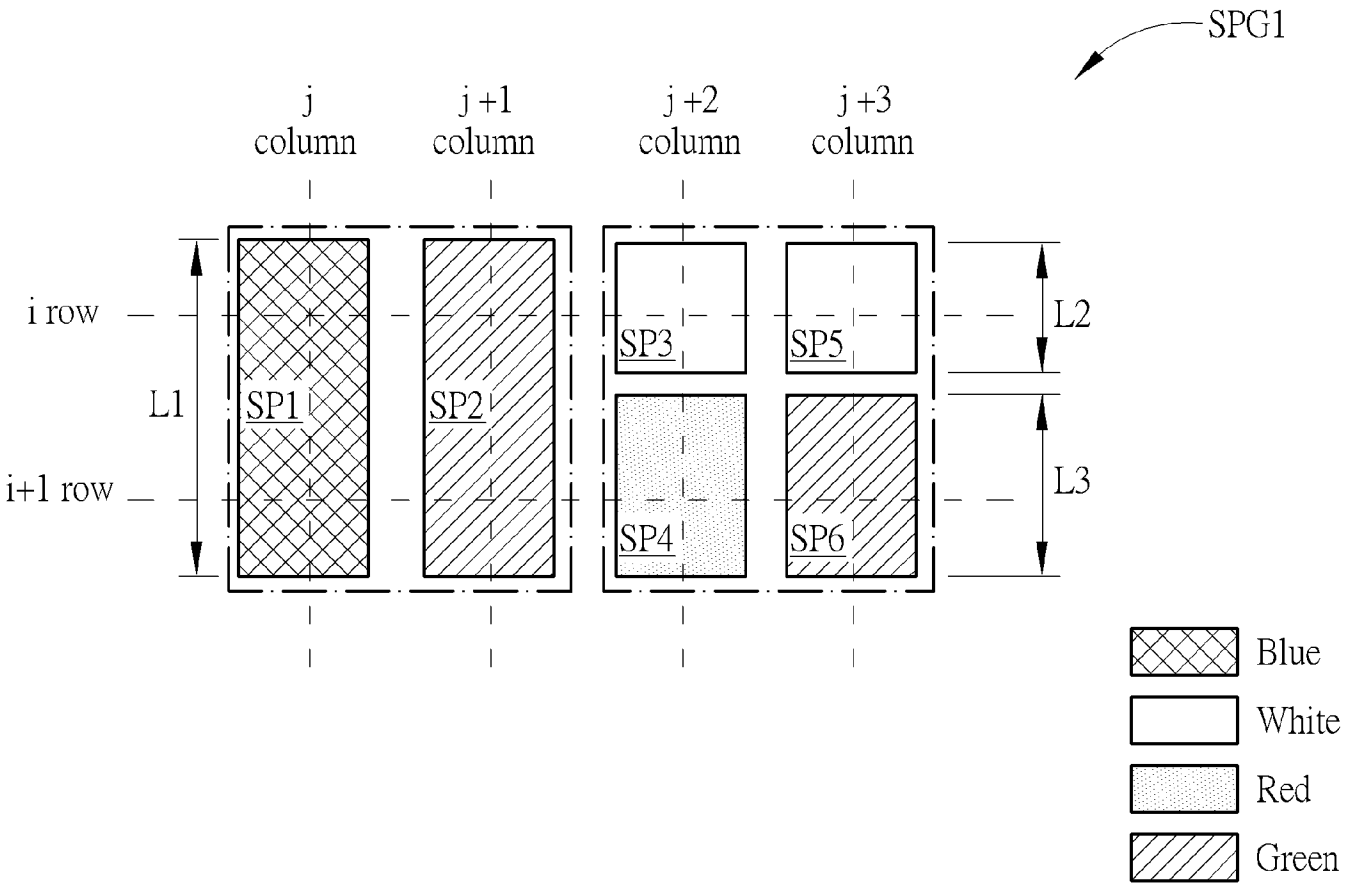
FIG. 3 is a schematic diagram of the sub-pixel group shown in FIG. 2.

Please refer to FIG. 2, which is a schematic diagram of a display device 20 according to an example of the present invention. The display device 20 may be an electronic product with a liquid crystal panel, such as a television, a smart phone or a tablet, and is not limited herein. FIG. 2 only shows parts of sub-pixels of the display device 20 for illustrations. Note that, FIG. 2 is utilized for illustrating the relative positions of the sub-pixels and not for limiting the ratio between length and width. As shown in FIG. 2, the display device 20 comprises a plurality of repeatedly arranged sub-pixel groups SPG1 (only one sub-pixel group SPG1 is marked in FIG. 2 for illustrations). In order to simplify the descriptions, please refer to FIG. 3 which is a schematic diagram of the sub-pixel group SPG1 shown in FIG. 2. In FIG. 3, the sub-pixel group SPG1 comprises sub-pixels SP1-SP6. The sub-pixel SP1 is configured at the j column, the i row and the i+1 row; the sub-pixel SP2 is configured at the j+1 column, the i row and the i+1 row; the sub-pixel SP3 is configured at the j+2 column and the i row; the sub-pixel SP4 is configured at the j+2 column and the i+1 row; the sub-pixel SP5 is configured at the j+3 column and the i row; and the sub-pixel SP5 is configured at the j+3 column and the i+1 row. The sub-pixels SP3 and SP4 may equip different or the same height and the sub-pixels SP5 and SP6 may also equip different or the same height. Via the abovementioned arrangement of the sub-pixels SP1-SP6, the sub-pixel group SPG1 is corresponding to 2 pixels. That is, a number of the sub-pixels corresponding to single pixel is reduced. The aperture ratio of display device 20 is increased and the power consumption of the display device 20 is decreased, therefore.

In detail, the sub-pixels SP1 and SP2 may have a same height L1, the sub-pixels SP3 and SP5 may have a same height L2 and the sub-pixels SP4 and SP6 may have a same height L3. The height L1 is greater than the heights L2 and L3, the height L2 may be different from or equal to the height L3, and the height L1 is different from or equal to a sum of the heights L2 and L3. In this example, the height L3 is greater than the height L2 in the sub-pixel group SPG1. In such a condition, the rows of the sub-pixels SP3-SP6 overlap those of the sub-pixels SP1 and SP2.

In this example, the sub-pixels SP1-SP6 are corresponding to blue, green, white, red, white and green, wherein the sub-pixels SP2 and SP6 corresponding to green have different areas. Via adding the sub-pixels SP3 and SP5 corresponding to white, the brightness of the display device 20 is increased and the power consumption of the display device 20 is decreased. According to different applications and design concepts, the colors corresponding to the sub-pixels SP1-SP6 in the sub-pixel group SPG1 may be changed and are not limited by those shown in FIG. 3. For example, the sub-pixels SP3 and SP5 may be altered to be corresponding to other color different from red, blue and green (e.g. yellow). In another example, the sub-pixels SP1-SP6 are corresponding to more than 4 colors. That is, the sub-pixels SP1-SP6 in the sub-pixel group SPG1 are corresponding to at least 4 colors.

As to the relationships between the pixels and the sub-pixels SP1-SP6 in the sub-pixel group SPG1 please refer to the followings. As shown in FIG. 3, the sub-pixels SP1 and SP2 are corresponding to a pixel and the sub-pixels SP3-SP6 are corresponding to another pixel. If the problem of lacking colors occurs when the sub-pixels SP1 and SP2 or the sub-pixels SP3-SP6 displays the corresponded pixel, the display device 20 may borrow the colors from surrounding pixels via adopting an algorithm (e.g. sub-pixel rendering algorithm), for displaying the corresponded pixel completely. In the prior art, each pixel requires 4 sub-pixels in average when adopting the sub-pixels corresponding to white. In comparison, 6 sub-pixels are corresponding to 2 pixels in the sub-pixel group SPG1. That is, the number of sub-pixels required by each pixel is decreased to 3. If the sub-pixels SP3 and SP5 are coupled to the same data line (i.e. the sub-pixels SP3 and SP5 may be regarded as single sub-pixel), the number of sub-pixels required by each pixel is decreased to 2.5. When the resolution of the display device 20 keeps constant, the number of the sub-pixels utilized for realizing the display device 20 is reduced and the aperture ratio of the display device 20 is accordingly increased.

Figure 4:
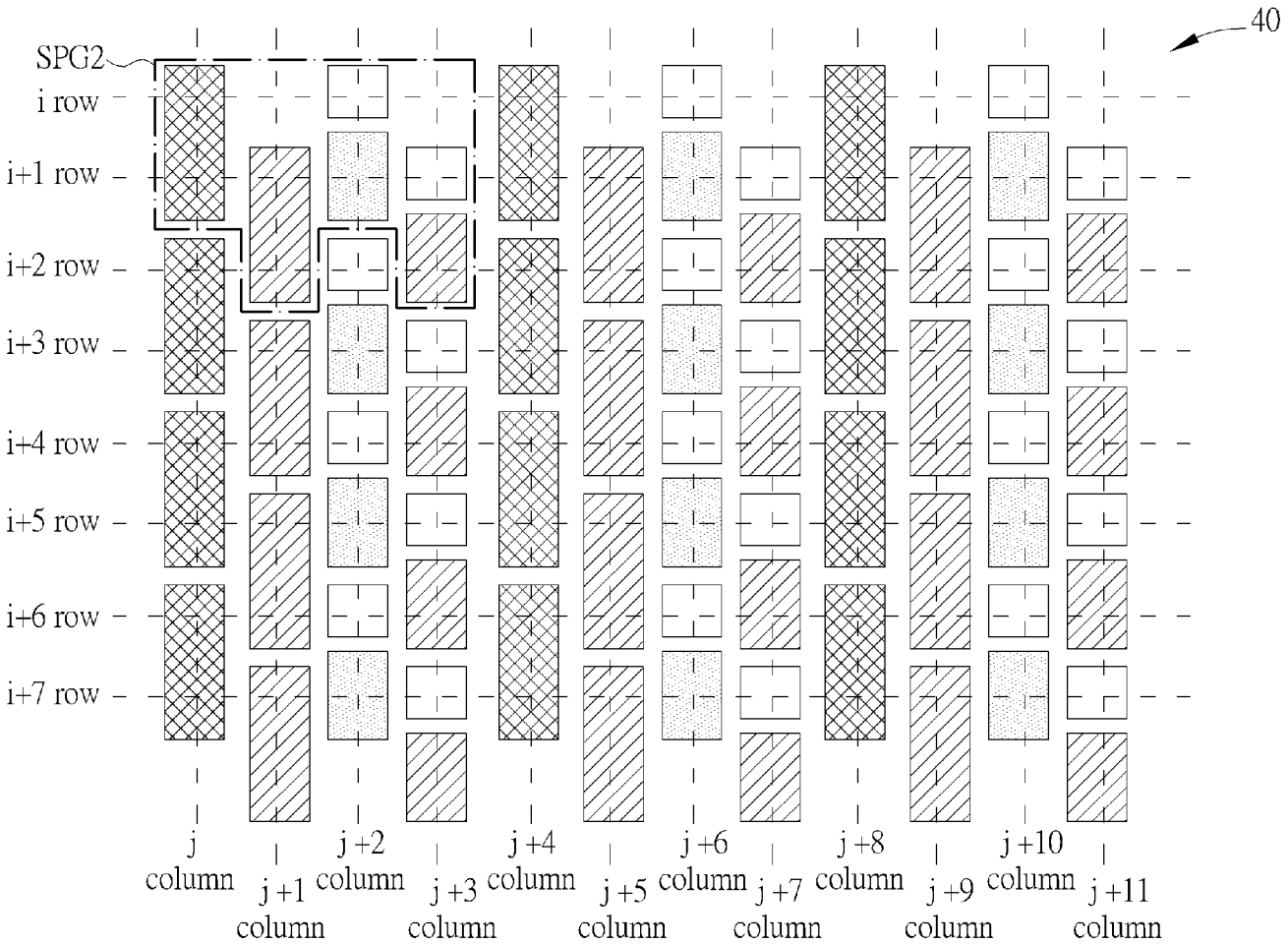
FIG. 4 is a schematic diagram of a display device according to an example of the present invention.
Figure 5:
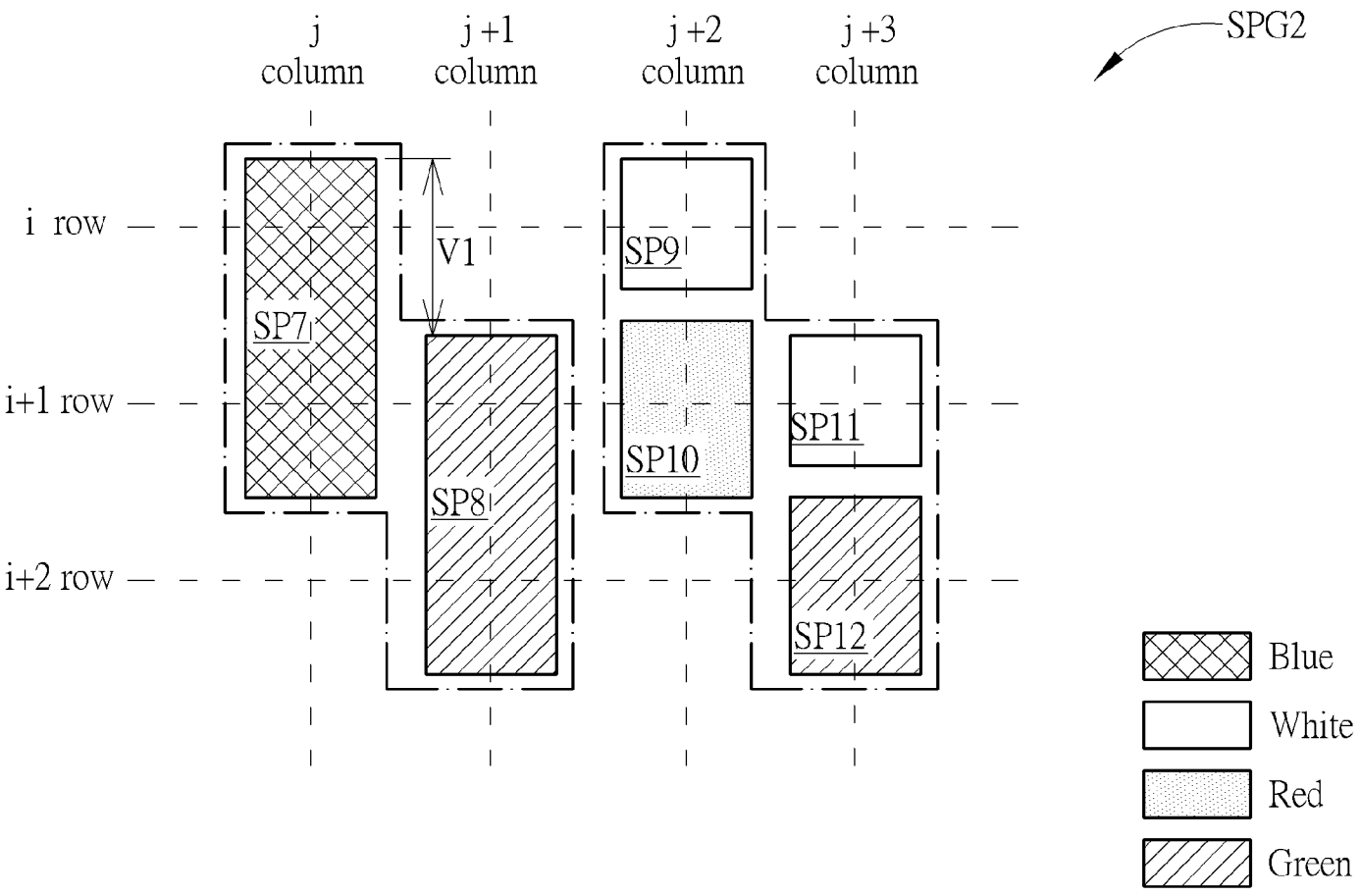
FIG. 5 is a schematic diagram of the sub-pixel group shown in FIG. 4.

In an example, a vertical displacement may exist between the sub-pixels of the display device 20 shown in FIG. 2. Please refer to FIG. 4, which is a schematic diagram of a display device 40 according to an example of the present invention. The display device 40 may be an electronic product with a liquid crystal panel, such as a television, a smart phone or a tablet, and is not limited herein. FIG. 4 only shows parts of sub-pixels of the display device 40 for illustrations. Note that, FIG. 4 is utilized for illustrating the relative positions of the sub-pixels and not for limiting the ratio between length and width. As shown in FIG. 4, the display device 40 comprises a plurality of repeatedly arranged sub-pixel groups SPG2 (only one sub-pixel group SPG2 is marked in FIG. 4 for illustrations). In order to simplify the descriptions, please refer to FIG. 5 which is a schematic diagram of the sub-pixel group SPG2 shown in FIG. 4. In FIG. 5, the sub-pixel group SPG2 comprises sub-pixels SP7-SP12. Different from the sub-pixel group SPG1 shown in FIG. 3, a vertical displacement V1 exists between the sub-pixels SP7 and SP8. The sub-pixel SP7 is located at the i, i+1 rows and the sub-pixel SP8 is located at the i+1, i+2 rows, therefore. In addition, the sub-pixels SP11 and SP12 are shifted downwards the vertical displacement V1 and are located at the adjacent i+1 and i+2 rows. Via the abovementioned arrangement of the sub-pixels SP7-SP12, the sub-pixel group SPG2 is corresponding to two pixels and the aperture ratio of the display device 40 is accordingly increased. The colors and the length-width relationships of the sub-pixels SP7-SP12 in the sub-pixel group SPG2 can be referred to those of the sub-pixels SP1-SP6 in the sub-pixel group SPG1, and are not narrated herein for brevity.

In the sub-pixel group SPG2 shown in FIG. 5, the rows of the sub-pixel SP8 partially overlap those of the sub-pixel SP7; the rows of the sub-pixels SP9, SP10 overlap those of the sub-pixels SP7; and the rows of the sub-pixel SP11 overlap those of the sub-pixels SP7. According to different applications and design concepts, the arrangement relationships between the sub-pixels SP7-SP12 may be appropriated modified. For example, the sub-pixels SP11, SP12 may change to be shifted upwards, such that only the rows of the sub-pixel SP12 overlap those of the sub-pixel SP7. Similarly, the sub-pixels SP9, SP10 may be shifted vertically. In other words, the rows of at least one of the sub-pixels located at the same column in the sub-pixel group SPG2 overlaps those of the sub-pixel SP7.

In an example, a horizontal displacement may exist between the sub-pixel groups SPG1 located at the adjacent rows in the display device 20 shown in FIG. 2. Please refer to FIG. 6, which is a schematic diagram of a display device 60 according to an example of the present invention. The display device 60 is similar to the display device 20 shown in FIG. 2, thus the components and the signals with the same functions use the same symbols. Different from the display device 20, a horizontal displacement W1 exists between the sub-pixel groups SPG1 configured at the adjacent rows (e.g. the sub-pixel groups SPG1 located at the i row and the i+1 row and those located at the i+2 row and the i+3 row). In this example, the horizontal displacement W1 is half of the width of the sub-pixel group SPG1. As a result, the display device 60 equipping different sub-pixel arrangement can be realized by the sub-pixel group SPG1. In addition, the sub-pixel group SPG3 shown in FIG. 6 also can be regarded as the repeated sub-pixel group in this example. In other words, the display device 60 shown in FIG. 6 can be acquired by repeatedly arranging the sub-pixel group SPG3.

Figure 7:
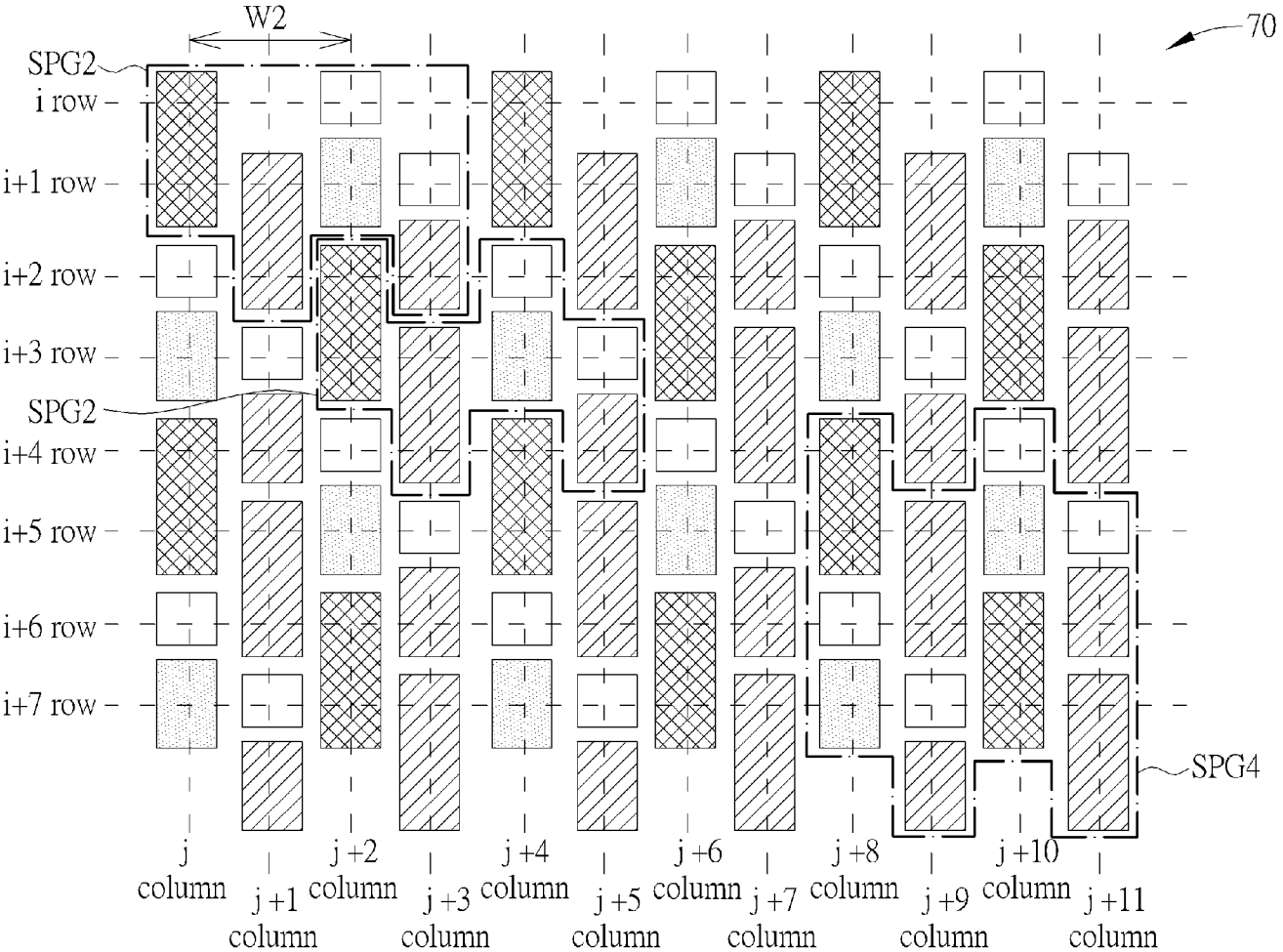
FIG. 7 is a schematic diagram of a display device according to an example of the present invention.

In an example, a horizontal displacement may exist between the sub-pixel groups SPG1 located at adjacent rows and a vertical displacement may exist between sub-pixels SP1-SP6 of the sub-pixel group SPG1 in the display device 20 shown in FIG. 2. That is, a horizontal displacement may exist between the sub-pixel groups SPG2 located at adjacent rows in the display device 40 shown in FIG. 4. Please refer to FIG. 7, which is a schematic diagram of a display device 70 according to an example of the present invention. The display device 70 is similar to the display device 40 shown in FIG. 4, thus the components and the signal with the similar functions use the same symbols. Different from the display device 40, a horizontal displacement W2 exists between the sub-pixel groups SPG2 located at adjacent rows (e.g. the sub-pixel groups SPG2 located at the i–i+2 rows and the i+1–i+3 rows). In this example, the horizontal displacement W2 is half of the width of the sub-pixel group SPG2. In such a condition, the sub-pixel group SPG4 shown in FIG. 7 also can be regarded as the repeated sub-pixel group. That is, the display device 70 shown in FIG. 7 can be acquired by repeatedly arranging the sub-pixel group SPG4.

Figure 8:
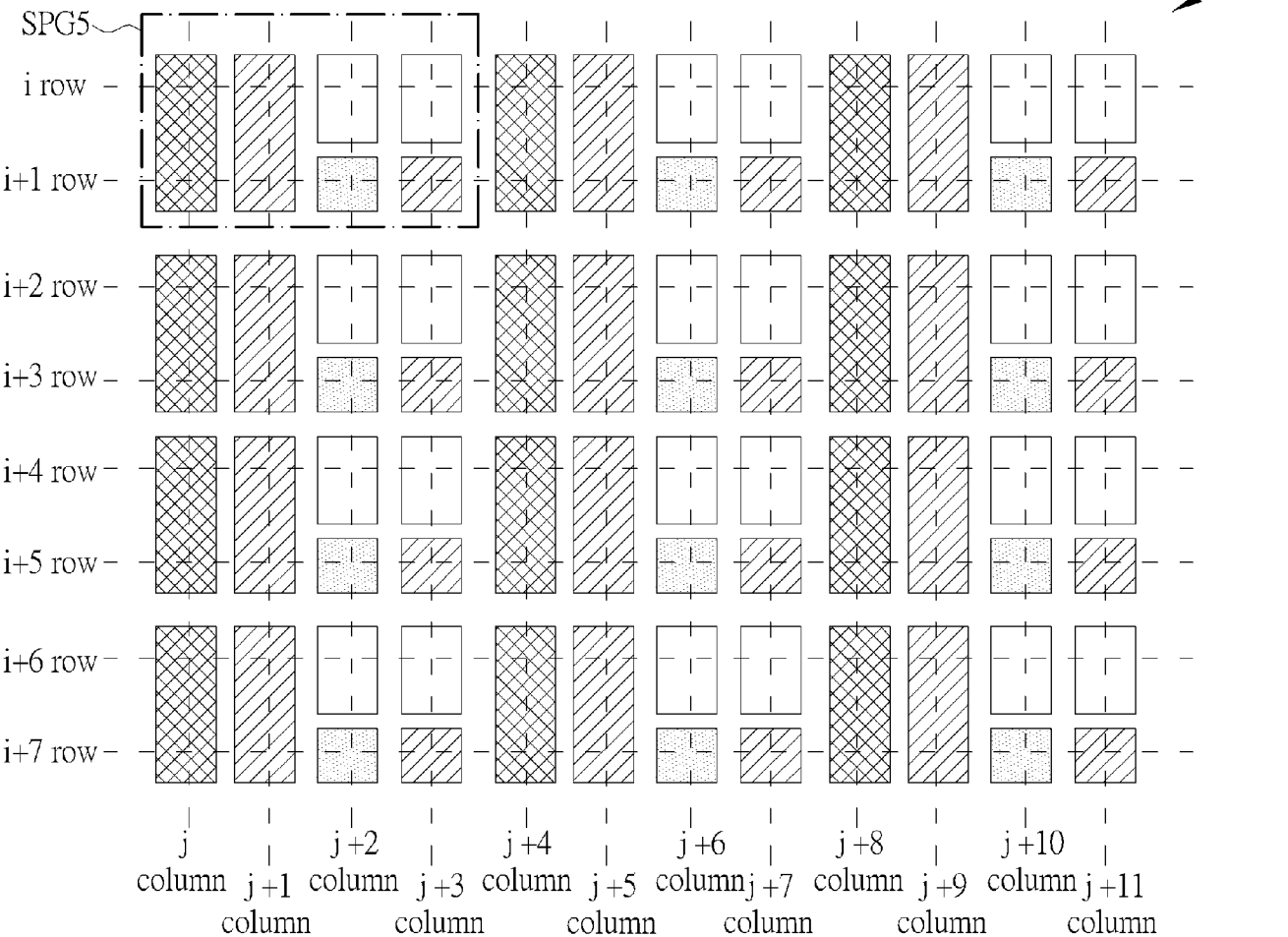
FIG. 8 is a schematic diagram of a display device according to an example of the present invention.
Figure 9:
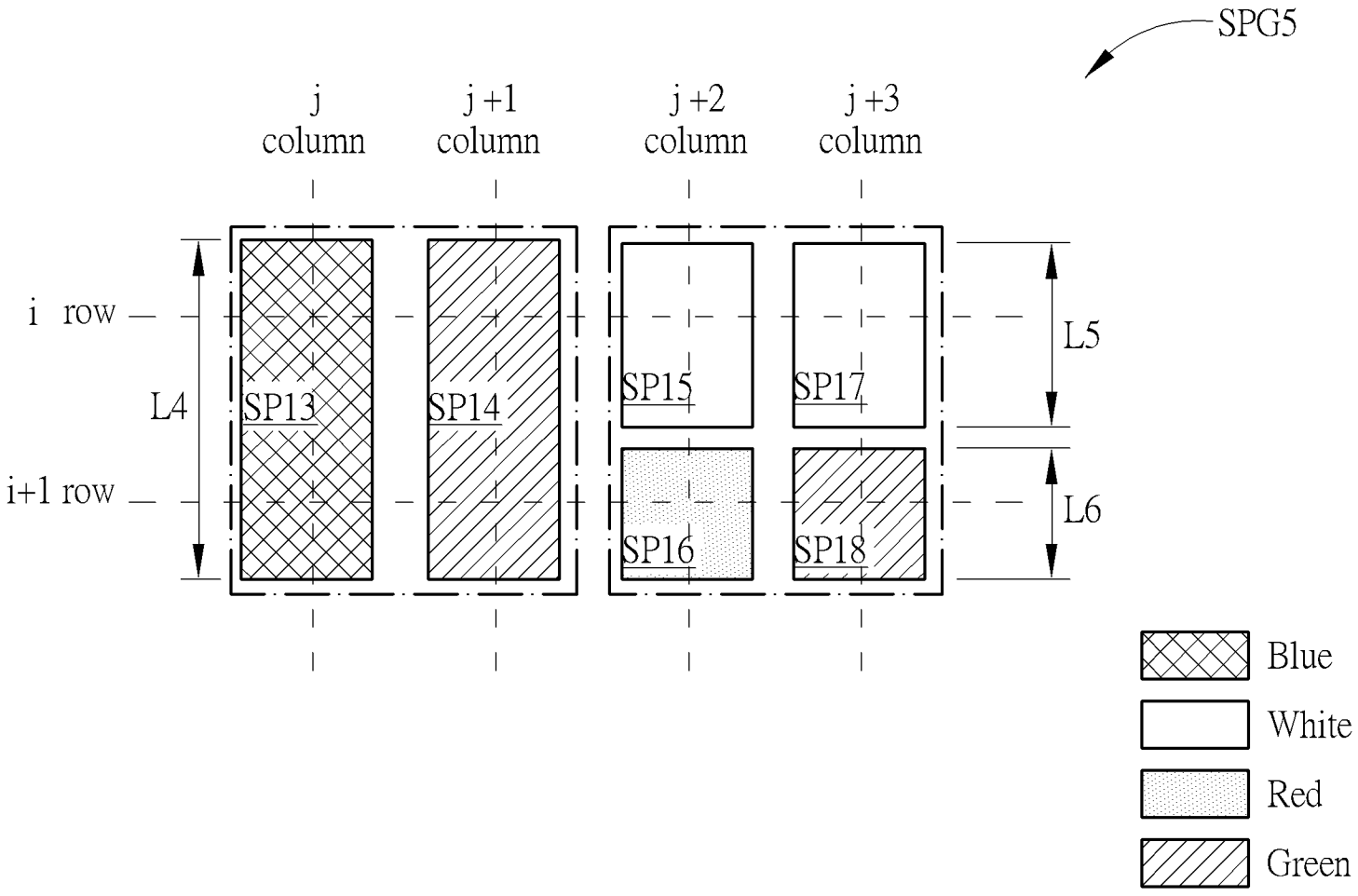
FIG. 9 is a schematic diagram of the sub-pixel group shown in FIG. 8.

In an example, the sizes of the sub-pixels SP1-SP6 in the sub-pixel group SPG1 shown in FIG. 3 may be appropriately modified. Please refer to FIG. 8, which is a schematic diagram of a display device 80 according to an example of the present invention. The display device 80 may be an electronic product with a liquid crystal panel, such as a television, a smart phone or a tablet, and is not limited herein. FIG. 8 only shows parts of sub-pixels of the display device 80 for illustrations. Note that, FIG. 8 is utilized for illustrating the relative positions of the sub-pixels and not for limiting the ratio between length and width. As shown in FIG. 8, the display device 80 comprises a plurality of repeatedly arranged sub-pixel groups SPG5 (only one sub-pixel group SPG5 is labeled in FIG. 8 for illustrations). In order to simplify the descriptions, please refer to FIG. 9 which is a schematic diagram of the sub-pixel group SPG5 shown in FIG. 8. Similar to the sub-pixel group SPG1 shown in FIG. 3, a height L4 of the sub-pixel SP13 is greater than a height L5 of the sub-pixels SP15, SP17 and the height L13 is also greater than a height L6 of the sub-pixels SP16, SP18. The height L4 is different from or equal to a sum of the height L5 of the sub-pixels SP15, SP17 and the height L6 of the sub-pixels SP16, SP18. However, the height L5 changes to be greater than the height L6 in the sub-pixel group SPG5. The colors and the relationships corresponding to the pixels of the sub-pixels SP13-SP18 in the sub-pixel group SPG5 can be referred to those of the sub-pixels SP1-SP6 in the sub-pixel group SPG1, and are not narrated herein for brevity.

Figure 10:
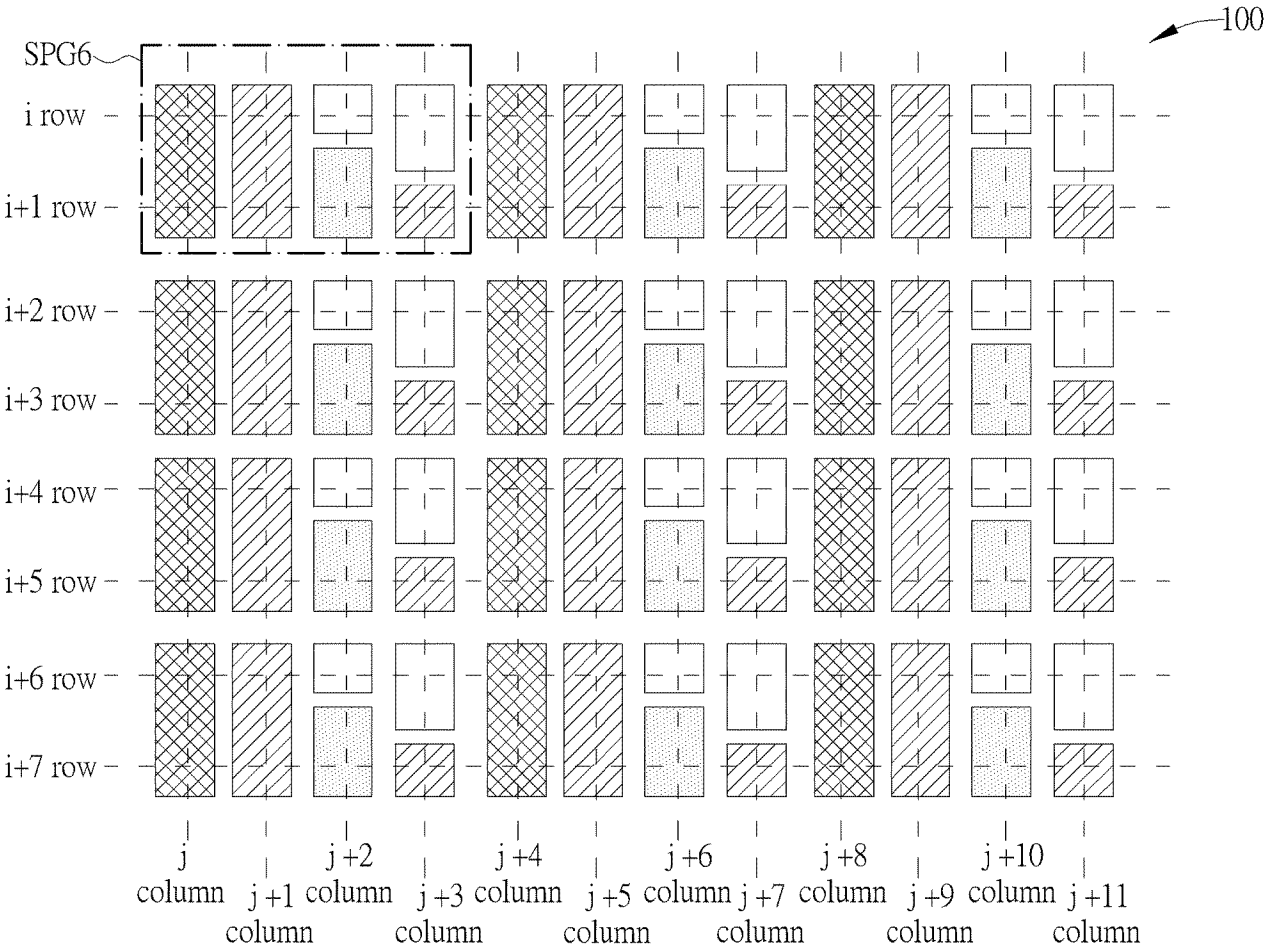
FIG. 10 is a schematic diagram of a display device according to an example of the present invention.
Figure 11:
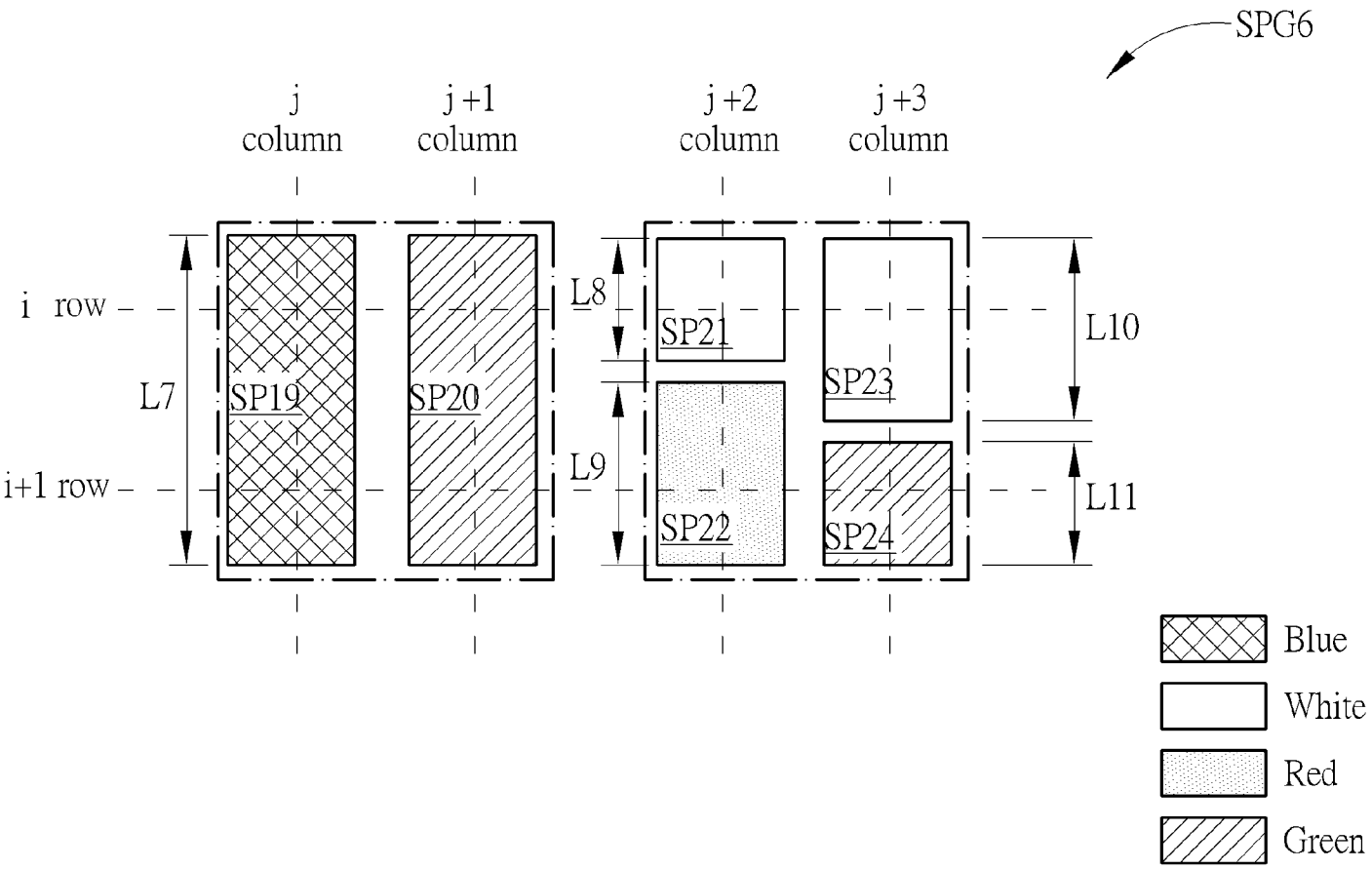
FIG. 11 is a schematic diagram of the sub-pixel group shown in FIG. 10.

Please refer to FIG. 10, which is a schematic diagram of a display device 100 according to an example of the present invention. The display device 100 may be an electronic product with a liquid crystal panel, such as a television, a smart phone or a tablet, and is not limited herein. FIG. 10 only shows parts of sub-pixels of the display device 100 for illustrations. Note that, FIG. 10 is utilized for illustrating the relative positions of the sub-pixels and not for limiting the ratio between length and width. As shown in FIG. 10, the display device 100 comprises a plurality of repeatedly arranged sub-pixel groups SPG6 (only one sub-pixel group SPG6 is labeled in FIG. 10 for illustrations). In order to simplify the descriptions, please refer to FIG. 11 which is a schematic diagram of the sub-pixel group SPG6 shown in FIG. 10. In FIG. 11, the sub-pixel group SPG6 comprises the sub-pixels SP19-SP24, wherein the sub-pixels SP21, SP22 have different heights and the sub-pixels SP23, SP24 have different heights. Similar to the sub-pixel group SPG5 shown in FIG. 9, a height L7 of the sub-pixels SP19, SP20 is greater than a height L8 of the sub-pixels SP21, a height L9 of the sub-pixel SP22, a height L10 of the sub-pixel SP23 and a height L11 of the sub-pixel SP24. The height L7 is different from or equal to the sum of the height L8 of the sub-pixel SP21 and the height L9 of the sub-pixel SP22 and the height L8 is different from the height L9. The height L7 is also greater than or equal to and the sum of the height L10 of the sub-pixel SP23 and the height L11 of the sub-pixel SP24 and the height L10 is different from the height L11. Note that, the height L10 changes to be greater than the height L11 in the sub-pixel group SP6. The colors and the relationships corresponding to the pixels of the sub-pixels SP19-SP24 in the sub-pixel group SPG6 can be referred to those of the sub-pixels SP1-SP6 in the sub-pixel group SPG1, and are not narrated herein for brevity.

Figure 12:
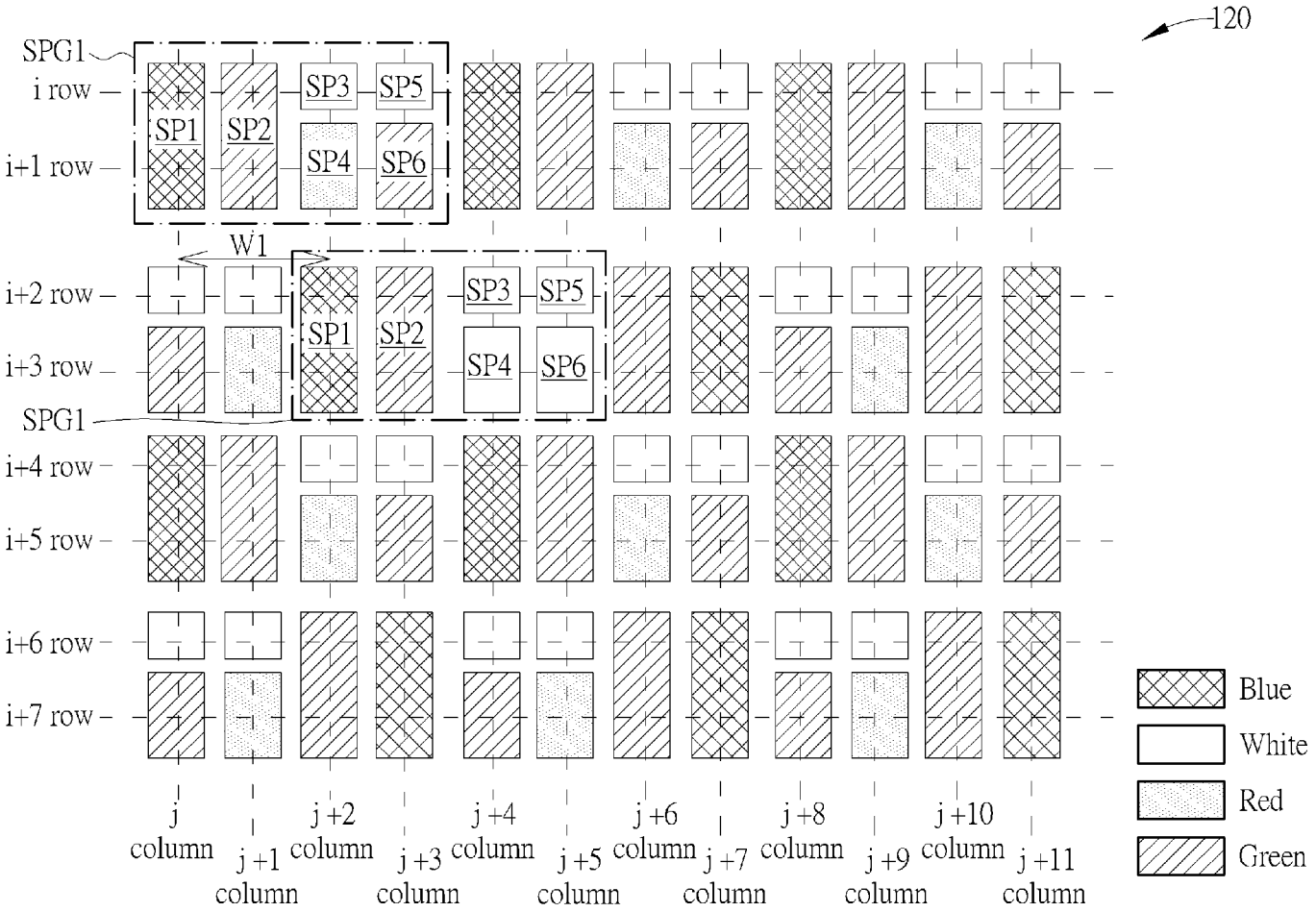
FIG. 12 is a schematic diagram of a display device according to an example of the present invention.

In an example, the color arrangement of the sub-pixel groups SPG1 located at the adjacent rows in the display device 20 shown in FIG. 2 may be different. Please refer to FIG. 12, which is a schematic diagram of a display device 120 according to an example of the present invention. The display device 120 may be an electronic product with a liquid crystal panel, such as a television, a smart phone or a tablet, and is not limited herein. FIG. 12 only shows parts of sub-pixels of the display device 120 for illustrations. Note that, FIG. 12 is utilized for illustrating the relative positions of the sub-pixels and not for limiting the ratio between length and width. The display device 120 is similar to the display device 60 shown in FIG. 6, thus the components and the signals with the similar functions use the same symbols. In comparison with the display device 60, the sub-pixel groups SPG1 located at adjacent rows in the display device 120 equip different color arrangements. In this example, the sub-pixels SP1-SP6 of the sub-pixel groups SPG1 at the i and i+1 rows are corresponding to blue, green, white, red, white and green, respectively, and the sub-pixels SP1-SP6 of the sub-pixel groups SPG1 at the i+2 and i+3 rows are corresponding to green, blue, white, green, white and red, respectively.

Note that, the horizontal displacements may exist between sub-pixels (e.g. the display device 40 shown in FIG. 4) of the display device 80 shown in FIG. 8, the display device 100 shown in FIG. 10 and the display device 120 shown in FIG. 12. In addition, the horizontal displacements may exist between sub-pixel groups located at adjacent rows (e.g. the display device 60 shown in FIG. 6) in the display device 80 shown in FIG. 8, the display device 100 shown in FIG. 10 and the display device 120 shown in FIG. 12. Furthermore, the size of each sub-pixel and/or the color arrangement in the sub-pixel groups located at adjacent rows in the display device may be different. For example, the sub-pixel groups located at adjacent rows in the display device may be the sub-pixel group SPG1 shown in FIG. 3 and the sub-pixel group SPG5 shown in FIG. 9, respectively. According to different applications and design concepts, those with ordinary skill in the art may observe appropriate alternations and modifications.

Figure 13:
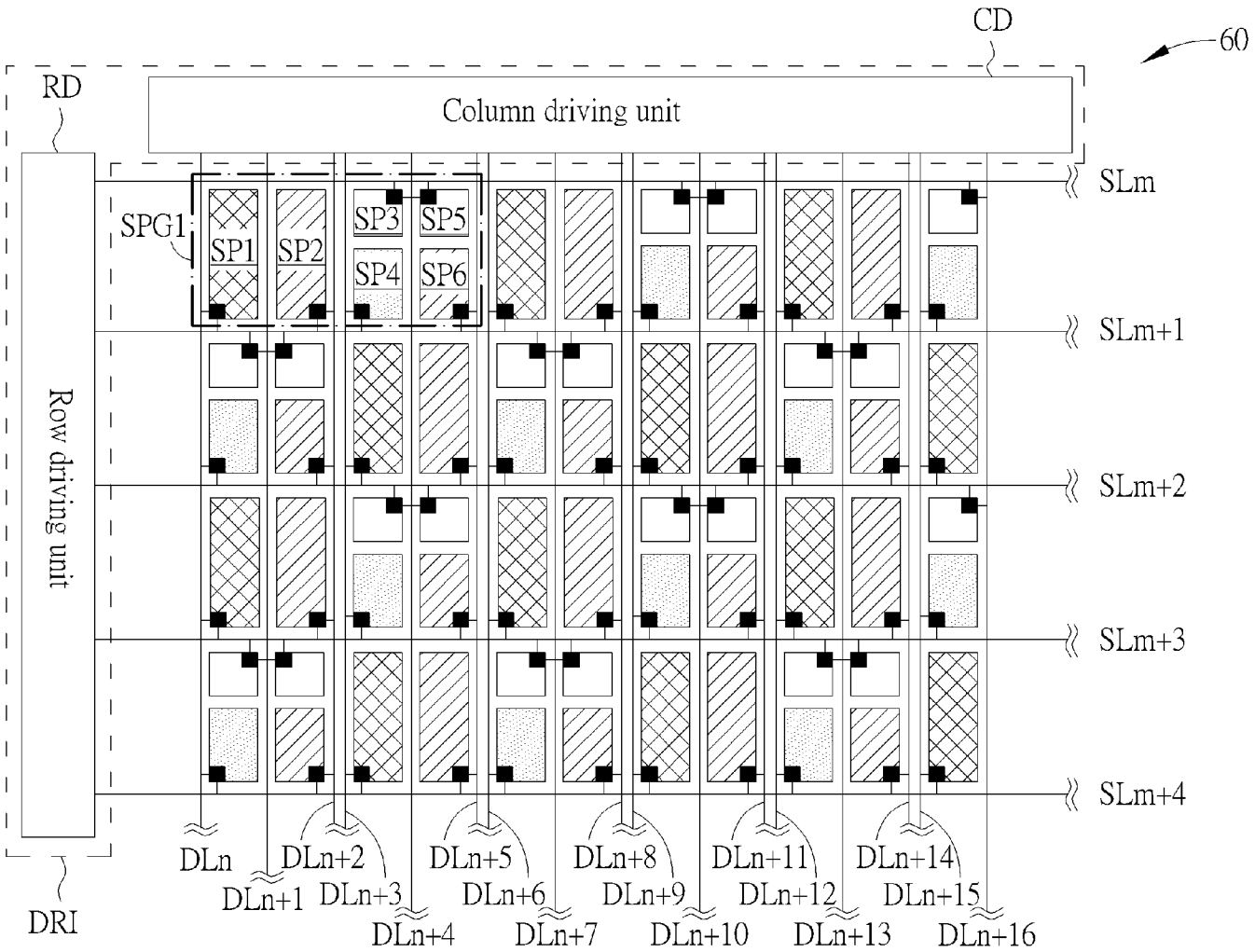
FIG. 13 is a schematic diagram of a circuit layout of the display device shown in FIG. 6.

The driving module (e.g. a driving integrated circuit (IC)) of the display device may need to be appropriately altered according to the sub-pixel arrangement of the above examples. Please jointly refer to FIG. 6 and FIG. 13, wherein FIG. 13 is a schematic diagram of a circuitry layout of the display device 60 shown in FIG. 6. As shown in FIG. 13, the display device 60 comprises a driving module DRI and a plurality of sub-pixel groups SPG1. The driving module DRI comprises a column driving unit CD and a row driving unit RD, which are utilized for driving data lines DL1-DLx and scan lines SL1-SLy, respectively, to control the display device 60 to display images. Note that, FIG. 13 only shows the data line DLn-DLn+16, the scan lines SLm-SLm+4 and parts of the plurality of sub-pixel groups SPG1 for illustrations. In the sub-pixel group SPG1 at the left-top corner, the sub-pixel SP1 is coupled to the data line DLn and the scan line SLm+1; the sub-pixel SP2 is coupled to the data line DLn+2 and the scan line SLm+1; the sub-pixel SP3 is coupled to the data line DLn+4 and the scan line SLm; the sub-pixel SP4 is coupled to the data line DLn+3 and the scan line SLm+1; the sub-pixel SP5 is coupled to the data line DLn+4 and the scan line SLm; and the sub-pixel SP6 is coupled to the data line DLn+5 and the scan line SLm+1. The relationships between the sub-pixels SP1-SP6 of rest sub-pixel groups SPG1 and the data lines DLn-DLn+16/scan lines SLm-SLm+4 in FIG. 13 can be referred to the above-mentioned sub-pixel group SPG1 at left-top corner. In brief, the sub-pixels SP1, SP2, SP4, SP6 of the sub-pixel group SPG1 are coupled to the same scan line (e.g. the scan line SLm+1) and the sub-pixels SP3, SP5 of the sub-pixel group SPG1 is coupled to an adjacent scan line (e.g. the scan line SLm), and the sub-pixels SP1-SP6 are respectively coupled to the closest data lines, wherein a data line (e.g. the data line DLn+1) exists between the sub-pixels SP1 and SP2 and is coupled to the sub-pixels SP3 and SP5 of the sub-pixel groups SPG1 of adjacent rows. Since the sub-pixels SP3 and SP5 are corresponding to the same colors, the sub-pixels SP3 and SP5 is coupled to the same data line in this example. According to the coupling relationships between the sub-pixels and data lines shown in FIG. 13, the number of data lines in the display device 60 realized by repeatedly configuring the sub-pixel group SPG1 can be reduced and the layout space in the display device 60 is therefore increased.

Figure 6:
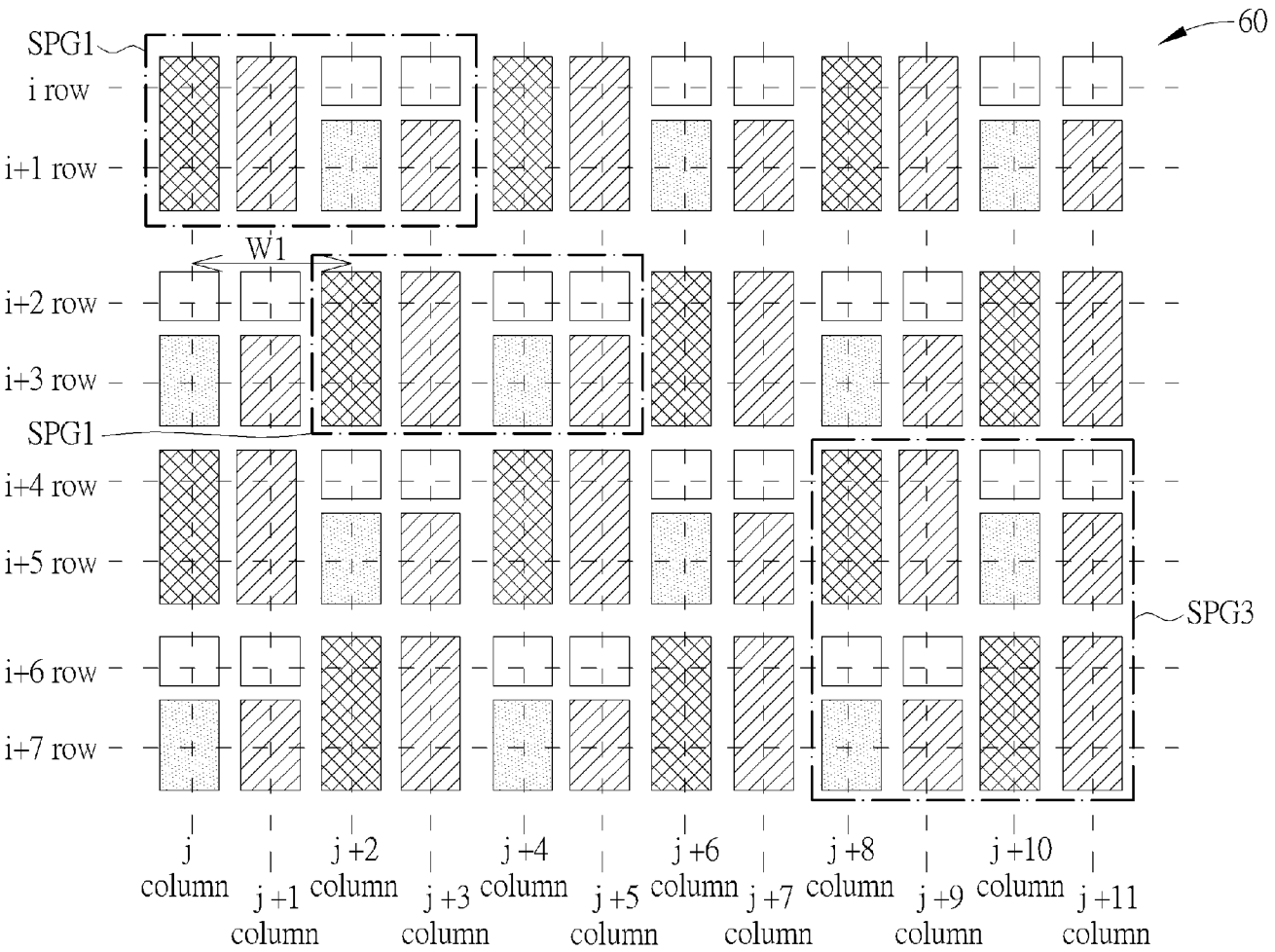
FIG. 6 is a schematic diagram of a display device according to an example of the present invention.
Figure 14:
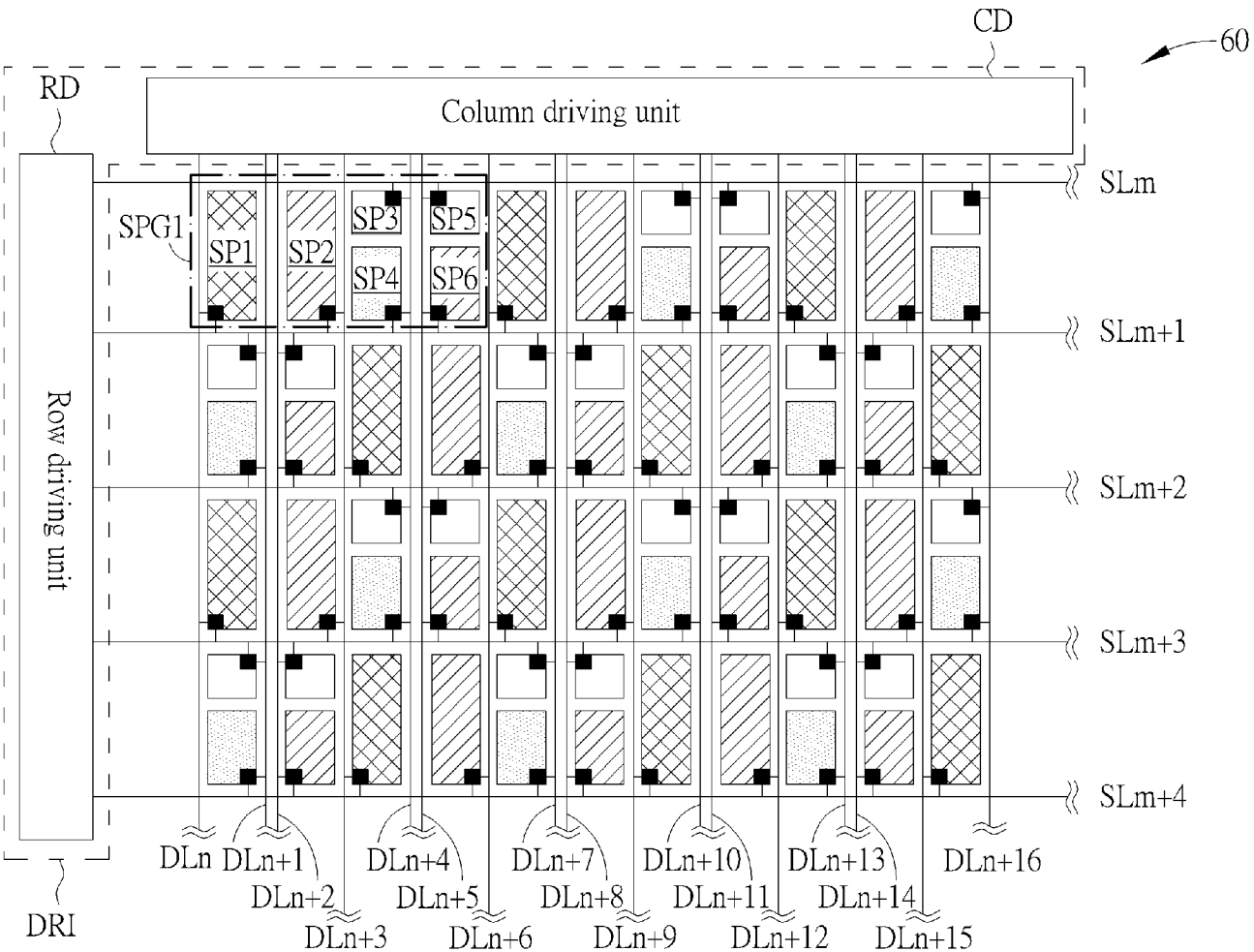
FIG. 14 is a schematic diagram of another circuit layout of the display device shown in FIG. 6.

Please jointly refer to FIG. 6 and FIG. 14, wherein FIG. 14 is a schematic diagram of a circuitry layout of the display device 60 shown in FIG. 6. As shown in FIG. 14, the display device 60 comprises a driving module DRI and a plurality of sub-pixel groups SPG1. The driving module DRI comprises a column driving unit CD and a row driving unit RD, which are utilized for driving data lines DL1-DLx and scan lines SL1-SLy, respectively. Note that, FIG. 14 only shows the data line DLn-DLn+16, the scan lines SLm-SLm+4 and parts of the plurality of sub-pixel groups SPG1 for illustrations. In the sub-pixel group SPG1 at the left-top corner, the sub-pixel SP1 is coupled to the data line DLn and the scan line SLm+1; the sub-pixel SP2 is coupled to the data line DLn+3 and the scan line SLm+1; the sub-pixel SP3 is coupled to the data line DLn+4 and the scan line SLm; the sub-pixel SP4 is coupled to the data line DLn+4 and the scan line SLm+1; the sub-pixel SP5 is coupled to the data line DLn+5 and the scan line SLm; and the sub-pixel SP6 is coupled to the data line DLn+5 and the scan line SLm+1. The relationships between the sub-pixels SP1-SP6 of rest of sub-pixel groups SPG1 and the data lines DLn-DLn+16/scan lines SLm-SLm+4 in FIG. 14 can be referred to the above-mentioned sub-pixel group SPG1 at left-top corner. In brief, the sub-pixels SP1, SP2, SP4, SP6 of the sub-pixel group SPG1 are coupled to the same scan line (e.g. the scan line SLm+1) and the sub-pixels SP3, SP5 of the sub-pixel group SPG1 is coupled to an adjacent scan line (e.g. the scan line SLm). Different from FIG. 13, the sub-pixels SP3 and SP5 change to be coupled to different data lines, the sub-pixels SP3 and SP4 change to be coupled to the same data line, and the sub-pixels SP5 and SP6 change to be coupled to the same data line in this example. Note that, 2 data lines (e.g. the data lines DLn+1 and DLn+2) exist between the sub-pixels SP1 and SP2 and are respectively coupled to the sub-pixels SP3, SP4 and the sub-pixels SP5, SP6 of the sub-pixel groups SPG1 at adjacent rows. According to the coupling relationships between the sub-pixels and data lines shown in FIG. 14, the number of data lines in the display device 60 realized by repeatedly configuring the sub-pixel group SPG1 can be reduced and the layout space in the display device 60 is therefore increased.

Figure 15:
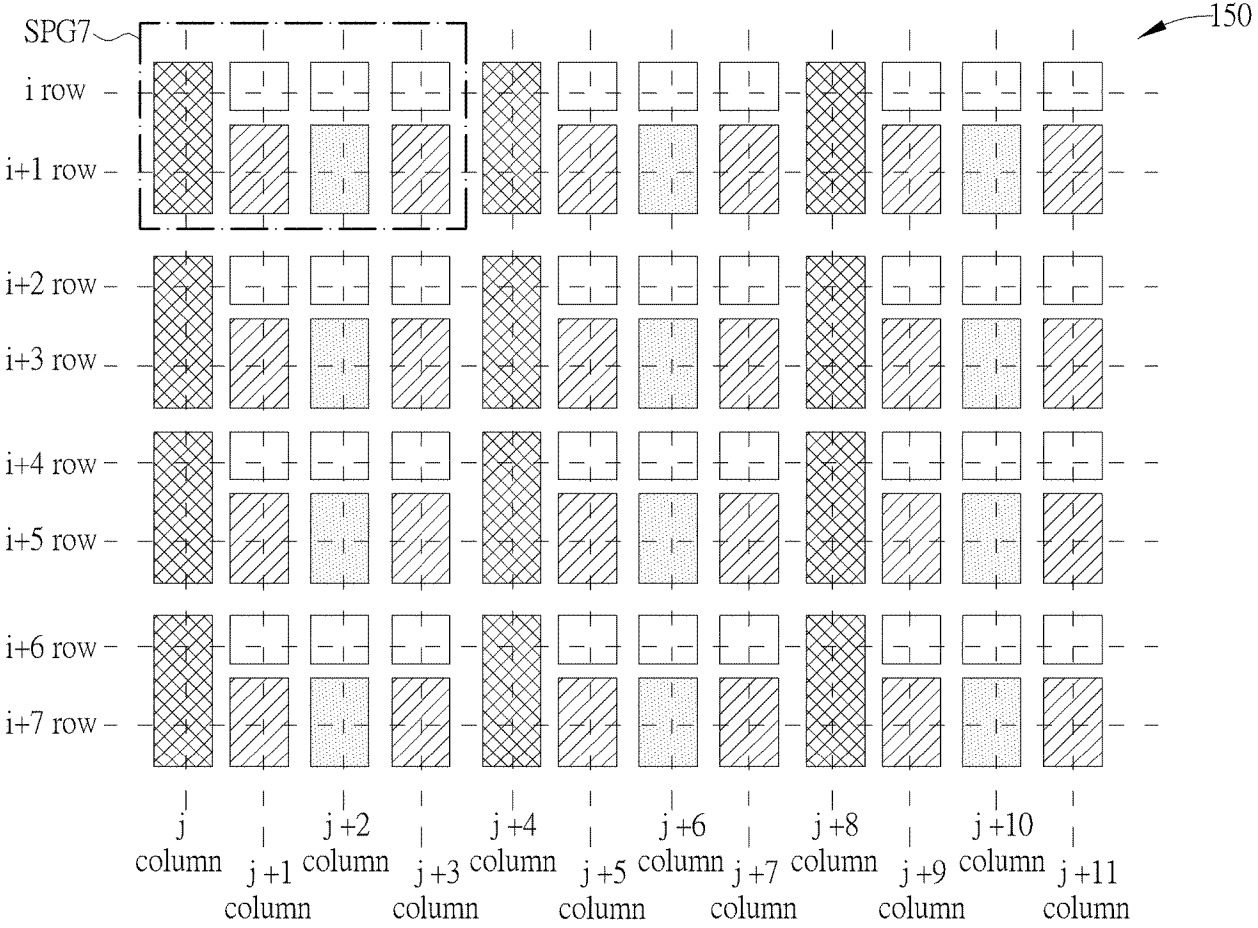
FIG. 15 is a schematic diagram of a display device according to an example of the present invention.
Figure 16:
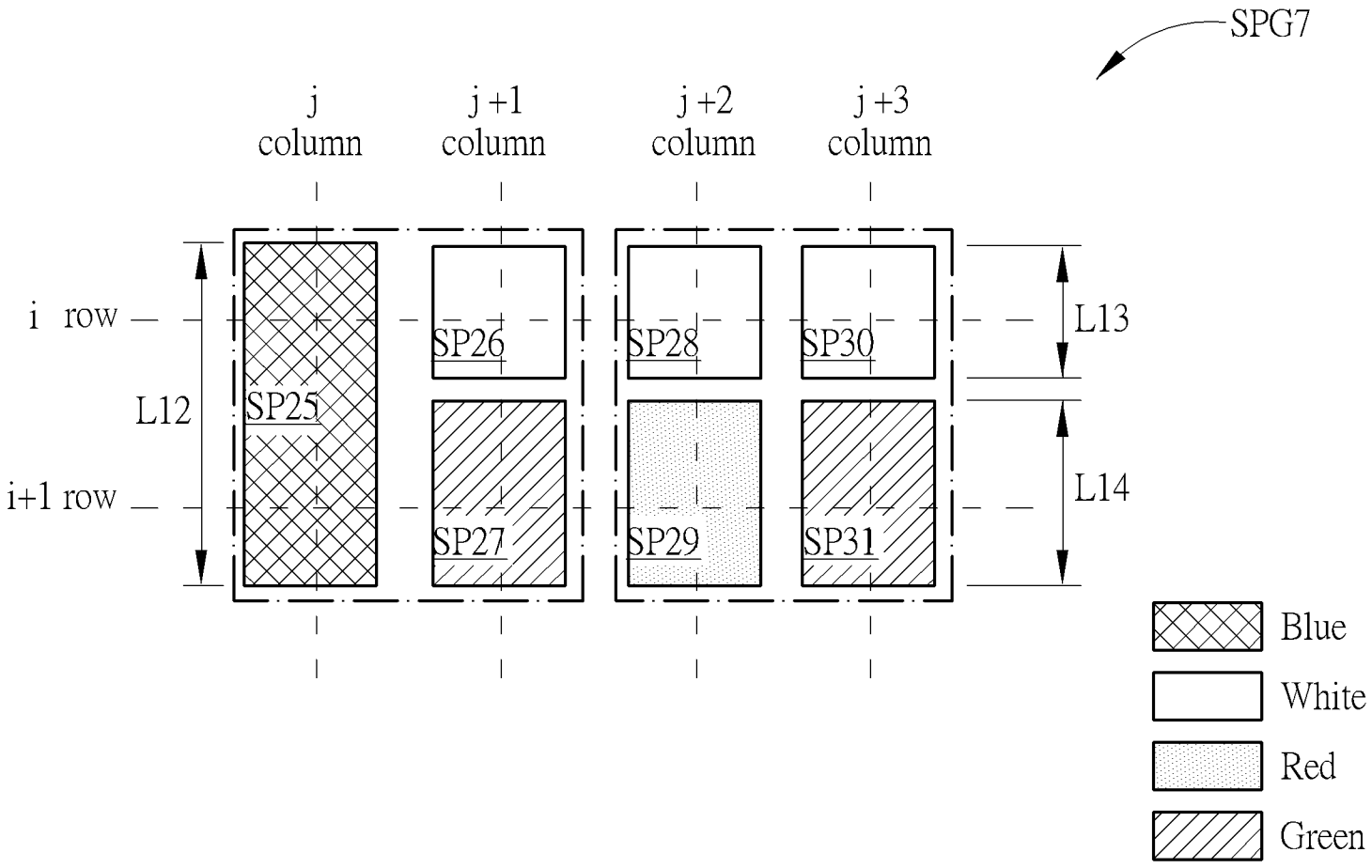
FIG. 16 is a schematic diagram of the sub-pixel group shown in FIG. 15.

Please refer to FIG. 15, which is a schematic diagram of a display device 150 according to an example of the present invention. The display device 150 may be an electronic product with a liquid crystal panel, such as a television, a smart phone or a tablet. FIG. 15 only shows parts of sub-pixels of the display device 150 for illustrations. Note that, FIG. 15 is utilized for illustrating the relative positions of the sub-pixels and not for limiting the ratio between length and width. As shown in FIG. 15, the display device 150 comprises a plurality of repeated sub-pixel groups SPG7 (only one sub-pixel group SPG7 is labeled in FIG. 15 for illustrations). In order to simplify the descriptions, please refer to FIG. 16 which is a schematic diagram of the sub-pixel group SPG7 shown in FIG. 15. In FIG. 16, the sub-pixel group SPG7 comprises sub-pixels SP25-SP31. The sub-pixel SP25 is located at the j column, the i row and the i+1 row; the sub-pixel SP26 is located at the j+1 column and the i row; the sub-pixel SP27 is located at the j+1 column and the i+1 row; the sub-pixel SP28 is located at the j+2 column and the i row; the sub-pixel SP29 is located at the j+2 column and the i+1 row; the sub-pixel SP30 is located at the j+3 column and the i row; and the sub-pixel SP31 is located at the j+3 column and the i+1 row. The sub-pixels SP26 and SP27 may have different or the same height, the sub-pixels SP28 and SP29 may have different or the same height, and the sub-pixels SP30 and SP31 may also have different or the same height. According to the sub-pixel arrangement shown in FIG. 16, the sub-pixel group SPG7 is corresponding to 2 pixels. That is, a number of the sub-pixels form a pixel is reduced. The aperture ratio of display device 150 is increased.

In details, the height of the sub-pixel SP25 is a height L12, the sub-pixels SP26, SP28, SP30 may have a same height L13, and the sub-pixels SP27, SP29, SP31 may have a same height L14. The height L12 is greater than the heights L13, L14, the height L13 is different form or equal to the height L14 and the height L12 is different from or equal to a sum of the heights L13 and L14. In this example, the height L14 is greater than the height L13. In other words, the rows of the sub-pixels SP26-SP31 overlap those of the sub-pixel SP25.

In this example, the sub-pixels SP25-SP31 are corresponding to blue, white, green, white, red, white and green, respectively. Via adding the sub-pixels SP26, SP28, SP30 corresponding to white, the brightness of the display device 150 is increased and the power consumption of the display device 150 is decreased. According to different applications and design concepts, the colors corresponding to the sub-pixels SP25-SP31 in the sub-pixel group SPG7 may be altered and is not limited to those shown in FIG. 16. For example, the sub-pixels SP25-SP31 may be altered to be corresponding to green, white, red, white, green, white and blue. In this example, the sub-pixels SP25 and SP29 corresponding to green have different areas. In another example, the sub-pixels SP26, SP28 and SP30 may be changed to be corresponding to other color different from red, blue and green (e.g. yellow). In still another example, the sub-pixels SP25-SP31 may be corresponding to more than 4 colors. That is, the sun-pixels SP25-SP31 in the sub-pixel group SPG7 are corresponding to at least four colors.

As to the relationships between pixels and the sub-pixels SP25-SP31 in the sub-pixel group SPG7 please refer to the followings. As shown in FIG. 16, the sub-pixels SP25-SP27 are corresponding to a pixel and the sub-pixels SP28-SP31 are corresponding to another pixel. If the problem of lacking colors occurs when the sub-pixels SP25-SP27 or the sub-pixels SP28-SP31 display the corresponding pixel, the display device 150 may adopt the algorithm (e.g. the sub-pixel rendering algorithm) to borrow colors from adjacent sub-pixels, so as to completely display the corresponded pixel. In the sub-pixel group SPG7, 7 sub-pixels form 2 pixels and the average number of the sub-pixels corresponding to a pixel is decreased to 3.5. When the resolution of the display device 150 remains constant, the number of the sub-pixels utilized for realizing the display device 150 would be reduced and the aperture ratio of the display device 150 would be accordingly increased.

In an example, a vertical displacement may exist between the sub-pixels of the display device 150 shown in FIG. 15.

Figure 17:
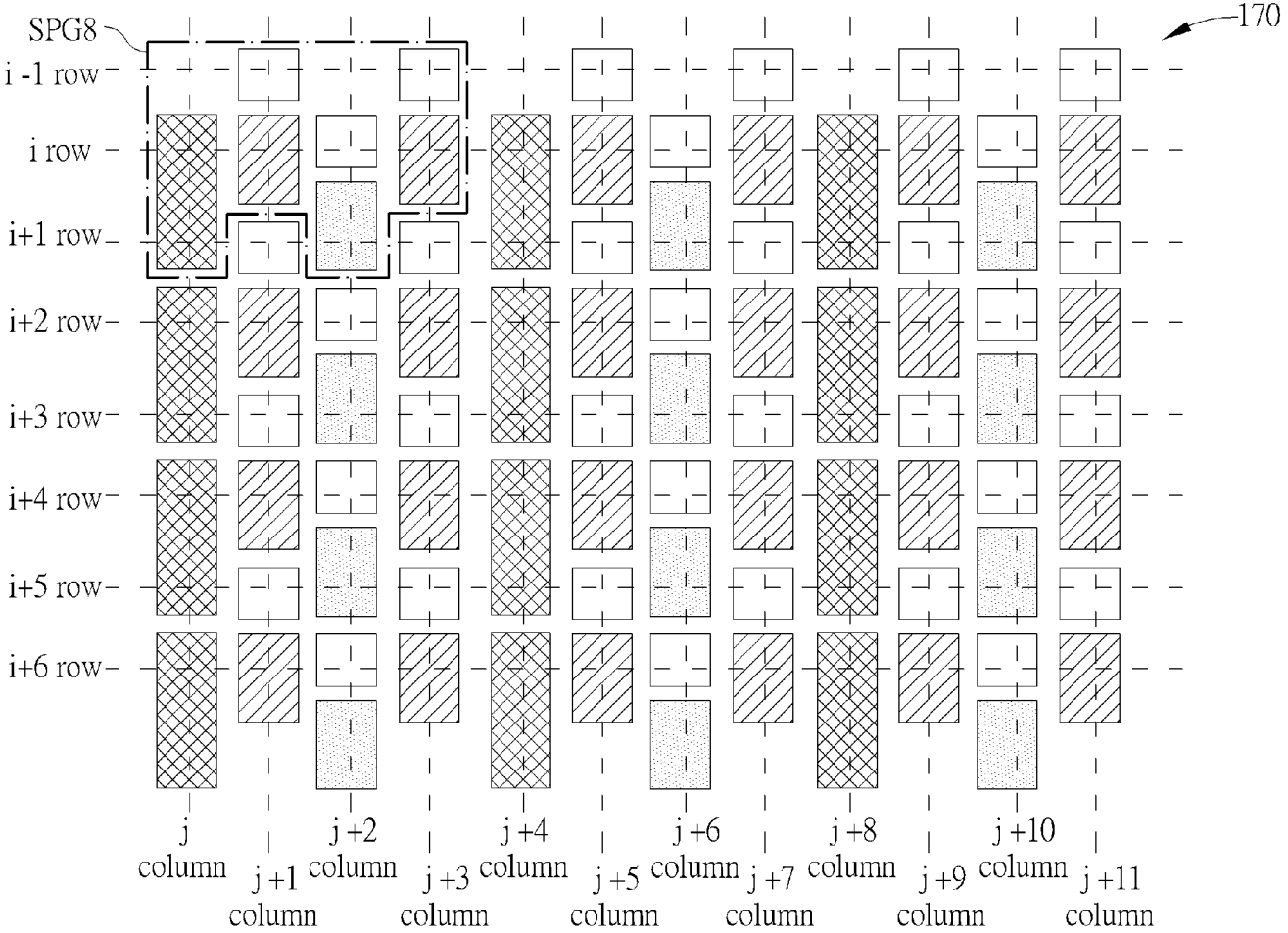
FIG. 17 is a schematic diagram of a display device according to an example of the present invention.
Figure 18:
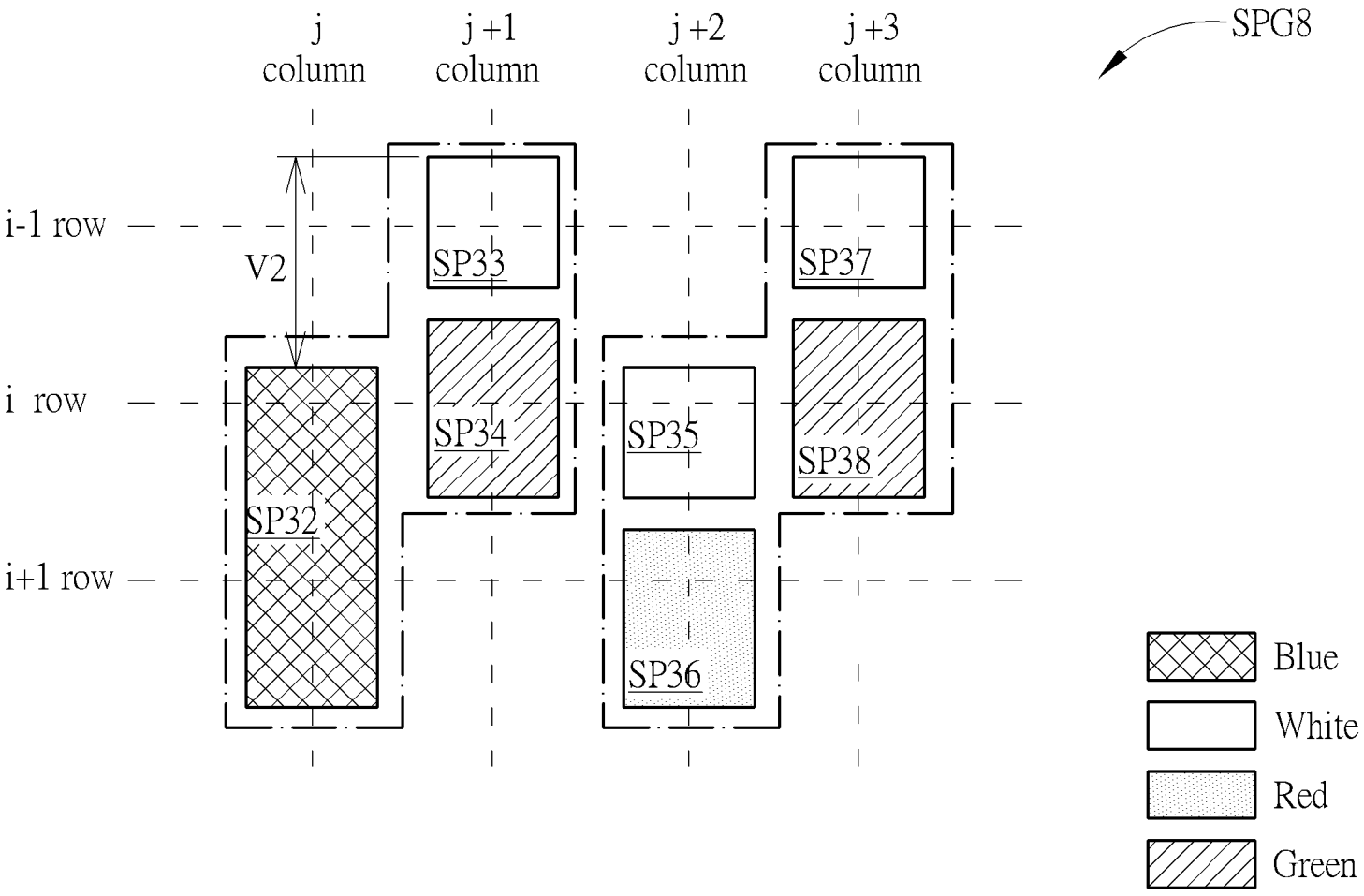
FIG. 18 is a schematic diagram of the sub-pixel group shown in FIG. 17.

Please refer to FIG. 17, which is a schematic diagram of a display device 170 according to an example of the present invention. The display device 170 may be an electronic product with a liquid crystal panel, such as a television, a smart phone or a tablet. FIG. 17 only shows parts of sub-pixels of the display device 170 for illustrations. Note that, FIG. 17 is utilized for illustrating the relative positions of the sub-pixels and not for limiting the ratio between length and width. As shown in FIG. 17, the display device 170 comprises a plurality of repeated sub-pixel groups SPG8 (only one sub-pixel group SPG8 is marked in FIG. 17 for illustrations). In order to simplify the descriptions, please refer to FIG. 18 which is a schematic diagram of the sub-pixel group SPG8 shown in FIG. 17. In FIG. 18, the sub-pixel group SPG8 comprises sub-pixels SP32-SP38, and the arrangement of the sub-pixels SP32-SP38 is similar to that of the sub-pixels SP25-SP31 of the sub-pixel group SPG7. In comparison with the sub-pixel group SPG7 shown in FIG. 16, the sub-pixels SP33, SP34 at the j+1 column and the sub-pixels SP37, SP38 at the j+3 column are shifted upwards a vertical displacement V2. According to the sub-pixel arrangement shown in FIG. 18, the sub-pixel group SPG8 is corresponding to 2 pixels. The number of the sub-pixels forming a pixel is decreased and the aperture ratio of display device 170 is increased therefore. The colors and the length-width relationships between the sub-pixels SP32-SP38 of the sub-pixel group SPG8 can be referred to those of the sub-pixels SP25-SP31 in the sub-pixel group SPG7, and are not narrated herein for brevity.

In the sub-pixel group SPG8 shown in FIG. 18, the rows of the sub-pixel SP34 overlap those of the sub-pixel SP32, the rows of the sub-pixels SP35, SP36 overlap of those of the sub-pixel SP32, and the rows of the sub-pixel SP38 overlap of those of the sub-pixel SP32. According to different applications and design concepts, the arrangement of the sub-pixels SP32-SP38 may be appropriately altered. For example, the sub-pixels SP37, SP38 may change to be shifted downwards, such that only the rows of the sub-pixel SP37 overlap those of the sub-pixel SP32. Similarly, the sub-pixels SP35 and SP36 may be shifted vertically such that rows of at least one of the sub-pixels SP35 and SP36 overlap those of the sub-pixel SP32. In other words, the rows of at least one of the sub-pixels located at the same column in the sub-pixel group SPG8 overlap the rows of the sub-pixel SP32.

In an example, a horizontal displacement may exist between the sub-pixel groups SPG7 located at the adjacent rows in the display device 150 shown in FIG. 15. Please refer to FIG. 19, which is a schematic diagram of a display device 190 according to an example of the present invention. The display device 190 is similar to the display device 150 shown in FIG. 15, thus the components and the signals with the same functions use the same symbols. Different from the display device 150, a horizontal displacement W3 exists between the sub-pixel groups SPG7 located at the adjacent rows (e.g. the sub-pixel groups SPG7 located at the i, i+1 rows and those located at the i+2, i+3 rows). In this example, the horizontal displacement W3 is half of the width of the sub-pixel group SPG7. As a result, the display device 190 equipping different sub-pixel arrangement can be realized by the sub-pixel group SPG7. In addition, a sub-pixel group SPG9 shown in FIG. 19 can be regarded as a repeated sub-pixel group. In other words, the display device 190 shown in FIG. 19 can be realized by repeatedly configuring the sub-pixel group SPG9.

Figure 20:
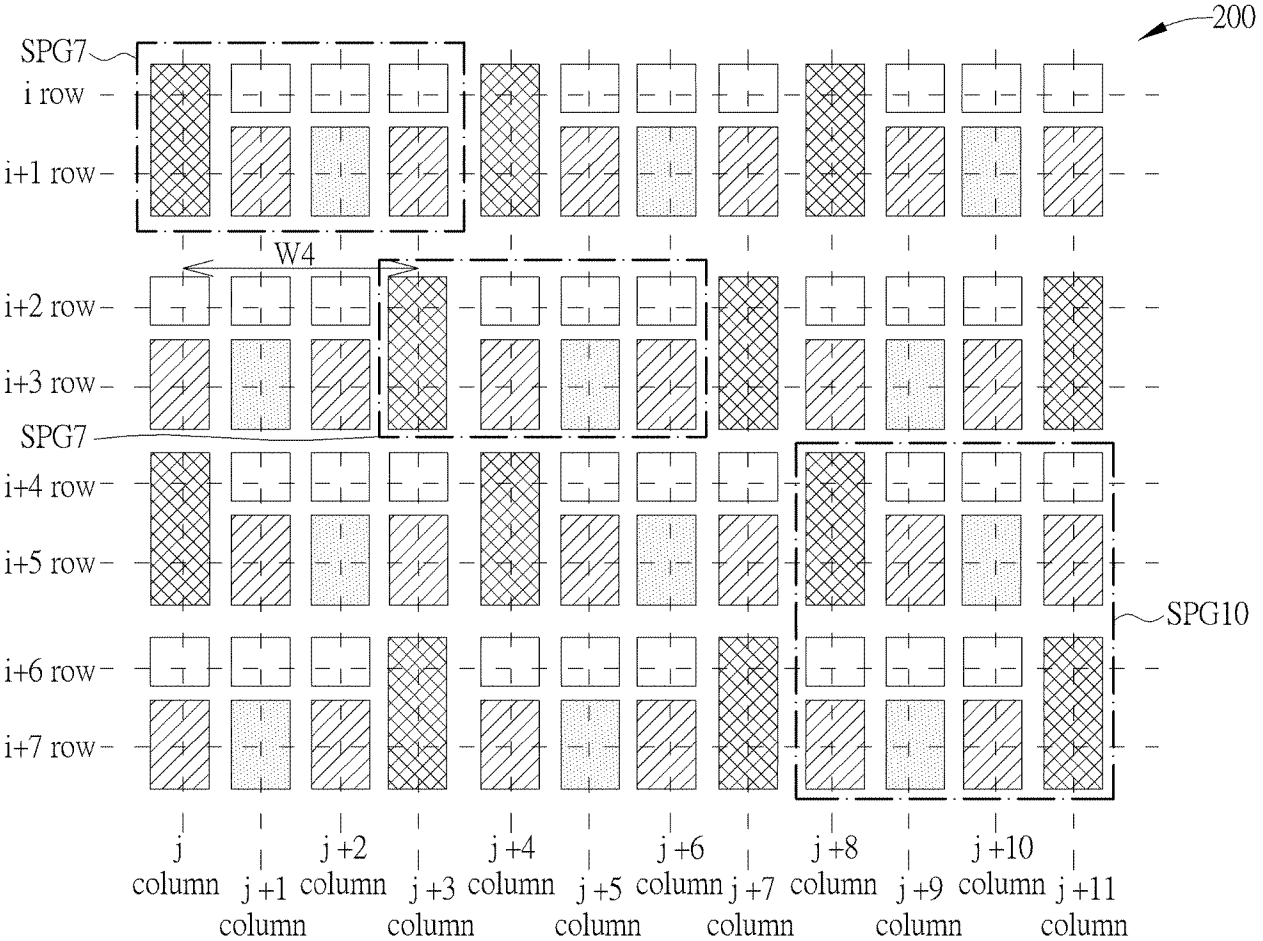
FIG. 20 is a schematic diagram of a display device according to an example of the present invention.

Please refer to FIG. 20, which is a schematic diagram of a display device 200 according to an example of the present invention. The display device 200 is similar to the display device 150 shown in FIG. 15, thus the components and the signals with the same functions use the same symbols. Different from the display device 150, a horizontal displacement W4 exists between the sub-pixel groups SPG7 located at the adjacent rows (e.g. the sub-pixel groups SPG7 located at the i, i+1 rows and those located at the i+2, i+3 rows). In this example, the horizontal displacement W4 is three-fourths of the width of the sub-pixel group SPG7. As a result, the display device 200 equipping different sub-pixel arrangement can be realized by the sub-pixel group SPG7. In addition, a sub-pixel group SPG10 shown in FIG. 20 can be regarded as a repeated sub-pixel group. In other words, the display device 200 shown in FIG. 20 can be realized by repeatedly configuring the sub-pixel group SPG10.

Figure 21:
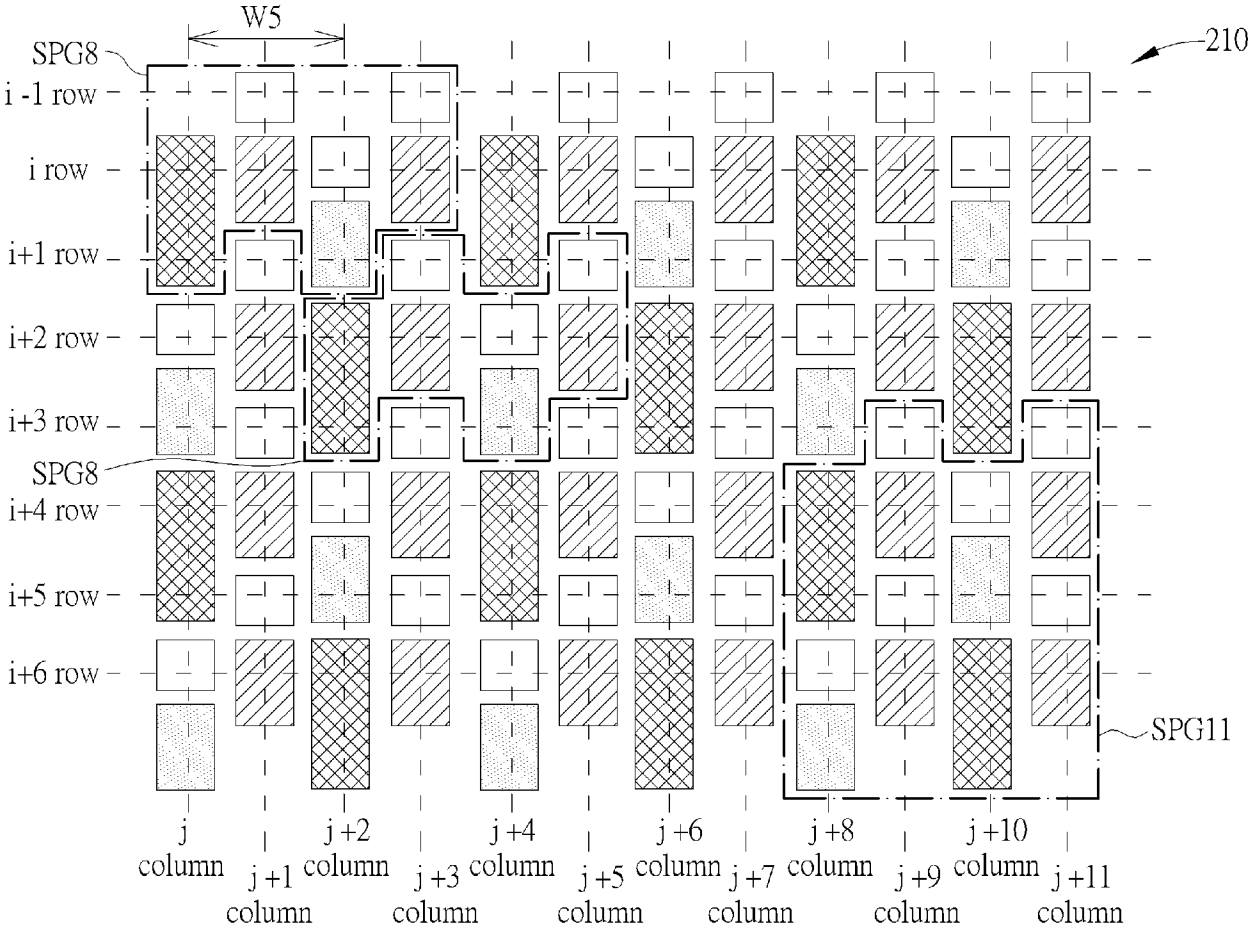
FIG. 21 is a schematic diagram of a display device according to an example of the present invention.

In an example, a horizontal displacement may exist between the sub-pixel groups SPG7 located at the adjacent rows and a vertical displacement may exist between sub-pixels in the display device 150 shown in FIG. 15. In other words, a horizontal displacement may exist between the sub-pixel groups SPG8 at adjacent rows in the display device 170 shown in FIG. 17. Please refer to FIG. 21, which is a schematic diagram of a display device 210 according to an example of the present invention. The display device 210 is similar to the display device 170 shown in FIG. 17, thus the components and the signals with the same functions use the same symbols. Different from the display device 170, a horizontal displacement W5 exist between the sub-pixel groups SPG8 at adjacent rows (e.g. the sub-pixel groups SPG8 located at the i, i+1 rows and those located at the i+2, i+3 rows). In this example, the horizontal displacement W5 is half of the width of the sub-pixel group SPG8. In addition, a sub-pixel group SPG11 shown in FIG. 21 can be regarded as a repeated sub-pixel group. That is, the display device 210 shown in FIG. 21 can be realized by repeatedly configuring the sub-pixel group SPG11.

Figure 22:
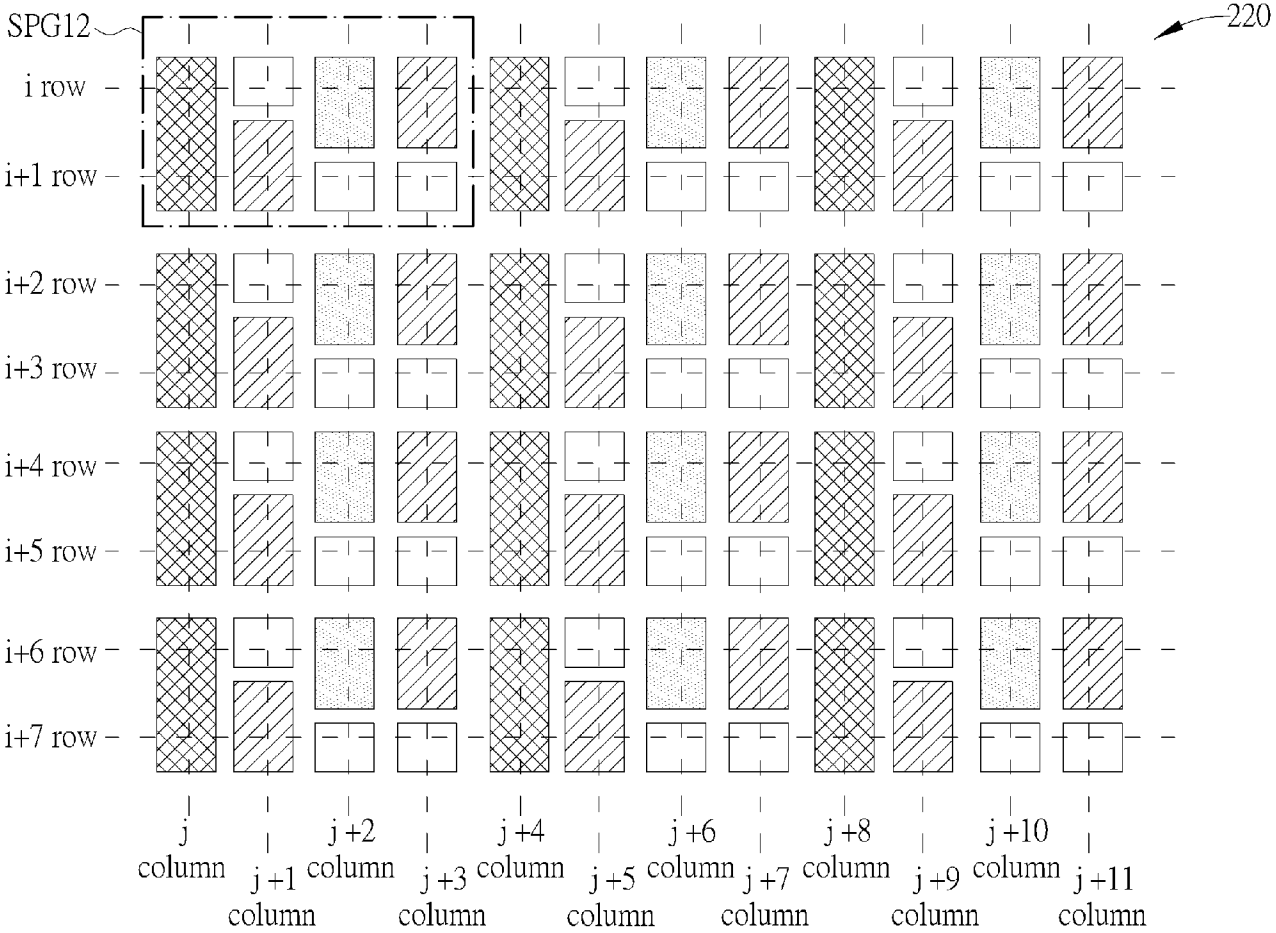
FIG. 22 is a schematic diagram of a display device according to an example of the present invention.
Figure 23:
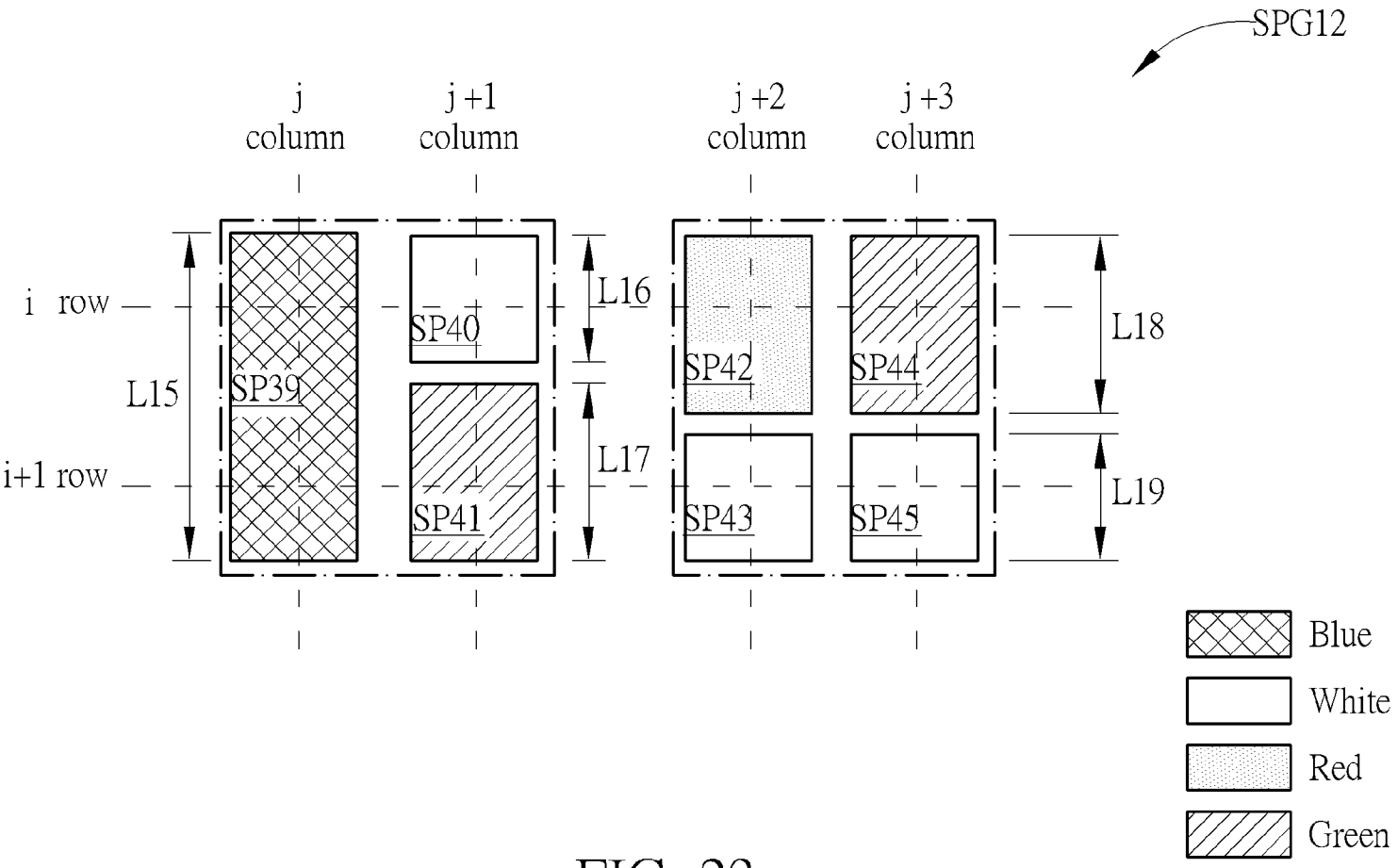
FIG. 23 is a schematic diagram of the sub-pixel group shown in FIG. 22.

In an example, the sizes of the sub-pixels SP25-SP31 in the sub-pixel group SPG7 shown in FIG. 16 may be appropriately modified. Please refer to FIG. 22, which is a schematic diagram of a display device 220 according to an example of the present invention. The display device 220 may be an electronic product with a liquid crystal panel, such as a television, a smart phone or a tablet, and is not limited herein. FIG. 22 only shows parts of sub-pixels of the display device 220 for illustrations. Note that, FIG. 22 is utilized for illustrating the relative positions of the sub-pixels and not for limiting the ratio between length and width. As shown in FIG. 22, the display device 220 comprises a plurality of repeatedly arranged sub-pixel groups SPG12 (only one sub-pixel group SPG12 is labeled in FIG. 22 for illustrations). In order to simplify the descriptions, please refer to FIG. 23 which is a schematic diagram of the sub-pixel group SPG12 shown in FIG. 22. In FIG. 23, the sub-pixel group SPG12 comprises sub-pixels SP39-SP45, wherein the arrangement of the sub-pixels SP39-SP45 is similar to that of the sub-pixel group SPG7 shown in FIG. 16. A height L15 of the sub-pixel 39 is different from or equal to the sum of the heights of the sub-pixels at the same column (e.g. the sum of a height L16 of the sub-pixel SP40 and a height L17 of the sub-pixel SP41 and the sum of a height L18 of the sub-pixels SP42, SP44 and a height L19 of the sub-pixels SP43, SP45) and is greater than the heights L16-L19. In comparison with the sub-pixel group SPG7 shown in FIG. 16, the height L18 of the sub-pixels SP42, SP44 changes to be greater than the height L19 of the sub-pixels SP43, SP45. Via the abovementioned arrangement of the sub-pixels SP39-SP45, the sub-pixel group SPG12 is corresponding to 2 pixels. That is, the number of the sub-pixels required by a pixel is decreased and the aperture ratio of the display device 220 is accordingly increased. The colors and the length-width relationships between the sub-pixels SP39-SP45 of the sub-pixel group SPG12 can be referred to those of the sub-pixels SP25-SP31 in the sub-pixel group SPG7, and are not narrated herein for brevity.

According to different applications and design concepts, the sizes of the sub-pixels SP25-SP31 in the sub-pixel group SPG7 shown in FIG. 16 may be appropriately modified and are not limited by those of the sub-pixel group SPG12 shown in FIG. 22. Please back to FIG. 16, the designer may modify the height of the sub-pixel SP28 to be greater than that of the sub-pixel SP29 in an example. In another example, the designer may modify the height of the sub-pixel SP26 to be greater than that of the sub-pixel SP27. In still another example, the designer may modify the heights of the sub-pixels SP26, SP28, SP30 to be greater than those of the sub-pixels SP27, SP29, SP31.

Note that, the vertical displacement may exist between sub-pixels of the display device 220 shown in FIG. 22 (e.g. the display device 170 shown in FIG. 17). In addition, the horizontal displacement may exist between sub-pixel groups at adjacent rows of the display device 220 shown in FIG. 22 (e.g. the display device 190 shown in FIG. 19). Moreover, the size of each sub-pixel and/or the color arrangement in the sub-pixel groups at adjacent rows in the display device may be different. According to different application and design concepts, those with ordinary skill in the art may observe appropriate alternations and modifications.

Figure 24:
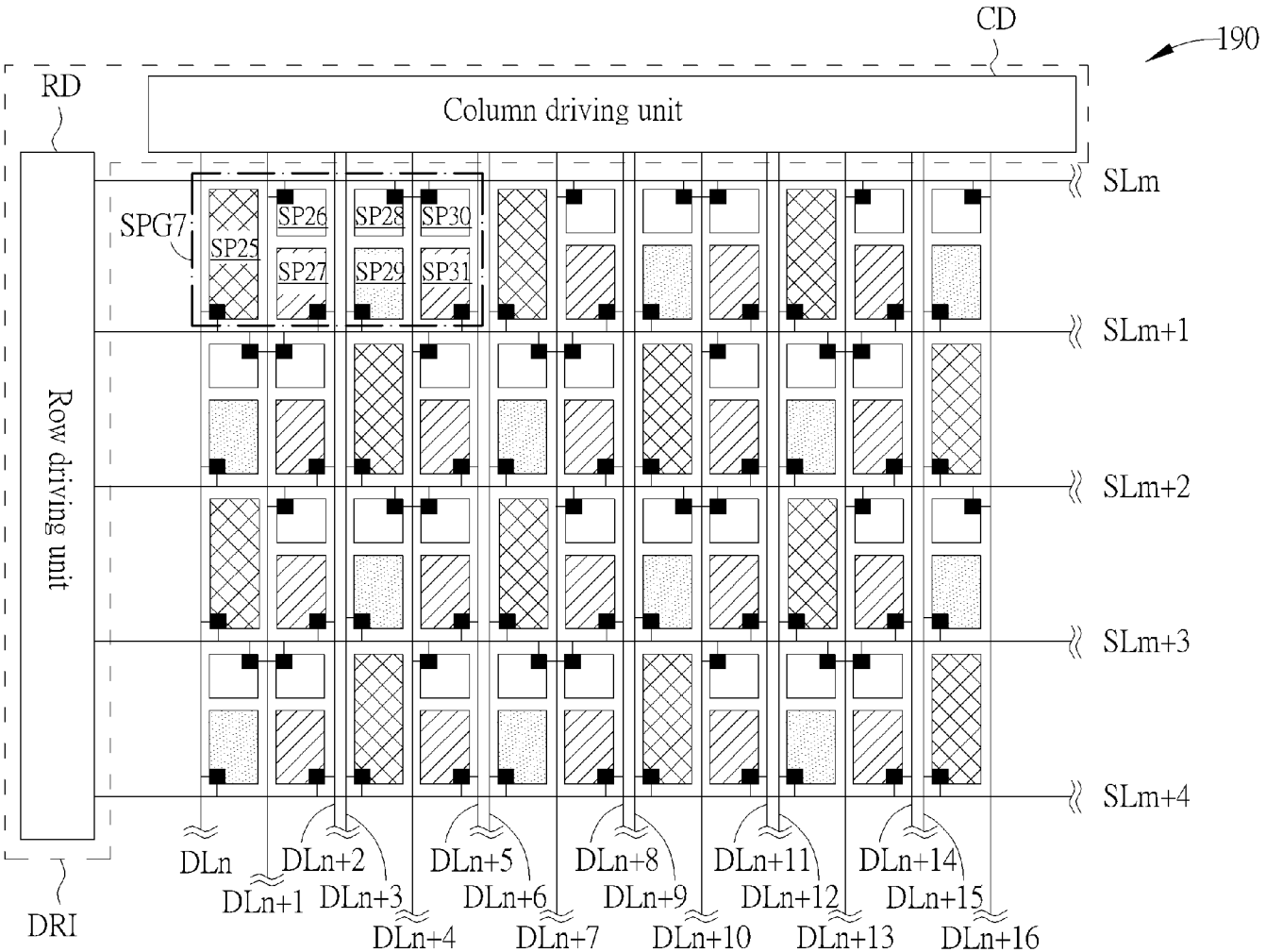
FIG. 24 is a schematic diagram of a circuit layout of the display device shown in FIG. 19.

The driving module (e.g. a driving IC) of the display device may need to be appropriately altered according to the sub-pixel arrangement of the above examples. Please jointly refer to FIG. 19 and FIG. 24, wherein FIG. 24 is a schematic diagram of a circuitry layout of the display device 190 shown in FIG. 19. As shown in FIG. 24, the display device 190 comprises a driving module DRI and a plurality of sub-pixel groups SPG7. The driving module DRI comprises a column driving unit CD and a row driving unit RD, which are utilized for driving data lines DL1-DLx and scan lines SL1-SLy, respectively, to control the display device 190 to display images. Note that, FIG. 24 only shows the data line DLn-DLn+16, the scan lines SLm-SLm+4 and parts of the plurality of sub-pixel groups SPG7 for illustrations. In the sub-pixel group SPG7 at the left-top corner, the sub-pixel SP25 is coupled to the data line DLn and the scan line SLm+1; the sub-pixel SP26 is coupled to the data line DLn+1 and the scan line SLm; the sub-pixel SP27 is coupled to the data line DLn+2 and the scan line SLm+1; the sub-pixel SP28 is coupled to the data line DLn+4 and the scan line SLm; the sub-pixel SP29 is coupled to the data line DLn+3 and the scan line SLm+1; the sub-pixel SP30 is coupled to the data line DLn+4 and the scan line SLm; and the sub-pixel SP31 is coupled to the data line DLn+5 and the scan line SLm+1. The relationships between the sub-pixels SP25-SP31 of rest sub-pixel groups SPG7 and the data lines DLn-DLn+16/scan lines SLm-SLm+4 in FIG. 24 can be referred to the abovementioned sub-pixel group SPG7 at left-top corner. In brief, the sub-pixels SP25, SP27, SP29, SP31 of the sub-pixel group SPG7 are coupled to the same scan line (e.g. the scan line SLm+1), the sub-pixels SP26, SP28, SP30 of the sub-pixel group SPG7 is coupled to an adjacent scan line (e.g. the scan line SLm), and the sub-pixels SP25-SP31 are respectively coupled to the closest data lines, wherein the sub-pixels SP28 and SP30 are coupled to the same data line since the sub-pixels SP28 and SP30 are corresponding to the same color. According to the coupling relationships between the sub-pixels and data lines shown in FIG. 24, the number of data lines in the display device 190 realized by repeatedly configuring the sub-pixel group SPG7 can be reduced and the layout space in the display device 190 is therefore increased.

Figure 19:
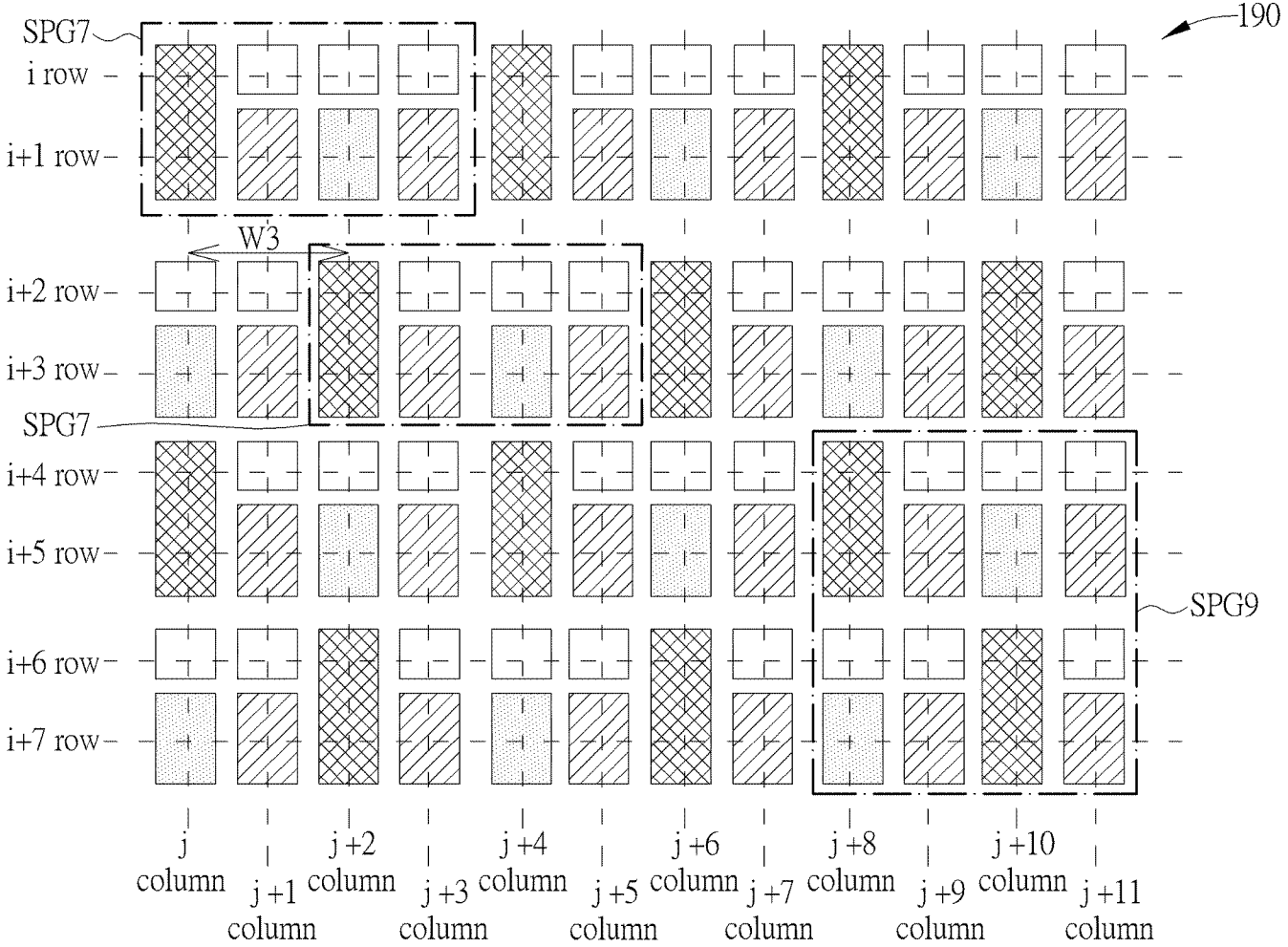
FIG. 19 is a schematic diagram of a display device according to an example of the present invention.
Figure 25:
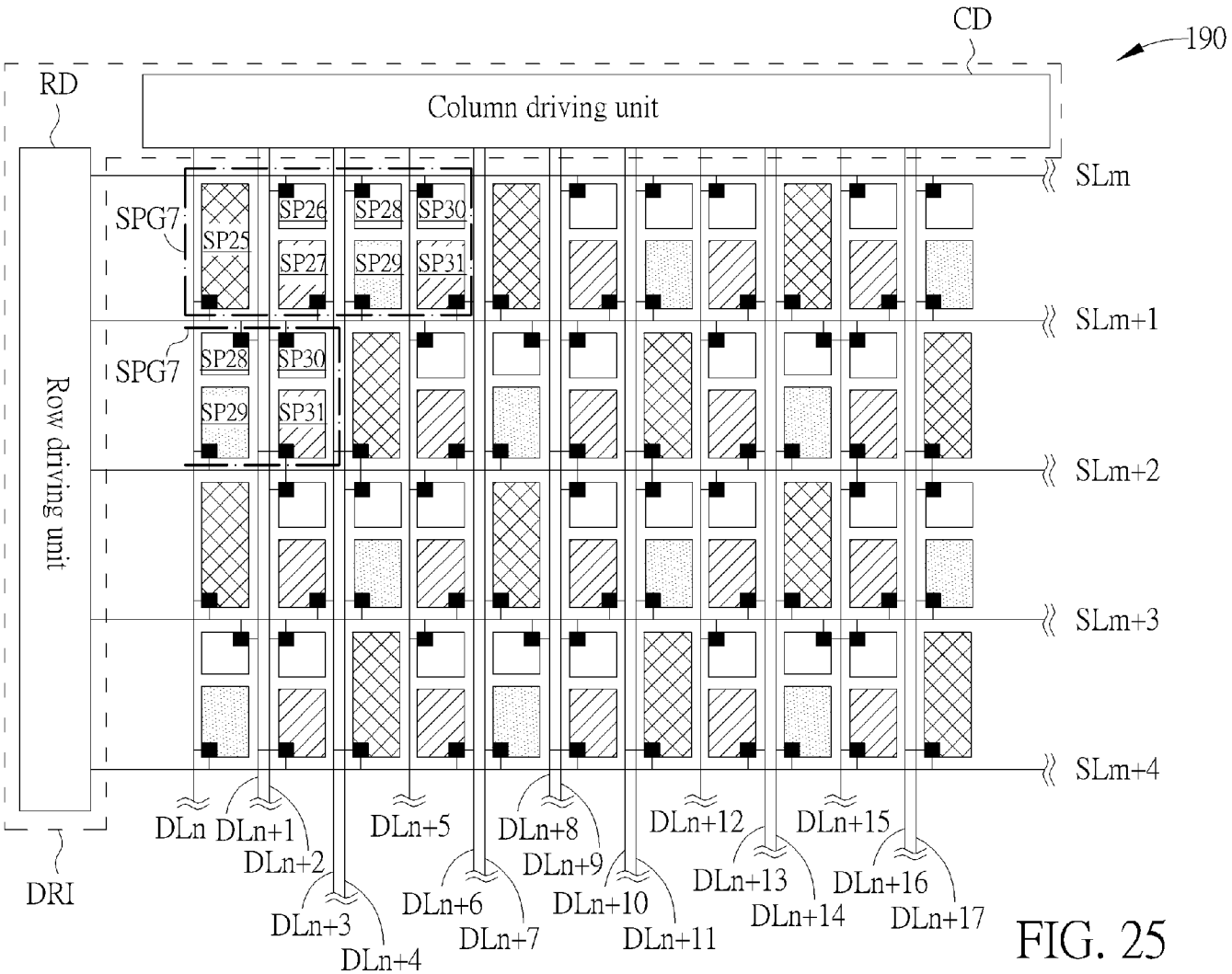
FIG. 25 is a schematic diagram of another circuit layout of the display device shown in FIG. 19.

Please jointly refer to FIG. 19 and FIG. 25, wherein FIG. 25 is a schematic diagram of a circuitry layout of the display device 190 shown in FIG. 19. As shown in FIG. 25, the display device 190 comprises a driving module DRI and a plurality of sub-pixel groups SPG7. The driving module DRI comprises a column driving unit CD and a row driving unit RD, which are utilized for driving data lines DL1-DLx and scan lines SL1-SLy, respectively, to control the display device 190 to display images. Note that, FIG. 25 only shows the data line DLn-DLn+17, the scan lines SLm-SLm+4 and parts of the plurality of sub-pixel groups SPG7 for illustrations. In the sub-pixel group SPG7 at the left-top corner, the sub-pixels SP25, SP27, SP29, SP31 are coupled to the scan line SLm+1, the sub-pixels SP26, SP28, SP30 are coupled to the scan line SLm, and the sub-pixels SP25-SP31 are coupled to the data line DLn, DLn+2, DLn+3, DLn+4, DLn+4, DLn+5, DLn+6, respectively. Although the sub-pixels SP28 and SP30 are corresponding to the same color, the sub-pixels SP28, SP30 are respectively coupled to the data lines DLn+4 and DLn+5 in this example. According to the coupling relationships between the sub-pixels and data lines shown in FIG. 25, the number of data lines in the display device 190 realized by repeatedly configuring the sub-pixel group SPG7 can be reduced and the layout space in the display device 190 is therefore increased.

Note that, the relationships between each of the sub-pixels SP25-SP31 and data lines DL1-DLx in the sub-pixels group SPG7 at adjacent rows are different in FIG. 25. For example, in another sub-pixel group SPG7 under the sub-pixel group SPG7 at the left-top corner, the sub-pixels SP28, SP29 are coupled to different data lines (i.e. the data lines DLn+1 and DLn), and the data line coupled to the sub-pixel SP31 is in front of that coupled to the sub-pixel SP30.

Figure 26:
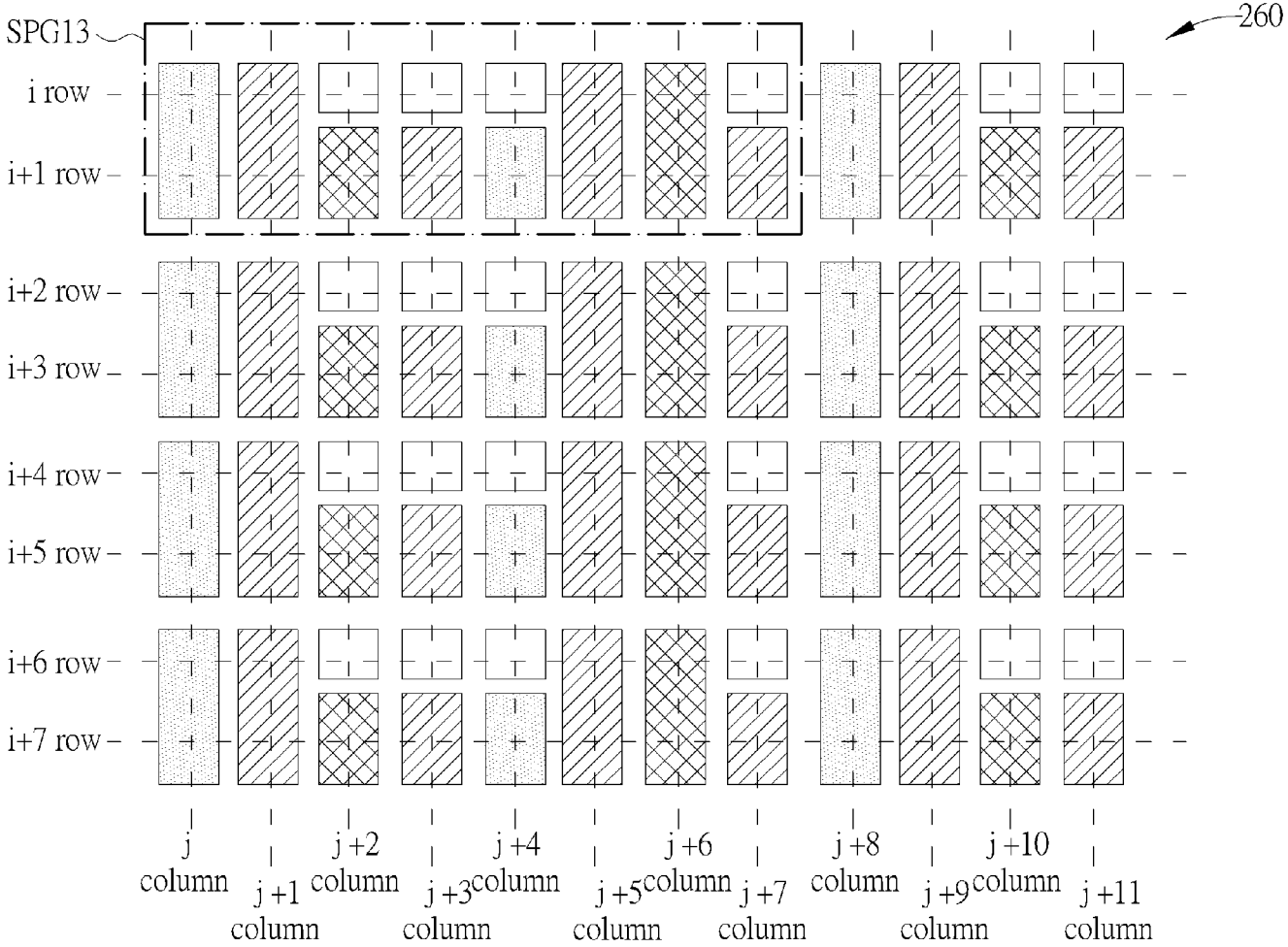
FIG. 26 is a schematic diagram of a display device according to an example of the present invention.
Figure 27:
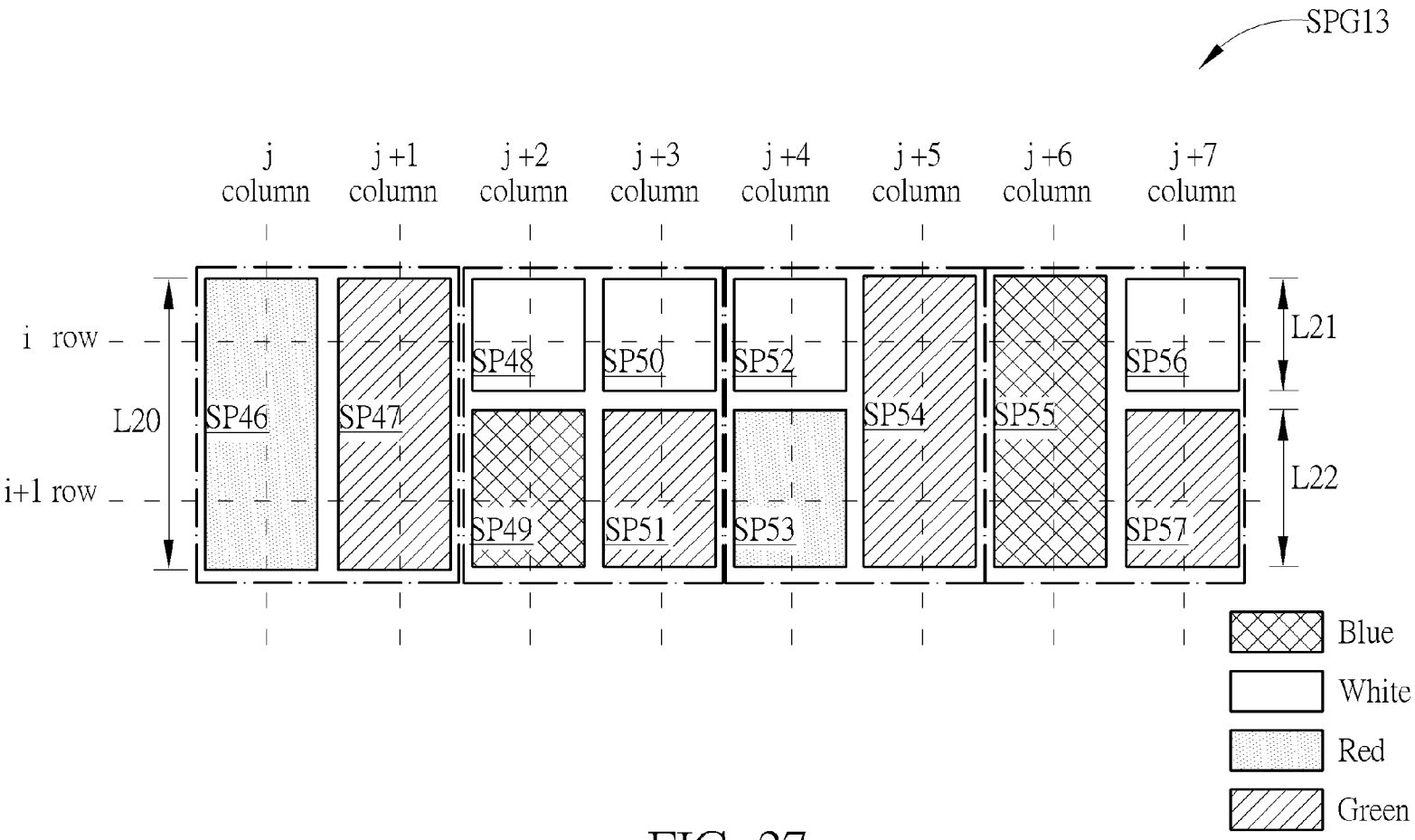
FIG. 27 is a schematic diagram of the sub-pixel group shown in FIG. 26.

Please refer to FIG. 26, which is a schematic diagram of a display device 260 according to an example of the present invention. The display device 260 may be an electronic product with a liquid crystal panel, such as a television, a smart phone or a tablet, and is not limited herein. FIG. 26 only shows parts of sub-pixels of the display device 260 for illustrations. Note that, FIG. 26 is utilized for illustrating the relative positions of the sub-pixels and not for limiting the ratio between length and width. As shown in FIG. 26, the display device 260 comprises a plurality of repeatedly arranged sub-pixel groups SPG13 (only one sub-pixel group SPG13 is marked in FIG. 26 for illustrations). In order to simplify the descriptions, please refer to FIG. 27 which is a schematic diagram of the sub-pixel group SPG13 shown in FIG. 26. In FIG. 27, the sub-pixel group SPG13 comprises sub-pixels SP46-SP57. The sub-pixel SP46 is configured at the j column, the i row and the i+1 row; the sub-pixel SP47 is configured at the j+1 column, the i row and the i+1 row; the sub-pixel SP48 is configured at the j+2 column and the i row; the sub-pixel SP49 is configured at the j+2 column and the i+1 row; the sub-pixel SP50 is configured at the j+3 column and the i row; the sub-pixel SP51 is configured at the j+3 column and the i+1 row; the sub-pixel SP52 is configured at the j+4 column and the i row; the sub-pixel SP53 is configured at the j+4 column and the i+1 row; the sub-pixel SP54 is configured at the j+5 column, the i row and the i+1 row; the sub-pixel SP55 is configured at the j+6 column, the i row and the i+1 row; the sub-pixel SP56 is configured at the j+7 column and the i row; and the sub-pixel SP57 is configured at the j+7 column and the i+1 row. The sub-pixels SP48 and SP49 may equip different or the same height, the sub-pixels SP50 and SP51 may equip different or the same height, the sub-pixels SP52 and SP53 may equip different or the same height, and the sub-pixels SP56 and SP57 may equip different or the same height. Via the abovementioned arrangement of the sub-pixels SP46-SP57, the sub-pixel group SPG13 is corresponding to 4 pixels. That is, the number of the sub-pixels corresponding to single pixel is reduced and the aperture ratio of display device 260 is therefore increased.

In detail, the sub-pixels SP46, SP47, SP54 and SP55 may have a same height L20, the sub-pixels SP48, SP50, SP52 and SP56 may have a same height L21 and the sub-pixels SP49, SP51, SP53, and SP57 may have a same height L22. The height L22 is greater than or equal to the height L21, the height L20 is greater than the heights L21 and L22, and the height L20 is different from or equal to the sum of the heights L21 and L22. That is, the rows of the sub-pixels SP48-SP53, SP56 and SP57 overlap those of the sub-pixel SP46.

In this example, the sub-pixels SP46-SP57 are corresponding to red, green, white, blue, white, green, white, red, green, blue, white and green. Via adding the sub-pixels SP48, SP50, SP52 and SP56 corresponding to white, the brightness of the display device 260 is increased and the power consumption of the display device 260 is decreased. According to different applications and design concepts, the colors corresponding to the sub-pixels SP46-SP57 in the sub-pixel group SPG13 may be changed and are not limited by those shown in FIG. 27. In an example, the sub-pixels SP46-SP57 may change to be corresponding to green, red, white, green, white, blue, white, green, red, green, white and blue. In the above examples, the sub-pixels corresponding to green in the sub-pixel group SPG13 are not adjacent to each other. In another example, the sub-pixels SP48, SP50, SP52 and SP56 may be altered to be corresponding to other color different from red, blue and green (e.g. yellow). In still another example, the sub-pixels SP46-SP57 are corresponding to more than 4 colors. That is, the sub-pixels SP46-SP57 in the sub-pixel group SPG13 are corresponding to at least 4 colors.

As to the relationships between the pixels and the sub-pixels SP46-SP57 in the sub-pixel group SPG13 please refer to the followings. As shown in FIG. 27, the sub-pixels SP46, SP47, the sub-pixels SP48-SP51, the sub-pixels SP52-SP54 and the sub-pixels SP55-SP57 are respectively corresponding to 4 pixels. If the problem of lacking colors occurs when the sub-pixels SP46, SP47, the sub-pixels SP48-SP51, the sub-pixels SP52-SP54 and/or the sub-pixels SP55-SP57 displays the corresponded pixel, the display device 260 may borrow the colors from surrounding pixels via adopting an algorithm (e.g. sub-pixel rendering algorithm), for displaying the corresponded pixel completely. In the sub-pixel group SPG13, 12 sub-pixels are corresponding to 4 pixels. The number of sub-pixels required by each pixel is decreased to 3. When the resolution of the display device 260 remains the same, the number of the sub-pixels utilized for realizing the display device 260 is reduced and the aperture ratio of the display device 260 is accordingly increased.

Figure 28:
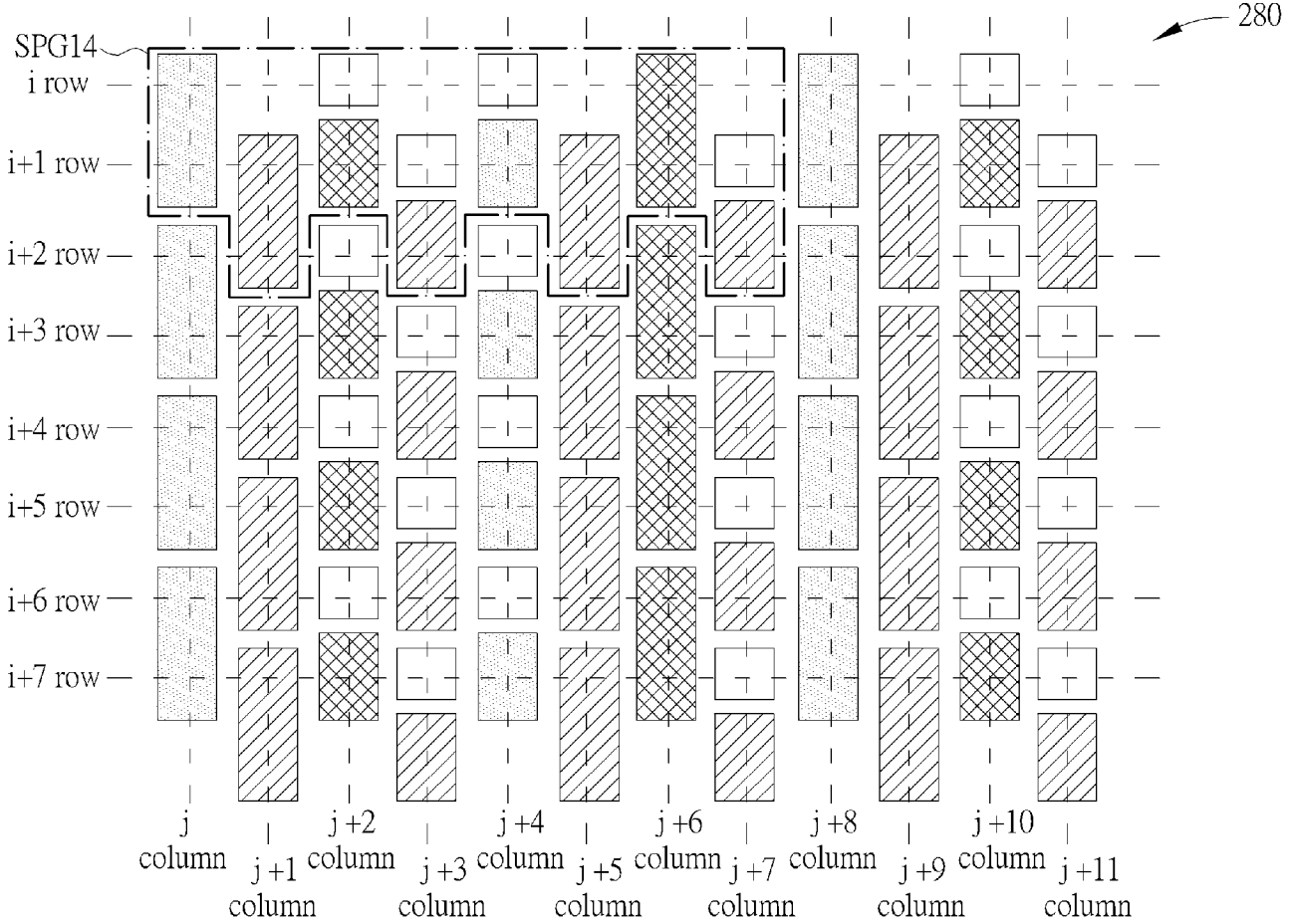
FIG. 28 is a schematic diagram of a display device according to an example of the present invention.
Figure 29:
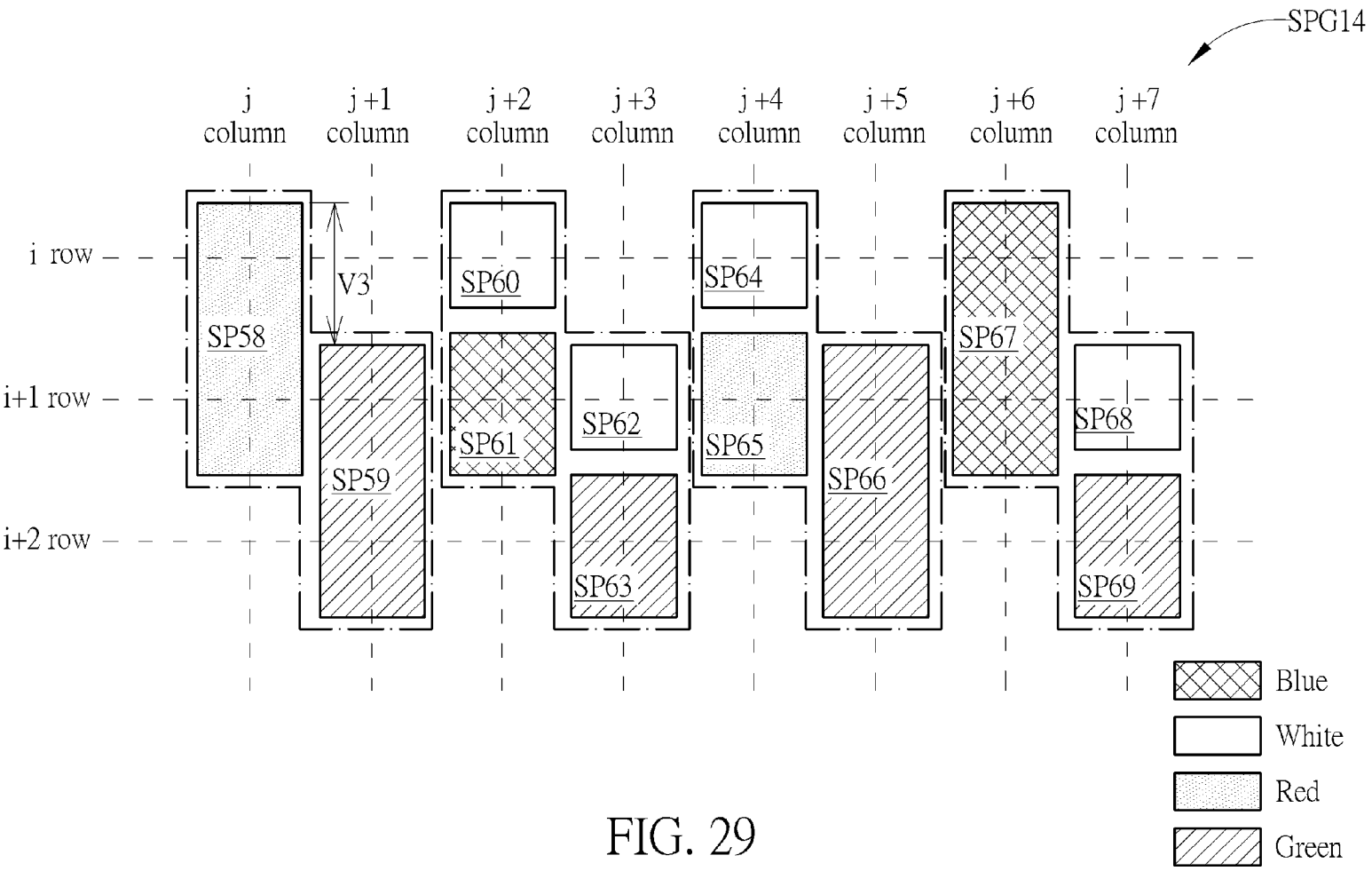
FIG. 29 is a schematic diagram of the sub-pixel group shown in FIG. 28.

In an example, a vertical displacement may exist between the sub-pixels of the display device 260 shown in FIG. 26. Please refer to FIG. 28, which is a schematic diagram of a display device 280 according to an example of the present invention. The display device 280 may be an electronic product with a liquid crystal panel, such as a television, a smart phone or a tablet, and is not limited herein. FIG. 28 only shows parts of sub-pixels of the display device 280 for illustrations. Note that, FIG. 28 is utilized for illustrating the relative positions of the sub-pixels and not for limiting the ratio between length and width. As shown in FIG. 28, the display device 280 comprises a plurality of repeatedly arranged sub-pixel groups SPG14 (only one sub-pixel group SPG14 is marked in FIG. 28 for illustrations). In order to simplify the descriptions, please refer to FIG. 29 which is a schematic diagram of the sub-pixel group SPG14 shown in FIG. 28. In FIG. 29, the sub-pixel group SPG14 comprises sub-pixels SP58-SP69 and the arrangement of the sub-pixels SP58-SP69 is similar to that of the sub-pixels SP46-SP57 of the sub-pixel group SPG13. In comparison with the sub-pixel group SPG13 shown in FIG. 27, the sub-pixels SP59 at the j+1 column, the sub-pixels SP62, SP63 at the j+3 column, the sub-pixel SP66 at the j+5 column and the sub-pixel SP68, SP69 at the j+7 column are shifted downwards a vertical displacement V3. Via the abovementioned arrangement of the sub-pixels SP58-SP69, the sub-pixel group SPG14 is corresponding to 4 pixels and the aperture ratio of the display device 280 is accordingly increased. The colors and the length-width relationships between the sub-pixels SP58-SP69 of the sub-pixel group SPG14 can be referred to those of the sub-pixels SP46-SP57 in the sub-pixel group SPG13, and are not narrated herein for brevity.

In the sub-pixel group SPG14 shown in FIG. 29, the rows of the sub-pixels SP59 and SP66 partially overlap those of the sub-pixel SP58; and the rows of the sub-pixels SP60-SP62, SP64, SP65, SP67 overlap those of the sub-pixels SP58. According to different applications and design concepts, the arrangement relationships between the sub-pixels SP58-SP69 may be appropriated modified. For example, the sub-pixels SP62, SP63 may change to be shifted upwards, such that only the rows of the sub-pixel SP63 overlap those of the sub-pixel SP58. Similarly, the sub-pixels SP60, SP61 may be shifted vertically, such that the rows of at least one of the sub-pixels SP60 and SP61 overlap those of the sub-pixel SP58. In other words, the rows of at least one of the sub-pixels located at the same column overlap those of the sub-pixel SP58 in the sub-pixel group SPG14.

In an example, a horizontal displacement may exist between the sub-pixel groups SPG13 located at the adjacent rows in the display device 260 shown in FIG. 26. Please refer to FIG. 30, which is a schematic diagram of a display device 300 according to an example of the present invention. The display device 300 is similar to the display device 260 shown in FIG. 26, thus the components and the signals with the same functions use the same symbols. Different from the display device 260, a horizontal displacement WE exists between the sub-pixel groups SPG13 configured at the adjacent rows (e.g. the sub-pixel groups SPG13 located at the i row and the i+1 row and those located at the i+2 row and the i+3 row). In this example, the horizontal displacement WE is half of the one-fourth of the sub-pixel group SPG13. As a result, the display device 300 equipping different sub-pixel arrangement can be realized by the sub-pixel group SPG13. In addition, the sub-pixel group SPG15 shown in FIG. 30 also can be regarded as the repeated sub-pixel group in this example. In other words, the display device 300 shown in FIG. 30 can be acquired by repeatedly arranging the sub-pixel group SPG15.

Figure 31:
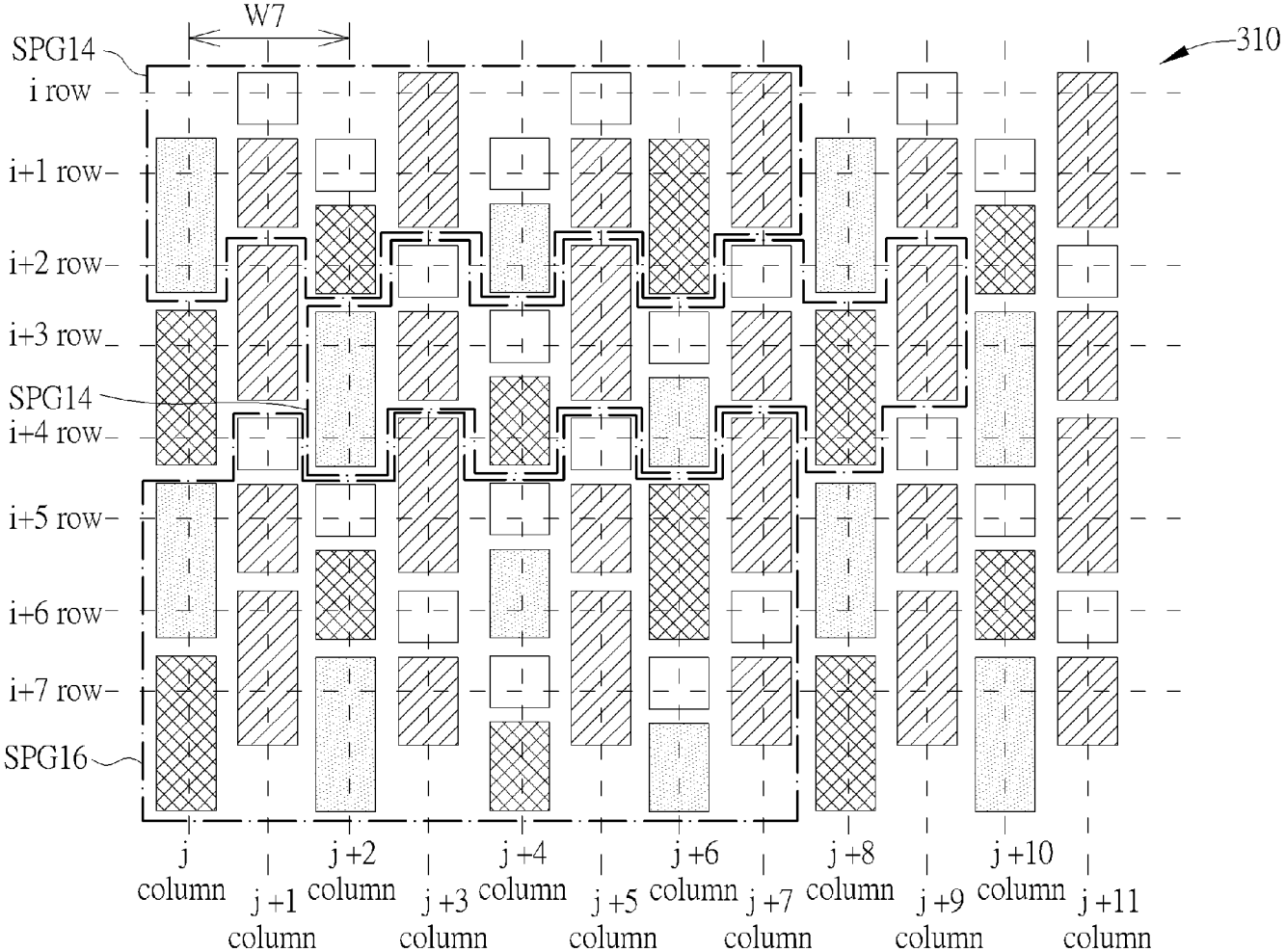
FIG. 31 is a schematic diagram of a display device according to an example of the present invention.

In an example, a horizontal displacement may exist between the sub-pixel groups SPG13 located at adjacent rows and a vertical displacement may exist between sub-pixels SP46-SP57 of the sub-pixel group SPG13 in the display device 260 shown in FIG. 26. That is, a horizontal displacement may exist between the sub-pixel groups SPG14 located at adjacent rows in the display device 280 shown in FIG. 28. Please refer to FIG. 31, which is a schematic diagram of a display device 310 according to an example of the present invention. The display device 310 is similar to the display device 280 shown in FIG. 28, thus the components and the signal with the similar functions use the same symbols. Different from the display device 280, a horizontal displacement W7 exists between the sub-pixel groups SPG14 located at adjacent rows (e.g. the sub-pixel groups SPG14 located at the i–i+2 rows and the i+1–i+3 rows). In this example, the horizontal displacement W7 is one-fourth of the width of the sub-pixel group SPG14. As a result, the display device 310 equipping different sub-pixel arrangement can be realized by the sub-pixel group SPG14. In addition, the sub-pixel group SPG16 shown in FIG. 31 also can be regarded as the repeated sub-pixel group. That is, the display device 310 shown in FIG. 31 can be acquired by repeatedly arranging the sub-pixel group SPG16.

Figure 32:
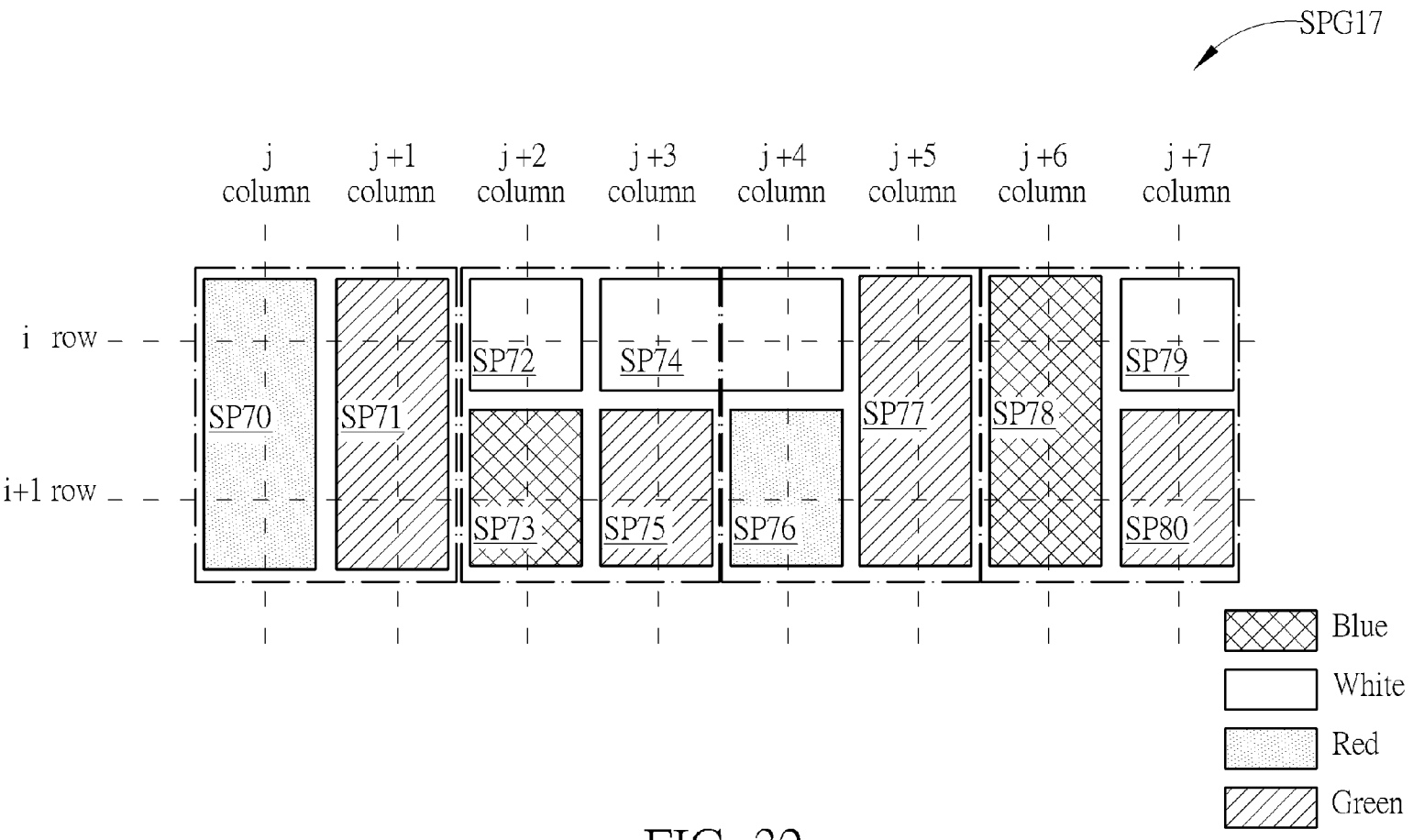
FIG. 32 is a schematic diagram of the sub-pixel group according to an example of the present invention.

In an example, the adjacent sub-pixels in the sub-pixel group SPG13 shown in FIG. 27 may be combined. Please refer to FIG. 32, which is a schematic diagram of a sub-pixel group SPG17 according to an example of the present invention. In FIG. 32, the sub-pixel group SPG17 comprises sub-pixels SP70-SP80, wherein the arrangement of the sub-pixels SP70-SP80 is similar to that of the sub-pixel group SPG13 shown in FIG. 27. In comparison with the sub-pixel group SPG13 shown in FIG. 27, the sub-pixels SP50 and SP52 at the j+3 and j+4 columns are combined to be the sub-pixel SP74. Via the abovementioned arrangement of the sub-pixels SP70-SP80, the sub-pixel group SPG17 is corresponding to 4 pixels. That is, the number of the sub-pixels corresponding to single pixel is reduced and the aperture ratio of display device is therefore increased. The colors and the length-width relationships of the sub-pixels SP70-SP80 of the sub-pixel group SPG17 can be referred to those of the sub-pixels SP46-SP57 in the sub-pixel group SPG13, and are not narrated herein for brevity.

Figure 33:
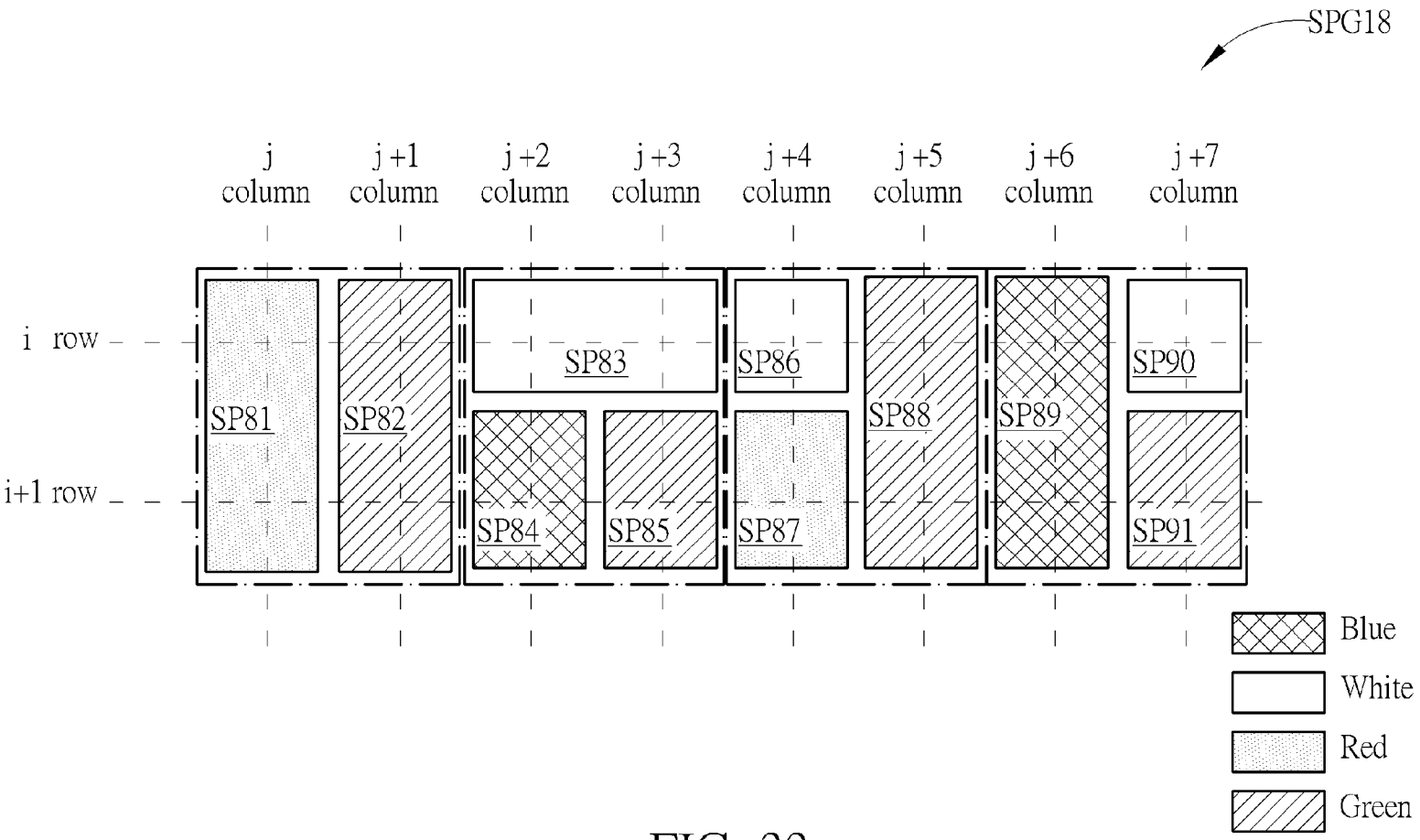
FIG. 33 is a schematic diagram of the sub-pixel group according to an example of the present invention.

Please refer to FIG. 33, which is a schematic diagram of a sub-pixel group SPG18 according to an example of the present invention. In FIG. 33, the sub-pixel group SPG18 comprises sub-pixels SP81-SP91, wherein the arrangement of the sub-pixels SP81-SP91 is similar to that of the sub-pixel group SPG13 shown in FIG. 27. In comparison with the sub-pixel group SPG13 shown in FIG. 27, the sub-pixels SP48 and SP50 at the j+2 and j+3 columns are combined to be the sub-pixel SP83. Via the abovementioned arrangement of the sub-pixels SP70-SP80, the sub-pixel group SPG18 is corresponding to 4 pixels. That is, the number of the sub-pixels corresponding to single pixel is reduced and the aperture ratio of display device is therefore increased. The colors and the length-width relationships of the sub-pixels SP81-SP91 of the sub-pixel group SPG18 can be referred to those of the sub-pixels SP46-SP57 in the sub-pixel group SPG13, and are not narrated herein for brevity.

Figure 34:
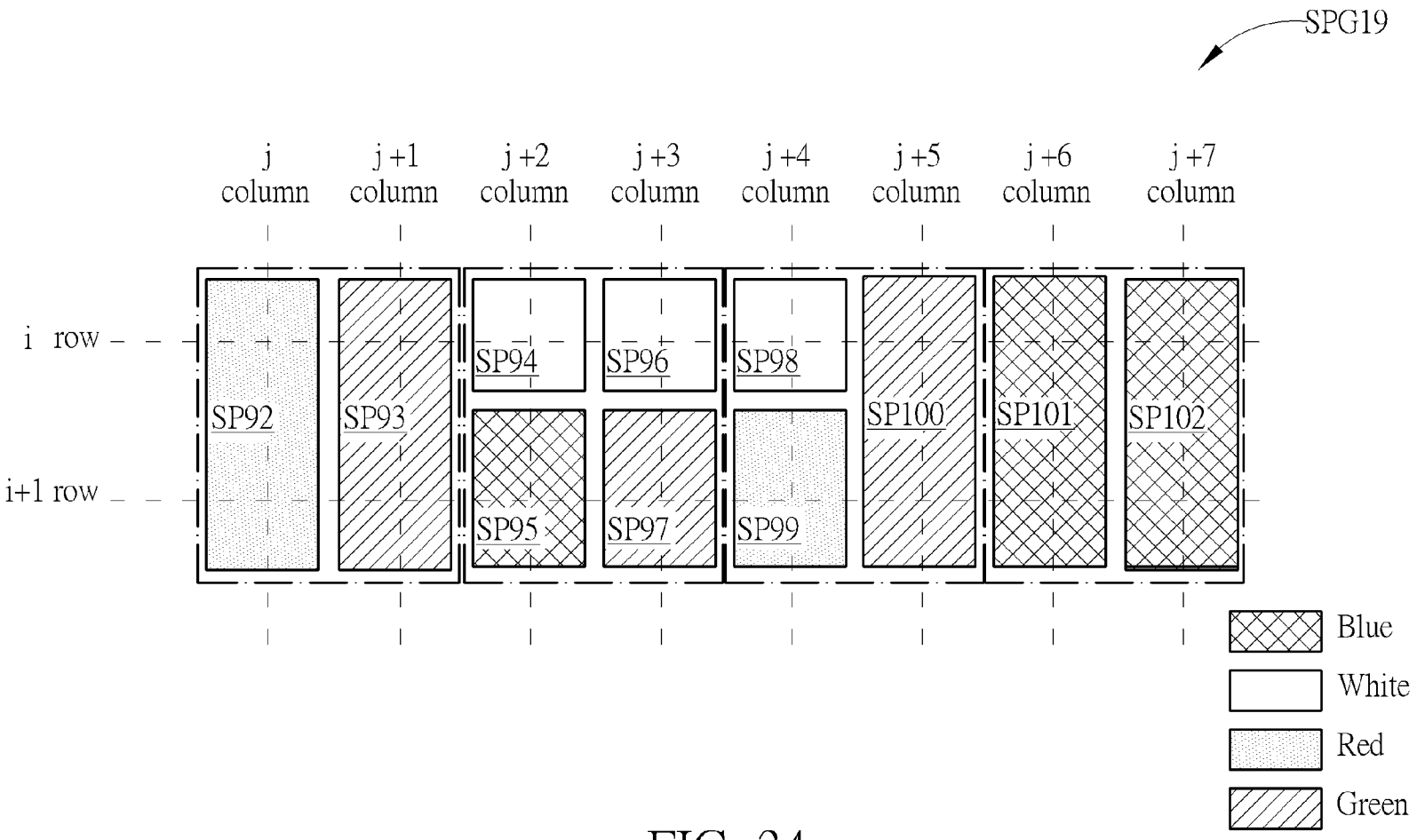
FIG. 34 is a schematic diagram of the sub-pixel group according to an example of the present invention.

Please refer to FIG. 34, which is a schematic diagram of a sub-pixel group SPG19 according to an example of the present invention. In FIG. 34, the sub-pixel group SPG19 comprises sub-pixels SP92-SP102, wherein the arrangement of the sub-pixels SP92-SP102 is similar to that of the sub-pixel group SPG13 shown in FIG. 27. In comparison with the sub-pixel group SPG13 shown in FIG. 27, the sub-pixels SP56 and SP57 at the j+7 column are combined to be the sub-pixel SP102. Via the abovementioned arrangement of the sub-pixels SP92-SP102, the sub-pixel group SPG19 is corresponding to 4 pixels. That is, the number of the sub-pixels corresponding to single pixel is reduced and the aperture ratio of display device is therefore increased. The colors and the length-width relationships of the sub-pixels SP92-SP102 of the sub-pixel group SPG19 can be referred to those of the sub-pixels SP46-SP57 in the sub-pixel group SPG13, and are not narrated herein for brevity.

According to different application and design concepts, the multiple sets of adjacent sub-pixels may be simultaneously combined. For example, the designer may combine the sub-pixels SP48, SP50 (e.g. the sub-pixel group SPG18) and the sub-pixels SP56, SP57 (e.g. the sub-pixel group SPG19) at the same time. Or, the designer may combine the sub-pixels SP50, SP52 (e.g. the sub-pixel group SPG17) and the sub-pixels SP56, SP57 (e.g. the sub-pixel group SPG19) at the same time.

Figure 35:
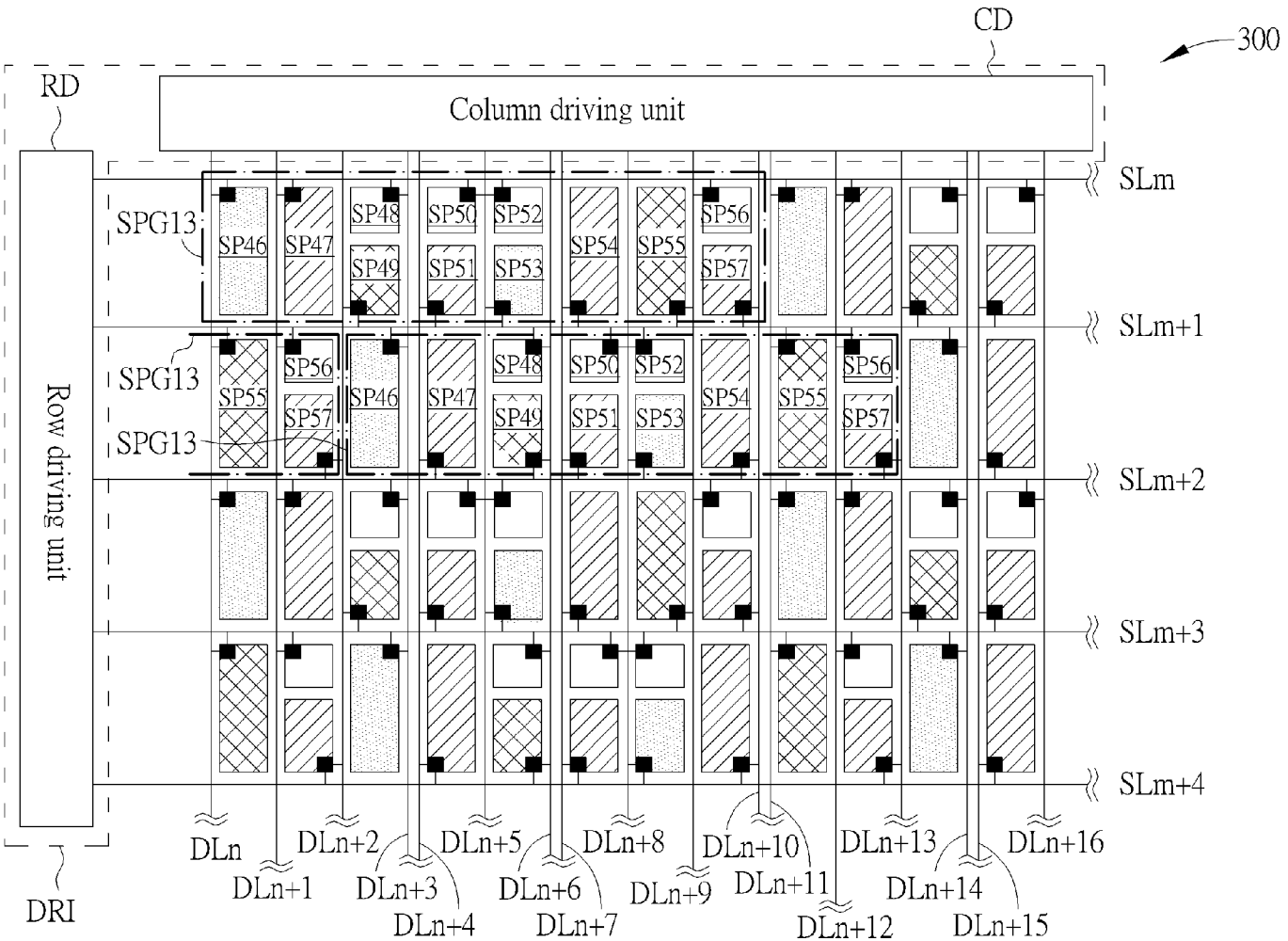
FIG. 35 is a schematic diagram of a circuit layout of the display device shown in FIG. 30.

The driving module (e.g. a driving IC)) of the display device may need to be appropriately altered according to the sub-pixel arrangement of the above examples. Please jointly refer to FIG. 35 and FIG. 30, wherein FIG. 35 is a schematic diagram of a circuitry layout of the display device 300 shown in FIG. 30. As shown in FIG. 35, the display device 300 comprises a driving module DRI and a plurality of sub-pixel groups SPG13. The driving module DRI comprises a column driving unit CD and a row driving unit RD, which are utilized for driving data lines DL1-DLx and scan lines SL1-SLy, respectively, to control the display device 300 to display images. Note that, FIG. 35 only shows the data line DLn-DLn+16, the scan lines SLm-SLm+4 and parts of the plurality of sub-pixel groups SPG13 for illustrations. In the sub-pixel group SPG13 at the left-top corner, the sub-pixels SP46-SP48, SP50, SP52 and SP56 are coupled to the scan line SLm and the sub-pixels SP49, SP51, SP53-SP55, and SP57 are coupled to the scan line SLm+1. In addition, the sub-pixels SP46-SP57 are coupled to the data lines DLn, DLn+1, DLn+3, DLn+2, DLn+5, DLn+4, DLn+5, DLn+5, DLn+7, DLn+9, DLn+9 and DLn+10, respectively. According to the coupling relationships between the sub-pixels and data lines shown in FIG. 35, the number of data lines in the display device 300 realized by repeatedly configuring the sub-pixel group SPG13 can be reduced and the layout space in the display device 300 is therefore increased.

Note that, the relationships between each of the sub-pixels SP46-SP57 and data lines DL1-DLx/scan lines SL1-SLy in the sub-pixels group SPG13 at adjacent rows are different in FIG. 35. For example, in another sub-pixel group SPG13 under the sub-pixel group SPG13 at the left-top corner, the sub-pixel SP47 changes to be coupled to the scan line SLm+2 and the sub-pixel SP55 changes to be coupled to the scan line SLm+1. In addition, the sub-pixel SP48 and SP49 are coupled to the same data line DLn+6.

Figure 30:
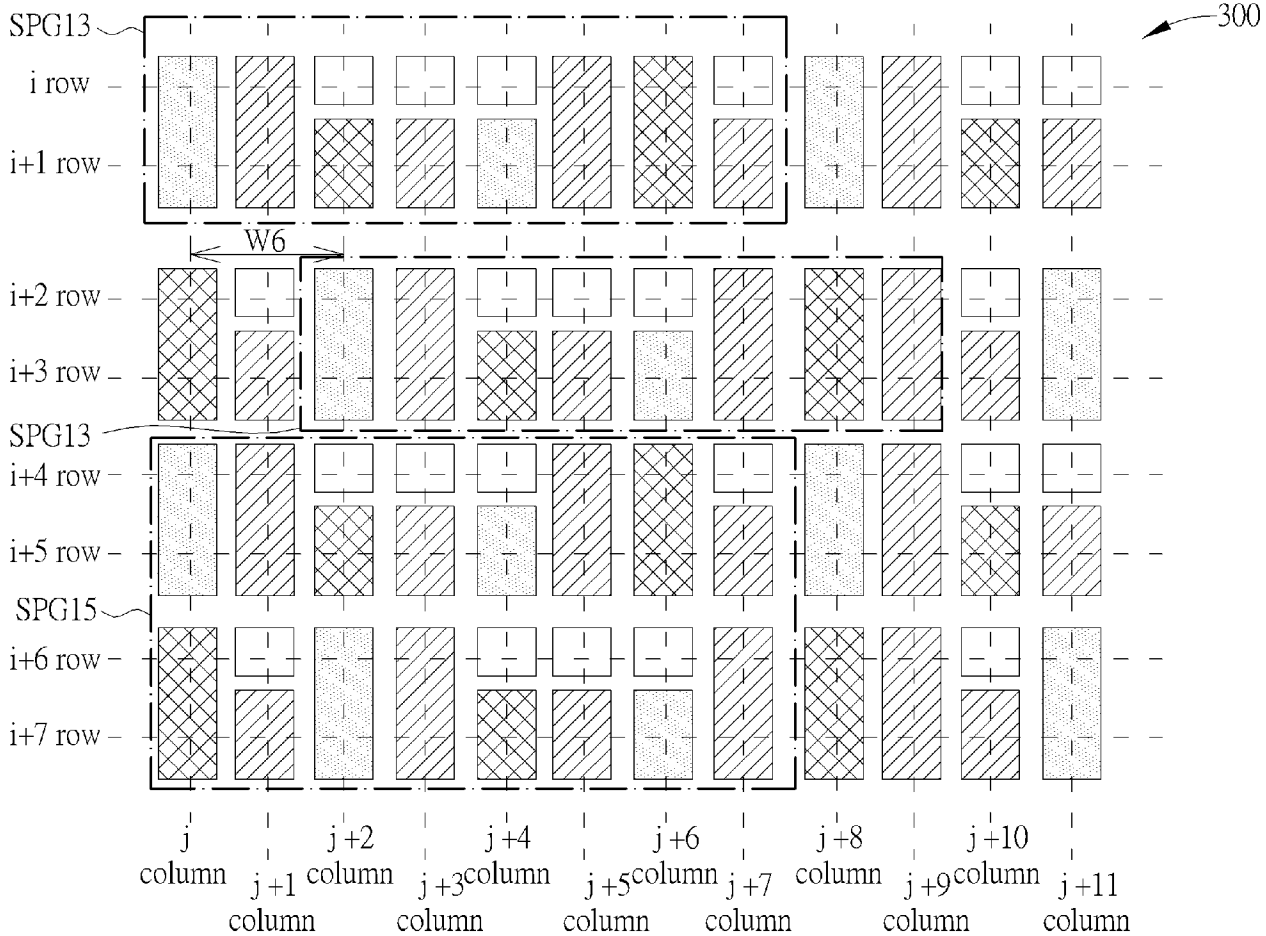
FIG. 30 is a schematic diagram of a display device according to an example of the present invention.
Figure 36:
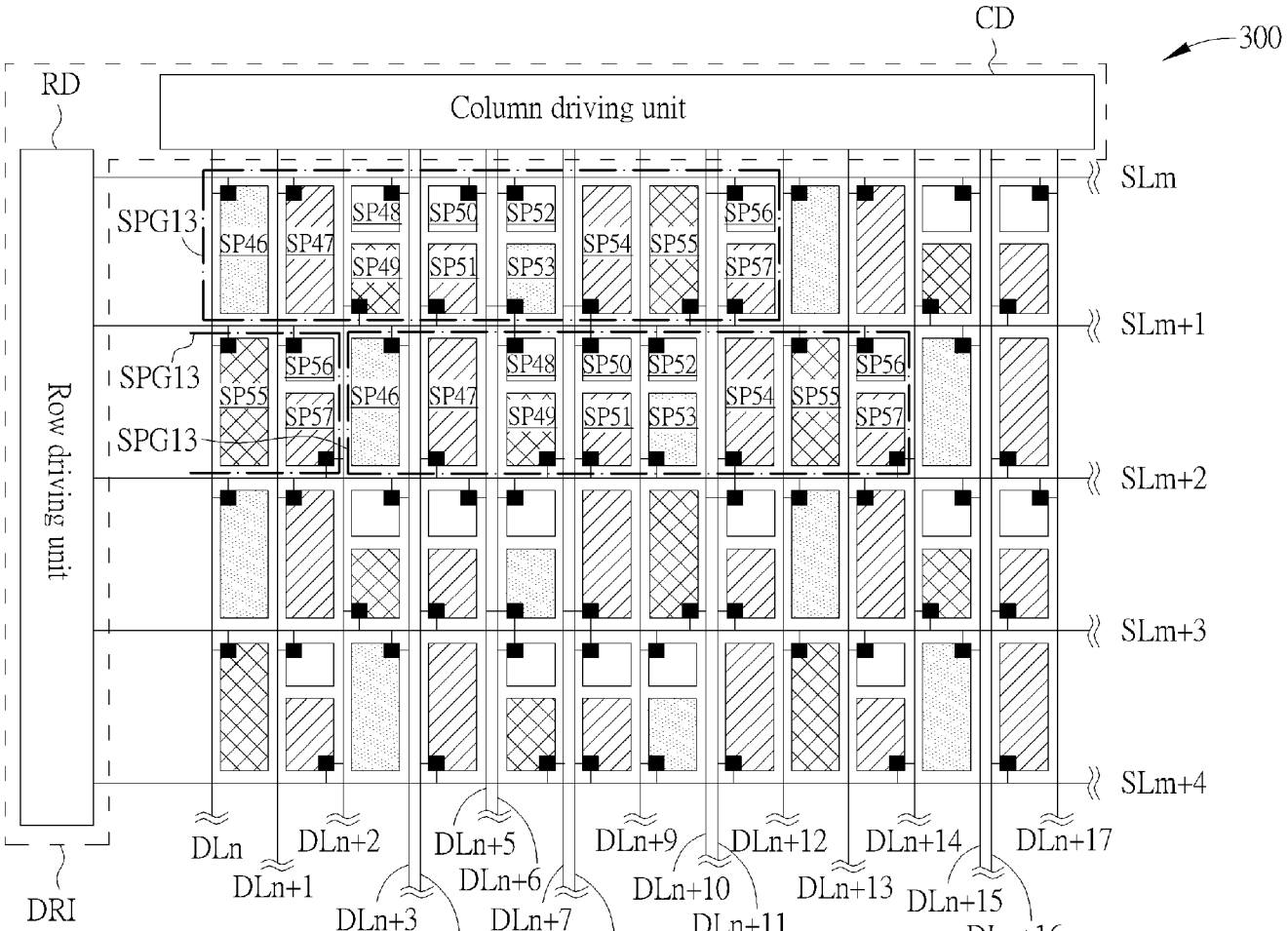
FIG. 36 is a schematic diagram of another circuit layout of the display device shown in FIG. 30.

Please jointly refer to FIG. 36 and FIG. 30, wherein FIG. 36 is a schematic diagram of a circuitry layout of the display device 300 shown in FIG. 30. As shown in FIG. 36, the display device 300 comprises a driving module DRI and a plurality of sub-pixel groups SPG13. The driving module DRI comprises a column driving unit CD and a row driving unit RD, which are utilized for driving data lines DL1-DLx and scan lines SL1-SLy, respectively, to control the display device 300 to display images. Note that, FIG. 36 only shows the data line DLn-DLn+17, the scan lines SLm-SLm+4 and parts of the plurality of sub-pixel groups SPG13 for illustrations. In comparison with FIG. 35, the coupling relationships between each of the sub-pixels SP46-SP57 and the scan lines SLm, SLm+1 remain the same. Note that, the sub-pixels SP50 and SP52 change to be coupled to different data lines, thus the sub-pixels SP46-SP57 are coupled to DLn, DLn+1, DLn+3, DLn+2, DLn+5, DLn+4, DLn+6, DLn+5, DLn+7, DLn+10, DLn+10 and DLn+11, respectively. According to the coupling relationships between the sub-pixels and data lines shown in FIG. 36, the number of data lines in the display device 300 realized by repeatedly configuring the sub-pixel group SPG13 can be reduced and the layout space in the display device 300 is therefore increased.

Note that, the relationships between each of the sub-pixels SP46-SP57 and data lines DL1-DLx/scan lines SL1-SLy in the sub-pixels group SPG13 at adjacent rows are different in FIG. 36. For example, in another sub-pixel group SPG13 under the sub-pixel group SPG13 at the left-top corner, the sub-pixel SP47 changes to be coupled to the scan line SLm+2 and the sub-pixel SP55 changes to be coupled to the scan line SLm+1. In addition, the sequence of the data lines coupled to the sub-pixels SP48, SP49 reverses, the sub-pixels SP50, SP51 change to be coupled to the same data lines DLn+8, the sub-pixels SP52, SP53 change to be coupled to the same data line DLn+9.

Figure 37:
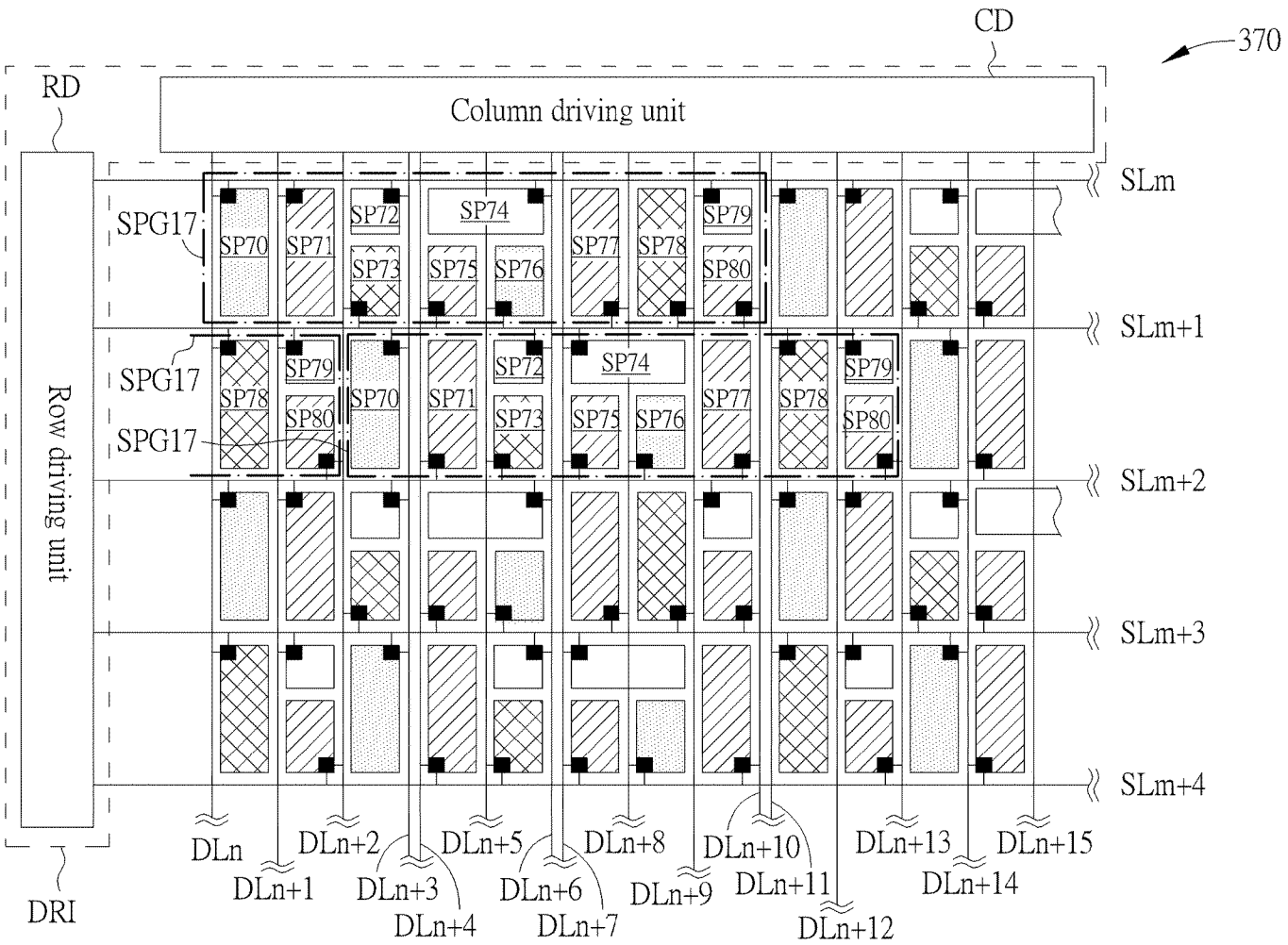
FIG. 37 is a schematic diagram of still another circuit layout of the display device shown in FIG. 30.

Please refer to FIG. 37, which is a schematic diagram of a circuitry layout of a display device 370 according to an example of the present invention. As shown in FIG. 37, the display device 370 comprises a driving module DRI and a plurality of sub-pixel groups SPG17 shown in FIG. 32. The driving module DRI comprises a column driving unit CD and a row driving unit RD, which are utilized for driving data lines DL1-DLx and scan lines SL1-SLy, respectively, to control the display device 370 to display images. Note that, FIG. 37 only shows the data line DLn-DLn+15, the scan lines SLm-SLm+4 and parts of the plurality of sub-pixel groups SPG17 for illustrations. In the sub-pixel group SPG13 at the left-top corner, the sub-pixels SP70-SP72, SP74 and SP79 are coupled to the scan line SLm and the sub-pixels SP73, SP75-SP78, and SP80 are coupled to the scan line SLm+1. In addition, the sub-pixels SP70-SP80 are coupled to the data lines DLn, DLn+1, DLn+3, DLn+2, DLn+6, DLn+4, DLn+5, DLn+8, DLn+9, DLn+9, and DLn+10, respectively. According to the coupling relationships between the sub-pixels and data lines shown in FIG. 37, the number of data lines in the display device 370 realized by repeatedly configuring the sub-pixel group SPG17 can be reduced and the layout space in the display device 370 is therefore increased.

To sum up, the above examples reduce the number of sub-pixels for realizing the display device via changing the sub-pixel arrangement in the display device, so as to increase the aperture ratio and to decrease the power consumption and the layout area of the display device. Moreover, the brightness of the display device is increased and the power consumption is further decreased via adding the sub-pixels corresponding to white.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device comprising a plurality of sub-pixel groups, wherein each of sub-pixel groups comprising:

a first sub-pixel, located at a first column;

a second sub-pixel, located at a second column adjacent to the first column;

a third sub-pixel, located at a third column adjacent to the second column;

a fourth sub-pixel, located at the third column;

a fifth sub-pixel, located at a fourth column adjacent to the third column; and a sixth sub-pixel, located at the fourth column;

wherein a height of the first sub-pixel is different from or equal to a height of the second sub-pixel;

wherein a height of the first sub-pixel is greater than heights of the third sub-pixel and the fourth sub-pixel;

wherein the height of the first sub-pixel is greater than or equal to a sum of the heights of the third sub-pixel and the fourth sub-pixel;

wherein the height of the first sub-pixel is different from or equal to a sum of the heights of the fifth sub-pixel and the sixth sub-pixel;

wherein the height of the third sub-pixel is different from or equal to the height of the fourth sub-pixel and the height of the fifth sub-pixel is different from or equal to the height of the sixth sub-pixel;

wherein the sub-pixels corresponding to the same color among the first sub-pixel, the second sub-pixel, the third sub-pixel, the fourth sub-pixel, the fifth sub-pixel and the sixth sub-pixel have different areas.

2. The display device of claim 1, wherein the row of the second sub-pixel partially overlaps the row of the first sub-pixel, the row of at least one of the third sub-pixel and the fourth sub-pixel overlaps the row of the first sub-pixel, and the row of at least one of the fifth sub-pixel and the sixth sub-pixel overlaps the row of the first sub-pixel.

3. The display device of claim 1, wherein the first sub-pixel, the second sub-pixel, the third sub-pixel, the fourth sub-pixel, the fifth sub-pixel and the sixth sub-pixel are corresponding to at least four colors.

4. The display device of claim 1, wherein a horizontal displacement exists between the sub-pixel groups located at adjacent rows.

5. A driving module in a display device comprising a plurality of sub-pixel groups and used for driving the display device to display images, wherein each of the plurality of sub-pixel groups comprises a first sub-pixel, located at a first column; a second sub-pixel, located at a second column adjacent to the first column; a third sub-pixel, located at a third column adjacent to the second column; a fourth sub-pixel, located at the third column; a fifth sub-pixel, located at a fourth column adjacent to the third column; and a sixth sub-pixel, located at the fourth column; wherein a height of the first sub-pixel is different from or equal to a height of the second sub-pixel; wherein a height of the first sub-pixel is greater than heights of the third sub-pixel and the fourth sub-pixel; wherein the height of the first sub-pixel is greater than or equal to a sum of the heights of the third sub-pixel and the fourth sub-pixel; wherein the height of the first sub-pixel is different from or equal to a sum of the heights of the fifth sub-pixel and the sixth sub-pixel; wherein the height of the third sub-pixel is different from or equal to the height of the fourth sub-pixel and the height of the fifth sub-pixel is different from or equal to the height of the sixth sub-pixel; wherein the sub-pixels corresponding to the same color among the first sub-pixel, the second sub-pixel, the third sub-pixel, the fourth sub-pixel, the fifth sub-pixel and the sixth sub-pixel have different areas.

6. The driving module of claim 5, comprising:

a gate driver, for driving a plurality of scan lines, wherein the first sub-pixel, the second sub-pixel, the fourth sub-pixel and the sixth sub-pixel of a first sub-pixel group are coupled to a first scan line of the plurality scan lines and the third sub-pixel and the fifth sub-pixel of the first sub-pixel groups are coupled to a second scan line adjacent to the first scan line; and a source driver, for driving a plurality of data lines, wherein the first sub-pixel of the first sub-pixel group is coupled to a first data line of the plurality of data lines, the second sub-pixel of the first sub-pixel group is coupled to a second data line, the fourth sub-pixel of the first sub-pixel group is coupled to a third data line adjacent to the second data line, the sixth sub-pixel of the first sub-pixel group is coupled to a fourth data line; the third sub-pixel of the first sub-pixel group is coupled to a fifth data line; and the fifth sub-pixel of the first sub-pixel group is coupled to a sixth data line;

wherein at least one data line is between the first data line and the second data line.

7. The driving module of claim 6, wherein the fifth data line and the sixth data line are a same data line between the third data line and the fourth data line.

8. The driving module of claim 6, wherein the fifth data line is the third data line and the sixth data line is the fourth data line.

* * * * *